US005540421A

United States Patent [19]

Ohta et al.

[11] Patent Number: 5,540,421

[45] Date of Patent: Jul. 30, 1996

[54] BOOK BINDING APPARATUS

[75] Inventors: Hiroshi Ohta; Yuji Takahashi, both of Tokyo; Kimiaki Hayakawa; Toshihiko Kusumoto, both of Yokohama; Yoshimasu Yamaguchi, Kawasaki; Hideaki Kosasa, Tokyo; Yuji Yamanaka; Kozo Sakakibara, both of Yokohama, all of Japan

[73] Assignee: Canon Kabushiki Kaisha, Tokyo, Japan

[21] Appl. No.: 278,265

[22] Filed: Jul. 21, 1994

[30] Foreign Application Priority Data

| | | | |
|---|---|---|---|
| Jul. 30, 1993 | [JP] | Japan | 5-208813 |
| Jul. 30, 1993 | [JP] | Japan | 5-208814 |
| Jul. 30, 1993 | [JP] | Japan | 5-208815 |
| Dec. 20, 1993 | [JP] | Japan | 5-344910 |
| Dec. 20, 1993 | [JP] | Japan | 5-344914 |

[51] Int. Cl.[6] ..... B42B 5/00; B42C 9/00

[52] U.S. Cl. ..... 270/58.19; 355/324; 270/58.09

[58] Field of Search ..... 270/53; 355/324; 412/33, 36, 37

[56] References Cited

U.S. PATENT DOCUMENTS

| | | | |
|---|---|---|---|
| 4,540,458 | 9/1985 | Baughman et al. | 355/324 X |
| 4,611,741 | 9/1986 | Wilson | 270/53 X |
| 4,782,363 | 11/1988 | Britt et al. | 270/53 X |
| 5,020,784 | 6/1991 | Asami et al. | 270/53 |
| 5,141,215 | 8/1992 | Ishiguro et al. | 270/53 |
| 5,342,034 | 8/1994 | Mandel et al. | 355/324 X |
| 5,382,012 | 1/1995 | Mandel et al. | 270/53 |
| 5,449,157 | 9/1995 | Kawano et al. | 270/53 |
| 5,464,201 | 11/1995 | Deen et al. | 270/53 |

FOREIGN PATENT DOCUMENTS

| | | | |
|---|---|---|---|
| 346851 | 12/1989 | European Pat. Off. . | |
| 427279 | 5/1991 | European Pat. Off. . | |
| 5-155177 | 6/1993 | Japan | 270/53 |

*Primary Examiner*—John E. Ryznic

*Attorney, Agent, or Firm*—Fitzpatrick, Cella, Harper & Scinto

[57] ABSTRACT

A book binding apparatus has a sheet storing device for temporarily storing a sheet, a binding device for binding sheets as a sheet bundle, a transfer device for conveying the bound sheet bundle, a discharge opening for discharging the sheet bundle conveyed by the transfer device out of the apparatus, and a stacker for storing the sheet and arranged in a confronting relation to the discharge opening with the interposition of the transfer device.

14 Claims, 66 Drawing Sheets

BOOK BINDING APPARATUS

BACKGROUND OF THE INVENTION

1. Field of the Invention

The present invention relates to a book binding apparatus having a stacker, and more particularly, it relates to a book binding apparatus in which imaged sheets are bound as a book and which is applicable to an on-line system wherein a plurality of image forming apparatuses required for forming images on sheets successively, a book binding apparatus for bookbinding the sheets on which the images were formed and a sorting and containing apparatus for sorting and containing the bookbound sheet bundles are interconnected, and also relates to an image forming apparatus having such a book binding apparatus.

2. Related Background Art

In the past, when a plurality of sheets on which images were formed are automatically glue-bound to obtain a book, an on-line system wherein a plurality of apparatuses required for performing such jobs are interconnected has been used.

For example, the on-line system includes (1) a reading and sheet supplying apparatus comprising an original setting portion for setting an original, an optical system for scanning the original, and a sheet supplying apparatus for containing a number of sheets and for supplying the sheet, (2) an image forming apparatus for forming an image on the sheet supplied from the sheet supplying apparatus, (3) a book binding apparatus for bookbinding the sheets on which the images were formed, and (4) a sheet sorting and containing apparatus for sorting and containing the bookbound or finished sheet bundles or the sheets. These apparatuses are interconnected in series.

When the sheet bundle is bookbound in the book binding apparatus, the sheet bundle aligned in a sheet align tray is glue-bound by a gluing binder. A bind tape used with the gluing binder comprises a tape-shaped sheet on which paste or glue of a hot melt type is coated. The bind tape is abutted against the sheet bundle and is adhered to the sheet bundle by melting the glue by a heater.

In the conventional book binding apparatus of the on-line system including the image forming apparatus, a sheet entrance portion, a sheet bundle aligning means, a convey means and a stacker are arranged in series, and the convey means is of handling type. According to this handling type, in bookbinding the sheet bundle, the sheets successively fed from the sheet entrance portion are aligned in the aligning means as a sheet bundle, and then the bind tape is abutted against the sheet bundle and is heated by the heater to bookbind the sheet bundle, and the bookbound sheet bundle is contained in the stacker. When a predetermined number of sheet bundles are bookbound or when the stacker is filled with the sheet bundles, the stacker is unloaded to retract a tray of the stacker out of the apparatus so that an operator can remove the sheet bundles from the tray. After the operator removes the sheet bundles, the tray is automatically returned into the apparatus, thereby achieving a stand-by condition. In this case, the bookbinding operation of the book binding apparatus will be stopped during the time from the unloaded condition to the stand-by condition, thereby reducing the productivity.

Further, an easy book binding device such as a stapler or folder as a finishing apparatus arranged upstream of the book binding apparatus must be also stopped, thus reducing the working ratio.

On the other hand, since the sheets on which the images were formed are stacked in a stacker or a discharge tray, the operator must sort such sheets manually. In order to minimize the sorting labor, recently, the improvement in a sorting apparatus such as a sorter, a mail box and a multi client sorter have been requested.

However, in the book binding apparatus having the above-mentioned modules interconnected in series, since the convey means is operated synchronously with the bookbinding operation, the productivity is changed in accordance with the bookbinding time. The reduction of the productivity of the entire system due to presence of the book binding apparatus which requires the longest tact time is not preferable for the high speed image forming apparatus included in the system from the view point of cost and productive capacity.

Further, in the on-line system, when the image forming apparatus and the finisher are arranged upstream of the book binding apparatus and the sorting apparatus is arranged downstream of the book binding apparatus, the single sheet, a stapled sheet bundle or a folded sheet bundle (which is not bound by the bind tape and which is obtained by the finisher) must be sent to the sorting apparatus through a convey portion of the book binding apparatus. In the above-mentioned conventional book binding apparatus having the modules interconnected in series, since the last process is effected in the stacker, the bookbound sheet bundle obtained in the book binding apparatus and other sheet bundle(s) obtained in the finisher must be contained in the same stacker in mixture or the jobs must be performed independently. Thus, in the above-mentioned conventional on-line system, the sorting apparatus cannot be arranged at the downstream side of the book binding apparatus.

SUMMARY OF THE INVENTION

The present invention aims to eliminate the above-mentioned conventional drawback, and has an object of the present invention to provide a book binding apparatus to which a sorting apparatus can be on-line connected downstream thereof and which can achieve high productivity corresponding to an image forming speed of an image forming apparatus.

To achieve the above object, according to the present invention, there is provided a book binding apparatus comprising a sheet storing means for temporarily storing a sheet, a binding means for binding sheets as a sheet bundle, a transfer means for conveying the bound sheet bundle, a discharge opening for discharging the sheet bundle conveyed by the transfer means out of the apparatus, and a stacker adapted to store the sheet and arranged in a confronting relation to the discharge opening with the interposition of the transfer means.

With this arrangement, when the bookbinding operation effected by the book binding apparatus is not required, the sheets on which the images were formed by the image forming apparatus arranged upstream of the book binding apparatus in the on-line system are entered into a sheet entrance portion, are conveyed through a sheet convey path, and are bookbound by the bookbinding apparatus as a sheet bundle. Then, the sheet bundle is discharged out of the book binding apparatus through the discharge opening. The discharged sheet bundle is stacked on a stacking tray arranged at the discharge opening. If the sorting apparatus is on-line connected to the book binding apparatus, the discharged sheet bundle is sent to the sorting apparatus.

In a bookbinding operation, the aligned sheet bundle on a sheet align tray is conveyed, by a sheet bundle conveying means, to a back abutment position, where a top end of the sheet bundle is abutted against a bind tape on a tape heating apparatus positioned at the back abutment position, and the bind tape is adhered to the sheet bundle by heating the bind tape. The bookbound sheet bundle is received by a sheet bundle receiving means and then is conveyed on a carriage by a convey means.

The carriage is lowered to a predetermined position to send the sheet bundle into the stacker.

Further, by providing two stackers for receiving the sheet bundles, one of the stacker can be drawn from the apparatus while the sheet bundle is being contained into the other stacker. Thus, when a plurality of bookbound sheet bundles are to be obtained, by switching the stacker, it is possible to remove a sample sheet bundle.

Further, when the bookbound sheet bundle is not contained in the stacker, the sheet bundle is discharged out of the apparatus through the discharge opening. In this case, a stacking tray is arranged at the discharge opening to facilitate the recognition of the sample. Further, when the sorting apparatus is on-line connected to the book binding apparatus downstream thereof, a sheet entrance portion of the sorting apparatus is connected to the discharge opening so that the sheet bundle can be sent from the book binding apparatus to the sorting apparatus.

DETAILED DESCRIPTION OF THE PREFERRED EMBODIMENTS

Now, a first embodiment of the present invention will be explained with reference to the accompanying drawings.

Figure 1:
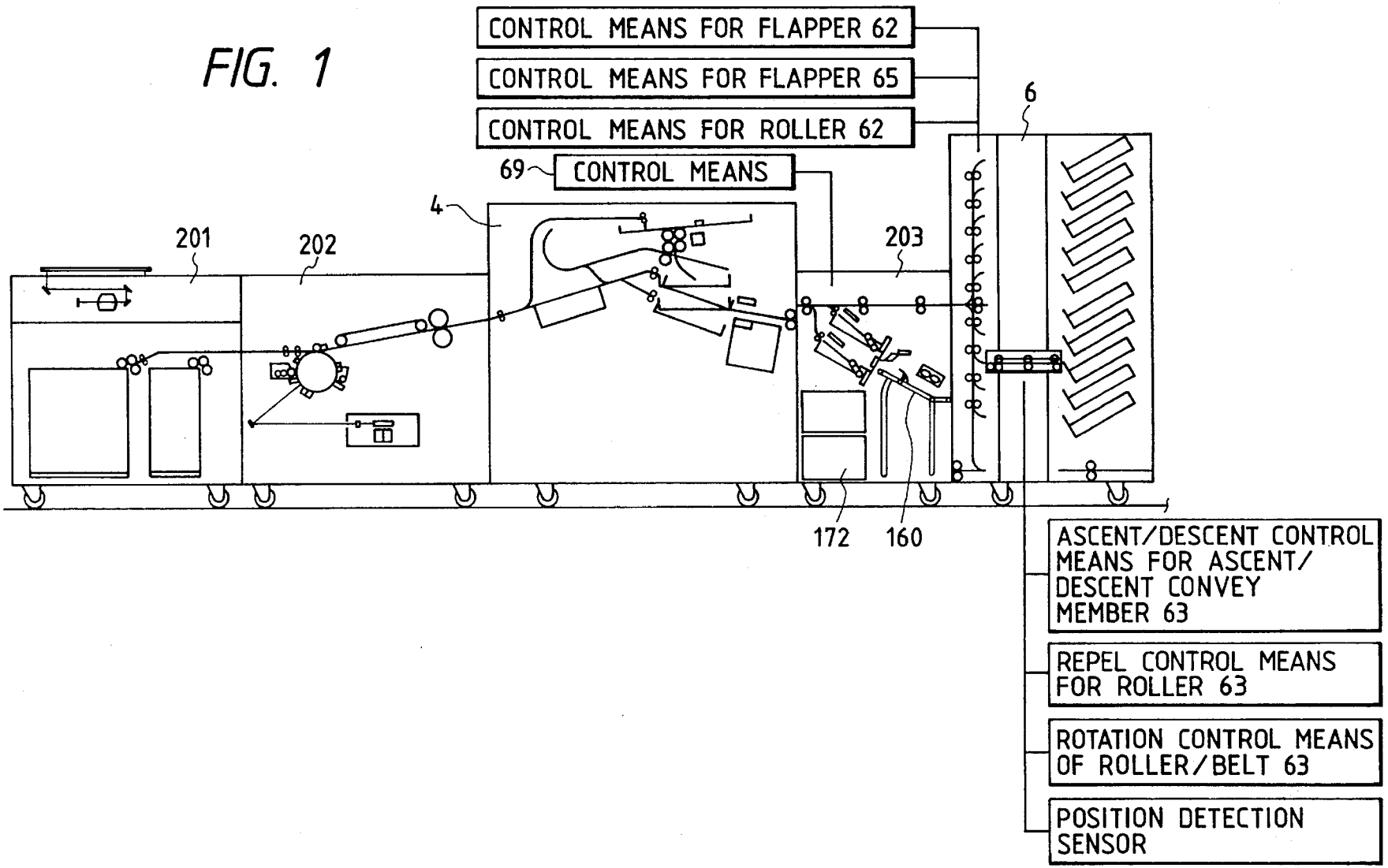
FIG. 1 is a front sectional view of the entire system according to a first embodiment of the present invention.

FIG. 1 is a front view showing the entire system, and FIGS. 2 to 7 shows a first embodiment of the present invention. The system comprises an original reading and sheet supplying apparatus 201, an image forming apparatus 202, a stapling apparatus (finisher) 4 including a stapler, a discharge tray and the like, a bookbinding apparatus 203, and a sheet sorting and containing apparatus 6 according to the present invention. Incidentally, the original reading and sheet supplying apparatus 201, image forming apparatus 202 and bookbinding apparatus 203 will be fully described later with reference to FIG. 9.

First of all, the sheet sorting and containing apparatus 6 will be fully explained.

Figure 2:
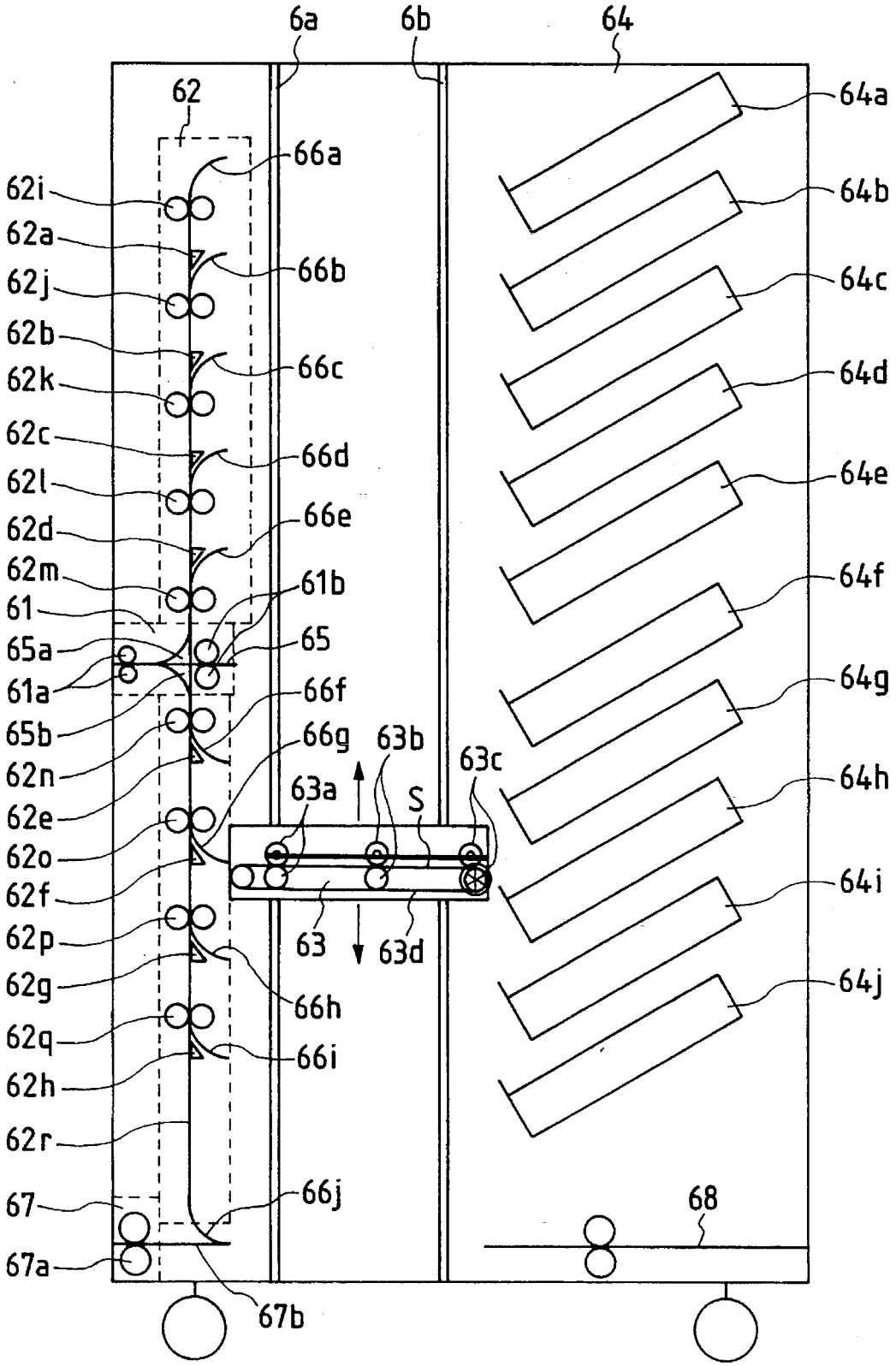
FIG. 2 is a front sectional view of a sheet sorting and containing apparatus in the system of FIG. 1.
Figure 3:
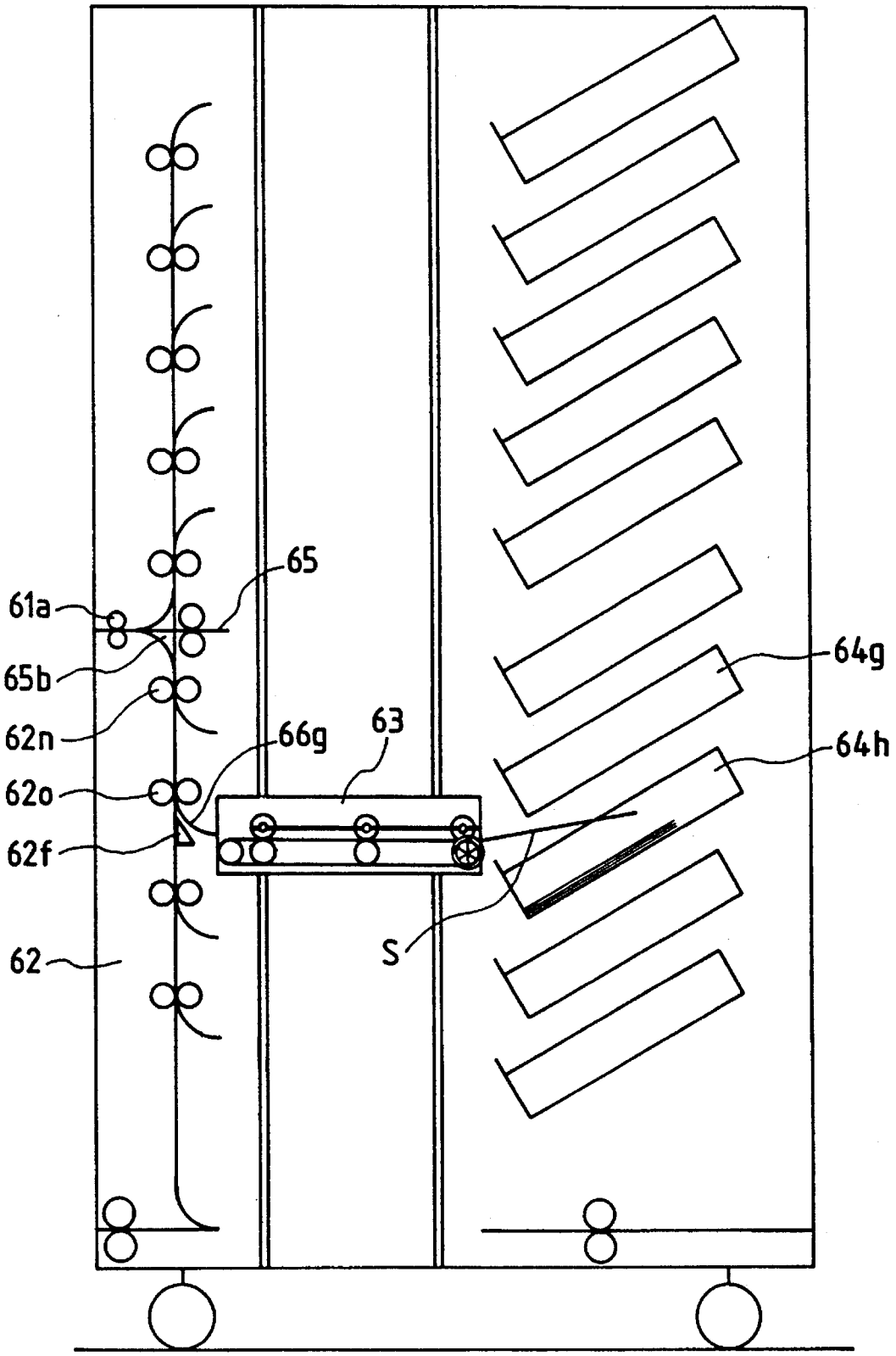
FIG. 3 is a front sectional view showing a condition that a single sheet is handled.

As shown in FIG. 2, the sheet sorting and containing apparatus 6 is provided with a sheet entrance portion 61 which serves to receive a single sheet or a sheet bundle conveyed from the stapling apparatus 4 connected to the apparatus 6 and to direct the sheet or the sheet bundle in an upward direction or a horizontal direction through flappers 65*a*, 65*b*. Incidentally, the sheet bundle was already bookbound by stapling or glue binding. The sheet entrance portion 61 includes therein a pair of inlet rollers 61*a* and a pair of outlet rollers 61*b* for directing the single sheet S or the sheet bundle having a thickness smaller than a predetermined value (comprised of eight sheets or less) upwardly or downwardly (to a convey vertical path 62 which will be described later) and for directing the sheet bundle having a thickness greater than the predetermined value (comprised of nine sheet or more) horizontally (to an ascent/descent convey member 63 which will be described later), a straight path 65, and the flappers 65*a*, 65*b* driven by solenoids. One of the pair of inlet rollers 61*a* is a drive roller, and the other roller is a driven roller which can be retracted from the drive roller by the solenoid when the sheet bundle having the thickness greater than the predetermined value enters into the entrance portion and then can be moved toward the drive roller to pinch the sheet bundle between the rollers. Further, the pair of outlet rollers 61*b* are designed similar to the pair of inlet rollers 61*a*. Incidentally, when the single sheet has a thickness greater than the predetermined value, such a sheet is directed horizontally.

A convey vertical path 62 is arranged at a downstream side of the sheet entrance portion 61, which convey vertical path serves to convey the single sheet S or the sheet bundle having the thickness smaller than the predetermined value branched upwardly or downwardly at the sheet entrance portion 61 in an upward direction or a downward direction. Within the convey vertical path, there are arranged a plurality of flappers 62*a*–62*h* driven by solenoids at positions corresponding to heights of trays 64*a*–64*j*. The flappers 62*a*–62*h* serve to change the direction of the single sheet S or the sheet bundle having the thickness smaller than the predetermined value to direct it to the ascent/descent convey member 63. Further, within the convey vertical path 62, there are arranged a plurality of pairs of vertical-feed rollers 62*i*–62*q*, which pairs are spaced apart from each other by a distance smaller than a length of a minimum size sheet. A convey guide 62*r* for guiding the single sheet S or the sheet bundle having the thickness smaller than the predetermined value is disposed within the convey vertical path 62 substantially along a vertical direction, and branch paths 66*a*–66*j* acting as curved guides are associated with the respective flappers 62*a*–62*h*.

The ascent/descent convey member 63 is disposed at a downstream side of the branch paths 66*a*–66*i* of the convey vertical path 62 and serves to pinch and convey the single sheet or the sheet bundle having the thickness smaller than the predetermined value sent from the sheet entrance portion 61 through the convey vertical path 62. When the thick sheet bundle stapled by the stapling apparatus 4 arranged at an upstream side of the sheet sorting and containing apparatus is conveyed from the sheet entrance portion 61 horizontally, the ascent/descent convey member 63 serves to receive the thick sheet bundle, so that the sheet bundle is pinched by a plurality of pairs of rollers 63*a*–63*c* and is lifted or lowered to a height corresponding to the desired tray through rotation of a motor.

To this end, the ascent/descent convey member 63 has upper driven rollers, and a lower drive roller and at least one idle roller. A convey belt 63*d* is wound around and extends between the drive roller and the idle roller. The driven rollers are retarded from the convey belt upwardly by an appropriate drive source such as a plunger when the sheet bundle having the thickness greater than the predetermined value enters into the ascent/descent convey member 63. After the sheet bundle enters into the ascent/descent convey member by a predetermined amount, the driven rollers are lowered to pinch the sheet bundle between the driven rollers and the convey belt. Further, the ascent/descent convey member 63 has a stepping motor for driving the convey belt 63*d*, so that the convey belt is rotated at the same speed as the process speed (400–1000 mm/sec) of the system when the single sheet S is conveyed and is rotated at a speed (100–300 mm/sec) slower than the process speed when the sheet bundle is conveyed. Incidentally, the position of the ascent/descent convey member 63 is determined by sensors arranged in the proximity of the respective branch paths 66*a*–66*j*. Further, a sensor provided in the ascent/descent convey member 63 serves to judge whether the sheet bundle has entered into the ascent/descent convey member 63, thereby controlling the motor, plunger and stepping motor. Incidentally, the ascent/descent convey member 63 is guided by rails 6*a*, 6*b* and is lifted or lowered by a belt or a chain driven by rotation of motor.

A containing portion 64 is constituted by the trays 64*a*–64*j* arranged in the vertical direction and serves to receive the sheet S or the sheet bundle on which an image or images were formed and which is sent from the ascent/descent convey member 63 and to contain the S or the sheet bundle therein. The trays 64*a*–64*j* are guided by corresponding rails and can be shifted in a front and rear direction, so that an operator can retract a desired tray to remove the sheets S or the sheet bundles from the tray. Further, each of the trays is inclined downwardly forwardly (downwardly leftwardly) so that the sheets can be aligned if sheets having various sizes are contained in the tray.

A second sheet entrance portion 67 is arranged below the sheet entrance portion 61. The second sheet entrance portion 67 serves to receive the sheet bundle from the bookbinding apparatus 203 such as the glue binder or the stapling apparatus 4 such as the finisher connected to the sheet sorting and containing apparatus at the upstream side thereof and to convey the sheet bundle to the ascent/descent convey member 63. By providing the second sheet entrance portion 67, the finished or bookbound sheet bundle is not required to be lifted up to the sheet entrance portion 61 in the glue binder or in the finisher connected to the sheet sorting and containing apparatus at the upstream side thereof, thereby making construction of the convey paths in the upstream bookbinding apparatus 203 and stapling apparatus 4 simpler. A pair of introduction rollers 67*a* comprising a drive roller and a driven roller is disposed in the second sheet entrance portion 67, and this driven roller can be retarded from the drive roller to facilitate the entering of the sheet bundle into the second sheet entrance portion, similar to the driven rollers of the pairs of rollers 61*a*, 61*b*. Incidentally, the reference numeral 66*j* denotes a branch path; and 68 denotes a connection convey path.

Next, the operation of the sheet sorting and containing apparatus will be explained.

[In case of the single sheet]

First of all, as shown in FIG. 2, the ascent/descent convey member 63 is aligned with the height position of the tray 64*h* (when it is selected) of the containing portion 64 and is stopped there, with the result that the entrance portion of the ascent/descent convey member 63 is aligned with the branch path 66*g*. The flapper 62*f* is switched to guide the sheet S toward the branch path 66*g*. The flapper 65*b* is switched to guide the sheet toward the lower portion of the convey vertical path 62. Accordingly, the sheet S is introduced into the tray 64*h* through the pair of inlet rollers 61*a*, convey vertical path 62, branch path 66*g* and ascent/descent convey member 63.

Similarly, when the sheet S is desired to be discharged onto the tray 64*g*, in response to a distribution signal from a control means, the ascent/descent convey member 63 is aligned with the height position of the tray 64*g* and is stopped there. The flapper 62*e* in the convey vertical path 62 corresponding to the height position of the stopped ascent/descent convey member 63 and the flappers 65*a*, 65*b* in the sheet entrance portion 61 are switched, respectively. As a result, the single sheet S can be sorted and contained into the tray 64*g*. Incidentally, when the sheets S are stapled in the stapling apparatus 4, if the number of the sheets is small (i.e. if the sheet bundle has the thickness smaller than the predetermined value), the sheet sorting and containing apparatus is operated as mentioned above, so that the thin sheet bundle can be contained into a desired one of the trays 64*a*–64*j*.

[In the case where a number of sheets are stapled in the stapling apparatus 4]

Figure 4:
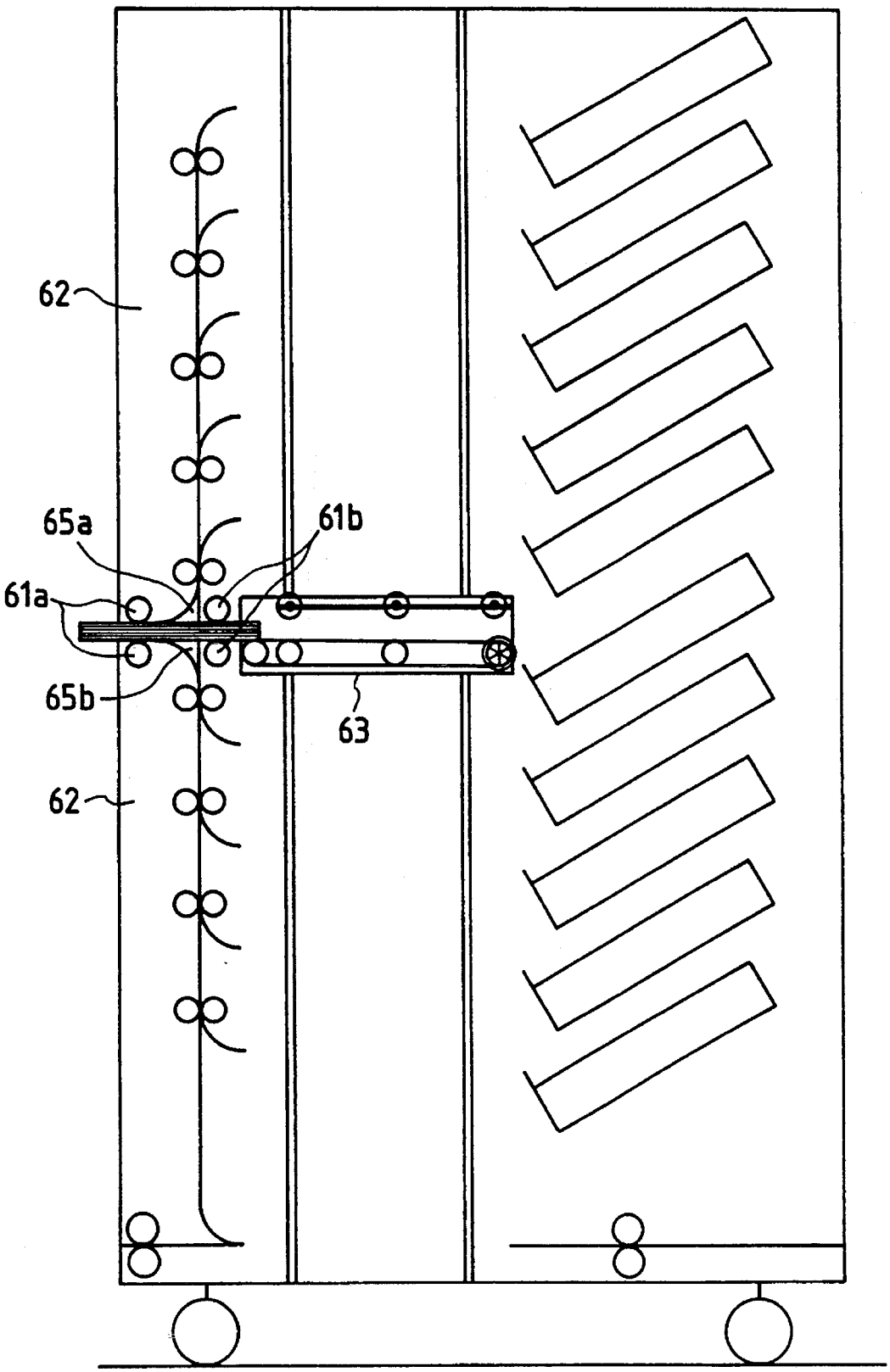
FIGS. 4 to 7 are front sectional views showing a condition that a sheet bundle is handled.
Figure 5:
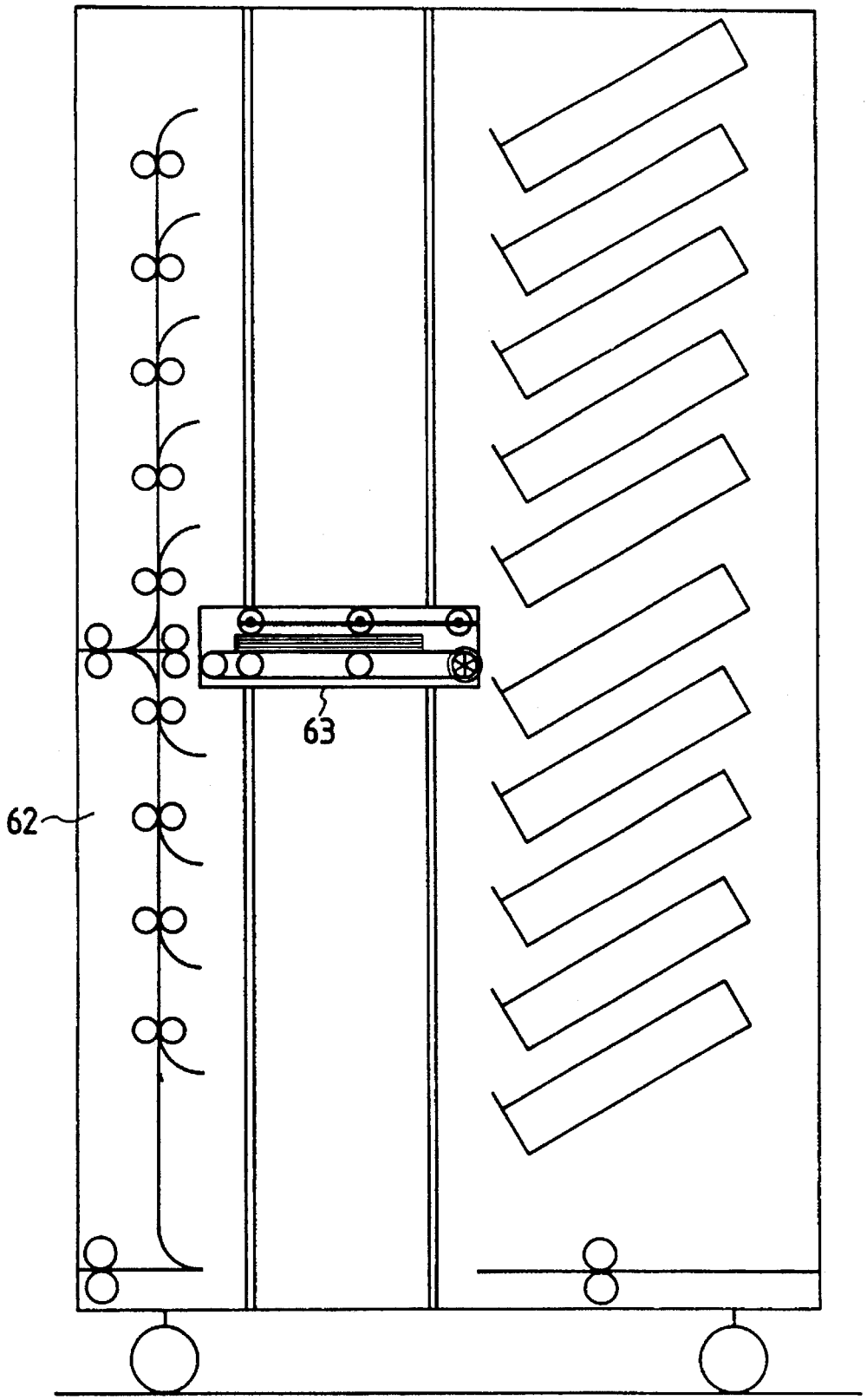
Figure 6:
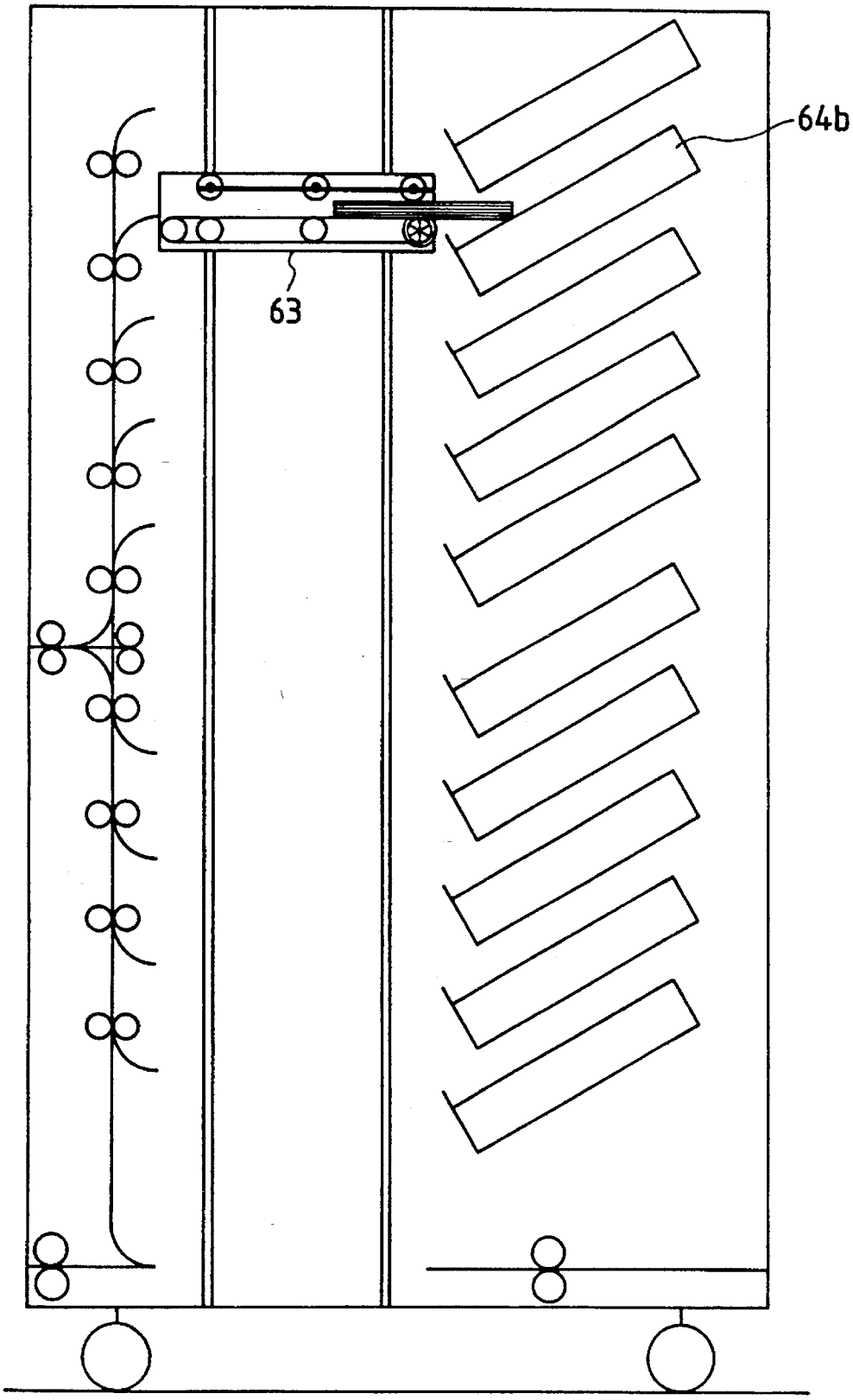
Figure 7:
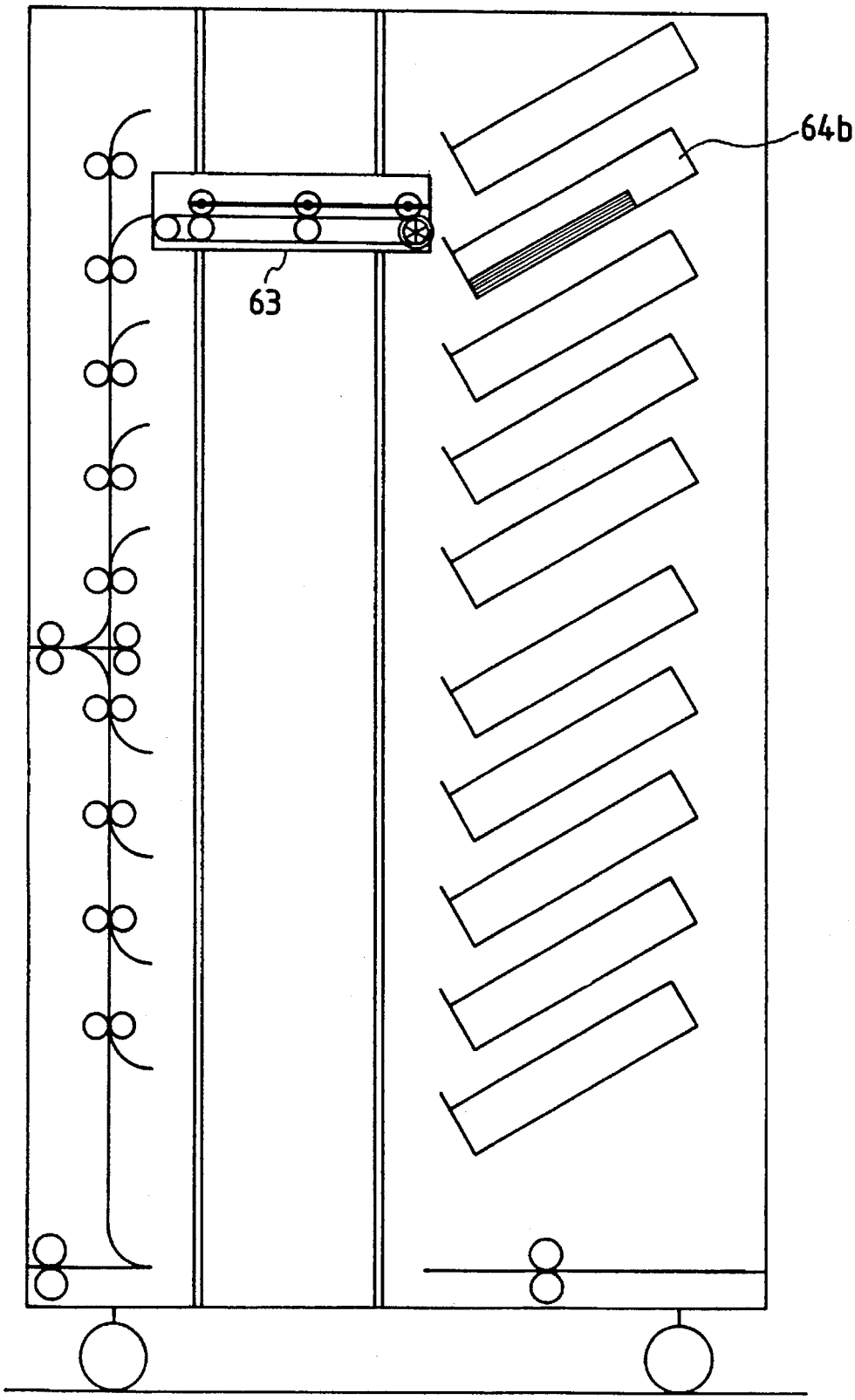

As shown in FIG. 4, when the sheet sorting and containing apparatus receives a signal (staple process signal) representative of the conveyance of the sheet bundle from the control means, the ascent/descent convey member 63 is aligned with the straight path 65 and is stopped there. The flappers 65*a*, 65*b* are switched to direct the sheet bundle to the straight path 65. Thus, as shown in FIG. 5, the sheet bundle is pinched by the pairs of rollers 63*a*–63*c* of the ascent/descent convey member 63. In this case, the driven rollers of the ascent/descent convey member 63 are driven by the solenoid in dependence upon the thickness of the sheet bundle to be retarded from the drive rollers. When the sheet bundle enters into the ascent/descent convey member 63 by the predetermined amount, the driven rollers are approached toward the drive rollers, thereby pinching the sheet bundle between the drive and driven rollers. Thereafter, as shown in FIG. 6, the ascent/descent convey member 63 is lifted to be aligned with the height position of the desired tray (for example, tray 64*h* ) and is stopped there. Then, the pairs of rollers 63*a*–63*c* and the convey belt 63*d* are rotated to discharge the sheet bundle onto the tray 64*h*. FIG. 7 shows a condition that the sheet bundle has been discharged onto the tray. Thereafter, the ascent/descent convey member 63 is lowered to be aligned with the straight path 65 again and is stopped there. The ascent/descent convey member 63 is maintained in this position to receive the next sheet bundle. In this way, the sheet bundles can be sorted in the trays 64*a*–64*j*.

[In the case where a number of sheets are bound in the bookbinding apparatus 203]

The sheet bundle bound at the gluing portion of the bookbinding apparatus 203 shown in FIG. 1 is conveyed to an elevator 160, and is normally stored on a staker 172. On the other hand, when the sheet bundle is desired to be discharged onto a desired one of the rays 64*a*–64*j*, the elevator 160 is lowered to a lowermost position, where a belt is rotated to shift the sheet bundle to the right. The sheet bundle shifted to the right enters between the pair of the separated introduction rollers 67*a* and is pinched by the rollers 67*a*. Then, the sheet bundle is shifted to the right by the rotation of the paired rollers 67*a* to be introduced into the straight path 67*b*. The ascent/descent convey member 63 has already been positioned at the same height as the straight path 67*b*, so that the sheet bundle sent from the straight path 67*b* is pinched by the pairs of rollers 63*a*–63*c* as mentioned above. Thereafter, the ascent/descent convey member 63 is lifted to convey the sheet bundle to the desired one of the trays 64*a*–64*j*. Then, the belt 63*d* is rotated to discharge the sheet bundle onto the desired tray.

Incidentally, the containing portion may be used as a "designated address" or a "variable address" (floating address) for outputting the sheets or sheet bundles from the trays, for example, as follows:

[Mail Box Use]

That is to say, the trays of the containing portion are assigned to individuals and/or companies, and, when the user wants to distribute the copies to a certain individual or company, by designating or identifying a certain tray for the individual or company, such copies are contained in the designated tray. In this way, the individual or company can obtain the desired copies.

[Client Use]

On the other hand, the trays of the containing portion are assigned to individuals, and, the individual can output the copies to be obtained or the finished sheet bundle into his own tray by using a computer terminal in the network. In this way, it is possible to prevent incorrect distribution of the copies even when the remote control is effected under the network.

[Others]

The addresses of the trays of the containing portion are not assigned to the individuals, and, whenever the copies are outputted, the user designates a certain tray or the image forming apparatus automatically selects a vacant tray so that the copies are contained in the vacant tray. In this way, even when the plural users effects the remote controls simultaneously under the network, it is possible to prevent incorrect distribution of the copies.

Figure 8:
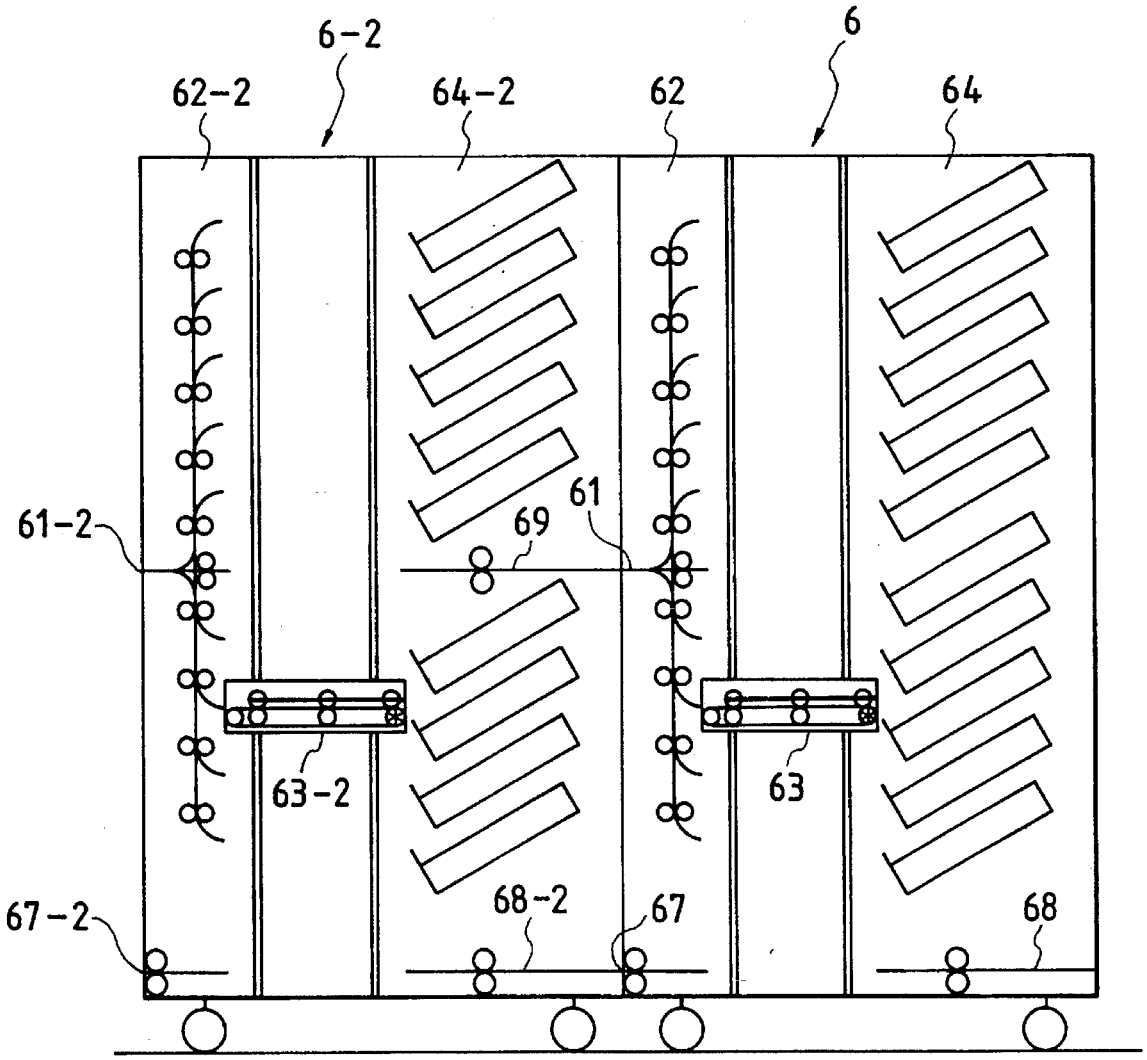
FIG. 8 is a front sectional view of a sheet sorting and containing apparatus according to an alteration.

Next, a sheet sorting and containing apparatus according to an alteration will be explained with reference to FIG. 8.

In this alteration, an additional sheet sorting and containing apparatus 6-2 is arranged between the bookbinding apparatus 203 and the sheet sorting and containing apparatus 6 of FIG. 1 to increase the number of trays. The sheet sorting and containing apparatus 6-2 differs from the sheet sorting and containing apparatus 6 in the point that a tray is omitted from a central portion of a containing portion 64-2 of the apparatus 6-2 and a straight path 69 is disposed at that vacant space in alignment with a straight path 65-2 of a convey vertical path 62-2. With this arrangement, the straight path 69 formed in the containing portion 64-2 of the sheet sorting and containing apparatus 6-2 is connected to the sheet entrance portion 61 of the sheet sorting and containing apparatus 6. Thus, the sheet bundle passed through the straight path 65-2 of a sheet entrance portion 61-2 of the sheet sorting and containing apparatus 6-2 is directed to the straight path 69 of the containing portion 64-2 through an ascent/descent convey member 63-2, thereby achieving the high speed conveyance of the sheet bundle.

Incidentally, other than the above-mentioned embodiment, an additional sheet sorting and containing apparatus having the same construction as that of the sheet sorting and containing apparatus 6 may be arranged continuous to the sheet sorting and containing apparatus 6 so that an outlet portion of the connection convey path 68 of the sheet sorting and containing apparatus 6 is connected to a sheet entrance portion of the additional sheet sorting and containing apparatus. With this arrangement, the number of trays is doubled.

In the arrangement as mentioned above, the sheets, stapled sheet bundles and glued sheet bundles can be sorted and contained without worsening the efficiency.

Next, a second embodiment of the present invention will be explained with reference to the accompanying drawings. In this second embodiment, the stapling apparatus 4 is omitted from the system of FIG. 1, and the sheet sorting and containing apparatus 6 is replaced by a different sheet sorting and containing apparatus 216.

Figure 9:
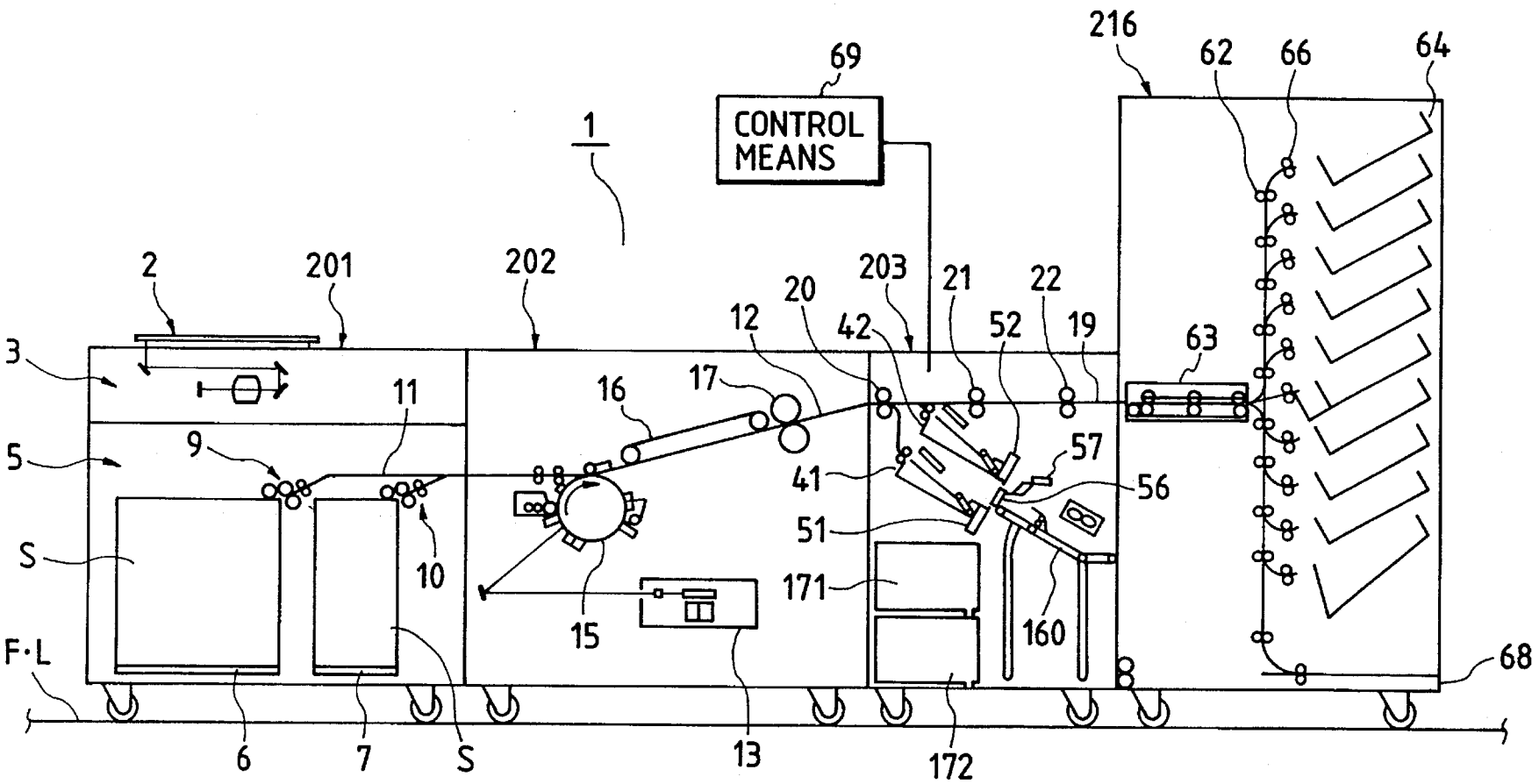
FIG. 9 is a front sectional view of the entire system according to a second embodiment of the present invention.
Figure 10:
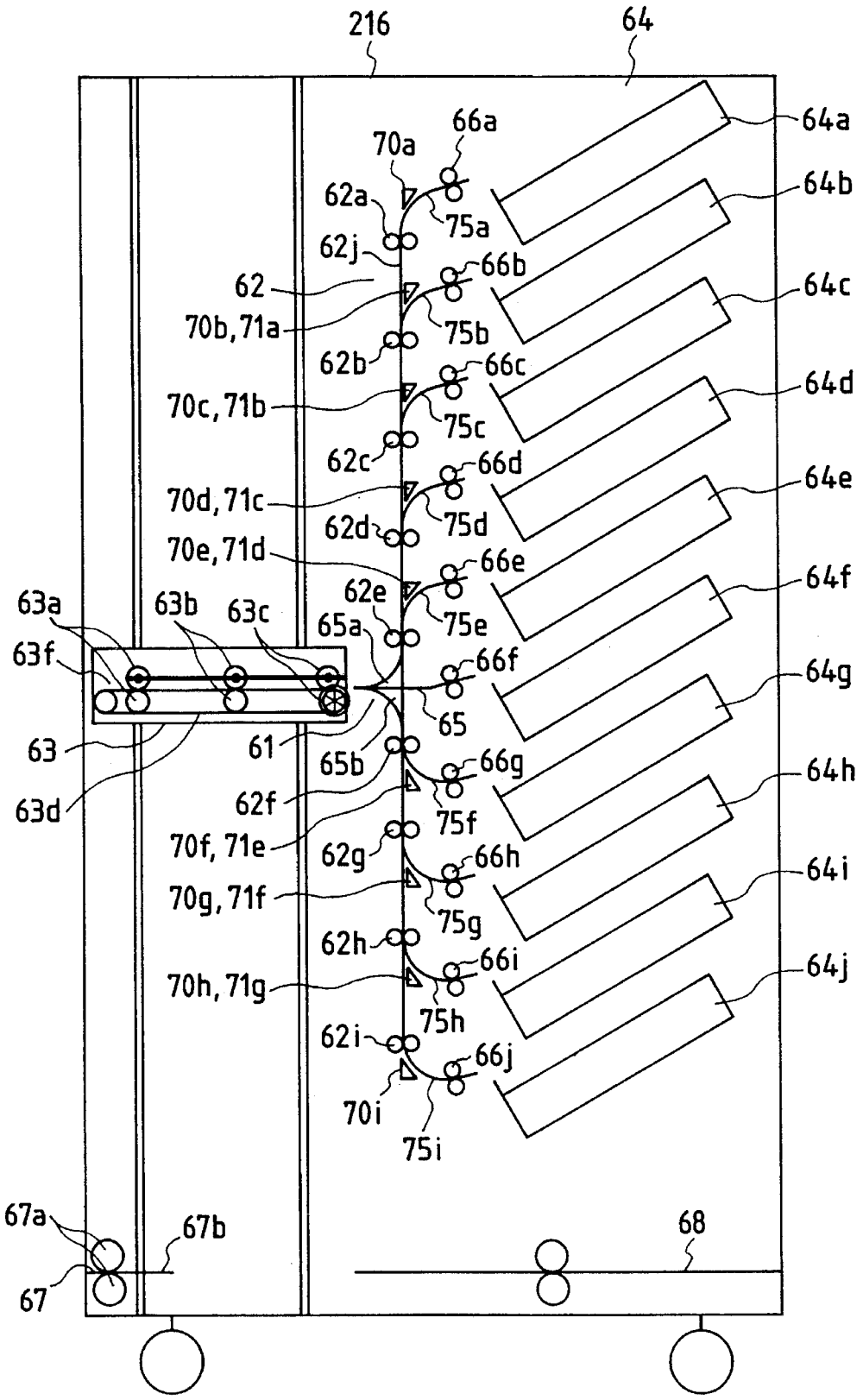
FIG. 10 is a front sectional view of a sheet sorting and containing apparatus in the system of FIG. 9.

In FIG. 9, an on-line system 1 comprises a reading and sheet supplying apparatus 201, an image forming apparatus 202, a bookbinding apparatus 203 and a sheet sorting and containing apparatus 216, which apparatuses are connected in series.

The reading and sheet supplying apparatus 201 includes, at an upper portion thereof, an original setting portion 2 on which an original (not shown) is rested, and an optical system 3 which can read and scan the original. In a lower portion of the apparatus 201, there are arranged a plurality of decks 6, 7 on which sheets S having different sizes are stacked, respectively, and sheet supply portions 9, 10 for supplying the sheets.

The supplied sheet S is conveyed to a sheet convey path 12 of the image forming apparatus 202 through a sheet convey path 11. Incidentally, the reference numeral 13 denotes a laser scanner for emitting laser light in response to image information read by the optical system 3, and 15 denotes an image forming portion which is scanned by the laser scanner 13 and on which a toner image is formed. The sheet S on which an image was formed at the image forming portion 15 is conveyed to a sheet convey path 19 of the bookbinding apparatus 203 via a convey belt 16 and a pair of convey rollers 17.

The bookbinding apparatus 203 includes first and second sheet align trays 41, 42 for containing and aligning the sheets S branched and conveyed from the sheet convey path 19, first and second abutment members 51, 52 against which a tip end of the sheet is abutted, first and second heat apparatuses 56, 57 for heating the aligned sheet bundle and a bind tape, a handling member 63 for handling the bookbound sheet bundle, a carriage 60 which can be shifted in an up-and-down direction and on which the handling member 63 is mounted, and stackers 71, 72 for storing the bookbound sheet bundles.

The sheet sorting and containing apparatus 216 includes an ascent/descent convey member (elevator) 63 for sending the sheet S conveyed from the sheet convey path 19 to a convey path 62, pairs of convey rollers **62*a*–62*j* disposed at a plurality of branched portions of the convey path 62, and pairs of discharge rollers 66*a*–66*j* for discharging the sheets S branched at the branched portions onto corresponding discharge trays 64*a*–64*j*. Further, the bookbound sheet bundle discharged from the bookbinding apparatus 203 is discharged from a discharge opening 68 of the system through the elevators 160, 63** and pairs of convey rollers.

Next, the sheet sorting and containing apparatus 216 will be fully explained. Incidentally, sensors and an arrangement for providing the up-and-down movement are the same as those shown in FIG. 2.

The sheet sorting and containing apparatus 216 includes a sheet entrance portion 61 for guiding a single sheet or a sheet bundle to the convey vertical path 62. The single sheet or the stapled or glue-bound sheet bundle conveyed from the ascent/descent convey member 63 (described later fully) is directed in a vertical direction or a horizontal direction. Flappers **65*a*, 65*b* for directing the single sheet S or the sheet bundle having a thickness smaller than a predetermined value (about eight sheets or less) upwardly or downwardly (along the convey vertical path 62 which will be described later fully) and for directing the sheet bundle having a thickness-smaller than the predetermined value (about nine sheets or more) horizontally are disposed in the sheet entrance portion 61**. The flappers are driven by solenoids.

The convey vertical path 62 serves to convey the single sheet S or the sheet bundle having the thickness smaller than the predetermined value upwardly or downwardly through the flappers **65*a* or 65*b*, and a plurality of pairs of vertical-feed rollers 62*a*–62*i* are arranged in the convey vertical path 62 in such a manner that the pairs are spaced apart from each other at a distance corresponding to a distance between the trays 64*a*–64*j* of the containing portion 64 which will be described later fully. Further, opening/closing guides 70*a*–70*a* for regulating or determining whether the single sheet S or the sheet bundle having the thickness smaller than the predetermined value is conveyed straightly along a convey guide 62*j* or is guided toward branch paths 75*a*–75*a* are arranged at a downstream side of the respective pairs of vertical-feed rollers 62*a*–62*i*. Flappers 71*a*–71*g* (FIG. 15) driven by solenoids are attached to lower ends of the opening/closing guides 70*b*–70*h***, respectively.

Further, an L-shaped release lever 72 is rotatably mounted on a pivot shaft 73 around which each opening/closing guide **70*a*–70*a* is rotated, and the flappers 71*a*–71*g* are attached to, at 74, lower portions of the opening/closing guides 70*b*–70*h* spaced apart from their shafts 72. A slide lever 80 (FIG. 17) slid by rotation of a stepping motor 82 is abutted against any one of the opening/closing guides 70*a*–70*i*, and the pairs of discharge rollers 66*a*–66*j* are arranged in the respective branch paths 75*a*–75*i* branched from the convey guide 62*j* in alignment with the respective trays 64*a*–64*j*. Each pair of discharge rollers comprises a lower drive roller and an upper driven roller. One arm 72-1 of the release lever 72 is abutted against a roller shaft of the driven roller, and a slide lever 81 slid by the rotation of the stepping motor 82 is abutted against the other arm 72-2 of the release lever. A distance between the pairs of the vertical-feed rollers 62*i*–62*q*** is selected to be smaller than a length of a minimum sheet in a sheet convey direction.

The ascent/descent convey member 63 is disposed at an upstream side of the sheet entrance portion 61 and can be lifted or lowered to a position corresponding to one of pairs of discharge rollers **66*a*–66*j*. The ascent/descent convey member 63 is normally positioned at a height corresponding to an outlet portion of the bookbinding apparatus 203 to communicate with the outlet portion. When the single sheet S or the sheet bundle having the thickness smaller than the predetermined value is sent from the upstream side, the ascent/descent convey member 63 directs the single sheet S or the sheet bundle to the pair of discharge rollers 66*f* through the straight path 65 and, when the sheet bundle having the thickness greater than the predetermined value is sent from the upstream side, the ascent/descent convey member 63 pinches the sheet bundle and convey the sheet bundle to the position corresponding to the selected pair of discharge rollers 66*a*–66*j***.

To this end, the ascent/descent convey member 63 includes a plurality of pairs of rollers **63*a*–63*c*. Among these rollers, one of lower rollers is a drive roller, and a convey belt 63***d* is wound around and extends between at least two lower rollers. Incidentally, upper rollers are driven rollers. The driven rollers are separated from the convey belt upwardly by means of a drive source such as a solenoid when the sheet bundle having the thickness greater than the predetermined value enters into the ascent/descent convey member. When the sheet bundle is advanced by a predetermined amount, the driven rollers are lowered, thereby pinching the sheet bundle between the driven roller and the convey belt. Further, the ascent/descent convey member 63 is provided with a stepping motor for driving the convey belt 63*d* so that, when the single sheet is conveyed, the convey belt is rotated at the same speed as a process speed (400–1000 mm/sec) of the system, and, when the sheet bundle is conveyed, the convey belt is rotated (100–300 mm/sec) slower than the process speed.

The containing portion 64 comprises the plurality of trays 64*a*–64*j* arranged side by side in the vertical direction and serves to receive and contain the sheet S or the sheet bundle. The trays 64*a*–64*j* can be shifted in a front and rear direction (from that side to this side or vice versa) so that the user can draw a desired tray to collect the sheet(s) S or sheet bundle(s). The tray 64*a*–64*j* are inclined downwardly leftwardly to align the sheets in the tray even if various sheets S having different size are mixed.

A second sheet entrance portion 67 is arranged below the sheet entrance portion 61. The second sheet entrance portion 67 serves to receive the sheet bundle from the bookbinding apparatus 203 such as the glue binder connected to the sheet sorting and containing apparatus at the upstream side thereof and to convey the sheet bundle to the ascent/descent convey member 63. By providing the second sheet entrance portion 67, the finished or bookbound sheet bundle is not required to be lifted up to the sheet entrance portion 61 in the glue binder connected to the sheet sorting and containing apparatus at the upstream side thereof, thereby making the constructions of the convey paths in the upstream bookbinding apparatus 203 and stapling apparatus (not shown) simpler. A pair of introduction rollers 67*a* comprises a drive roller and a driven roller, and this driven roller can be retracted from the drive roller to facilitate the entering of the sheet bundle into the second sheet entrance portion.

A control means 69 controls the ascent/descent convey member 63 to keep it in a position corresponding to the sheet entrance portion 61 or to lift the ascent/descent convey member to a position corresponding to the selected one of pairs of discharge rollers 66*a*–66*j* in the convey vertical path 62 in response to a signal regarding the sheet or the sheet bundle detected in the bookbinding apparatus 203. The control means 69 is provided within the bookbinding apparatus 203. When the sheets or the sheet bundles having the thickness smaller than the predetermined value are sorted, the ascent/descent convey member 63 is set to the position corresponding to the sheet entrance portion 61, and, when the sheet bundles having the thickness smaller than the predetermined value are sorted, the ascent/descent convey member 63 is lifted or lowered to the position corresponding to the selected one of pairs of discharge rollers 66*a*–66*j*. Incidentally, the reference numeral 68 denotes a connection convey path.

Next, the operation of the sheet sorting and containing apparatus will be explained.

[In case of the single sheet]

Figure 11:
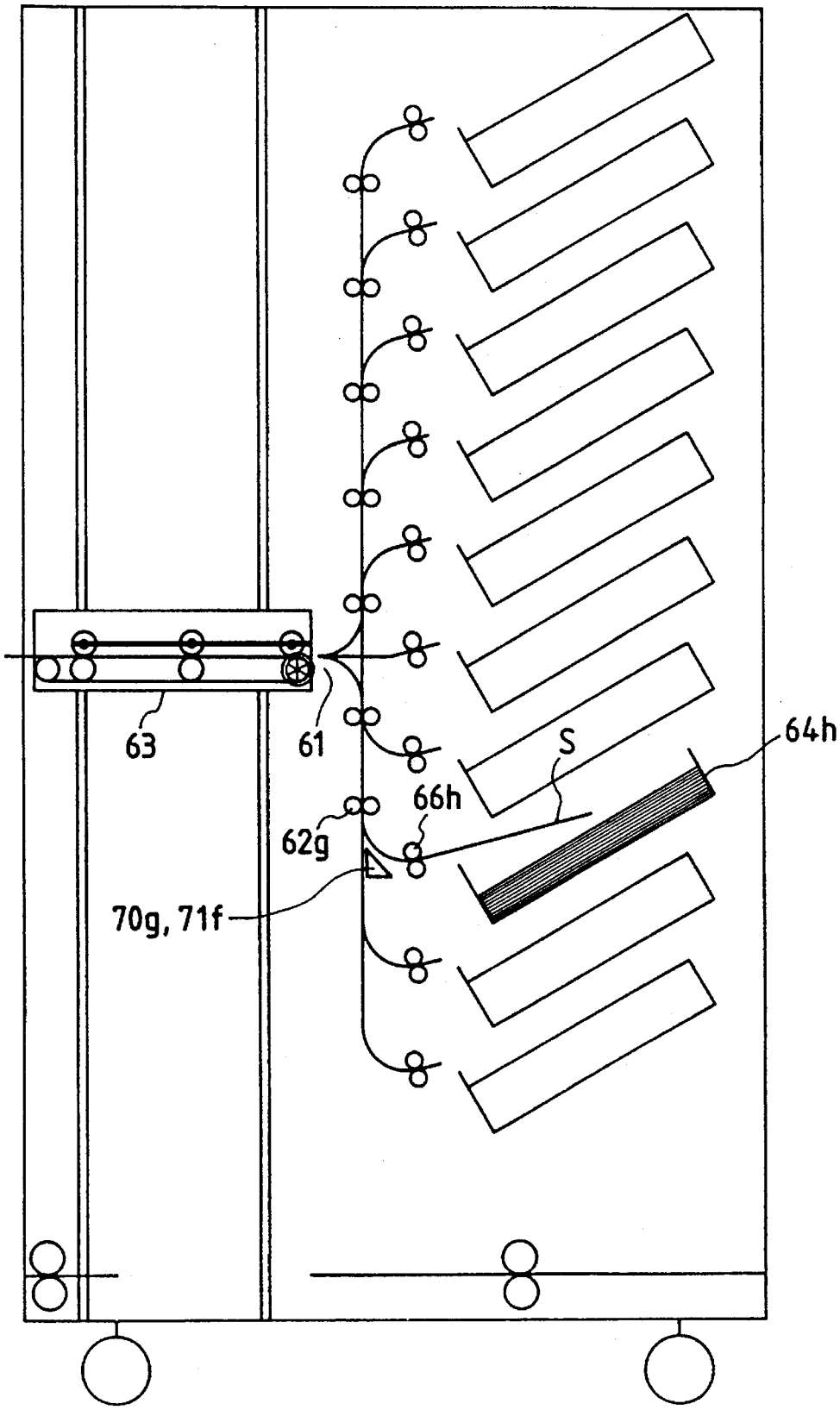
FIG. 11 is a front sectional view showing a condition that a single sheet is handled.

First of all, aas shown in FIG. 11, the ascent/descent convey member 63 is aligned with the height position corresponding to the sheet entrance portion 61 and is stopped there, with the result that the entrance portion of the ascent/descent convey member 63 is aligned with the outlet portion of the image forming apparatus and the like. When it is assumed that the sheet S is to be contained in the tray 64*h*, the flapper 65*d* is switched to guide the sheet S toward the pair of discharge rollers 66*h* in the branch path 75*g*. Accordingly, the sheet S is introduced into the tray 64*h* through the ascent/descent convey member 63, convey vertical path 62, pair of rollers 62*g* and pair of discharge rollers 65*h*. Similarly, when the sheet S is desired to be discharged onto the tray 64*g*, the ascent/descent convey member 63 is aligned with the height position of the sheet entrance portion 61 and is stopped there. The flapper 71*g* in the convey vertical path 62 corresponding to the height position of the stopped ascent/descent convey member 63 and the flappers 65*b* in the sheet entrance portion 61 are switched, respectively, thereby introducing the sheet S into the tray 64*g*. In this way, the single sheet S can be sorted into any tray. Incidentally, when the sheets S are stapled in the stapling apparatus 4, if the number of the sheets is small (i.e. if the sheet bundle has the thickness smaller than the predetermined value), the sheet sorting and containing apparatus is operated as mentioned above, so that the thin sheet bundle can be contained into a desired one of the trays 64*a*–64*j*.

[In the case where a number of sheets are stapled in the stapling apparatus (not shown) incorporated into the image forming apparatus or in case of thick sheet]

Figure 12:
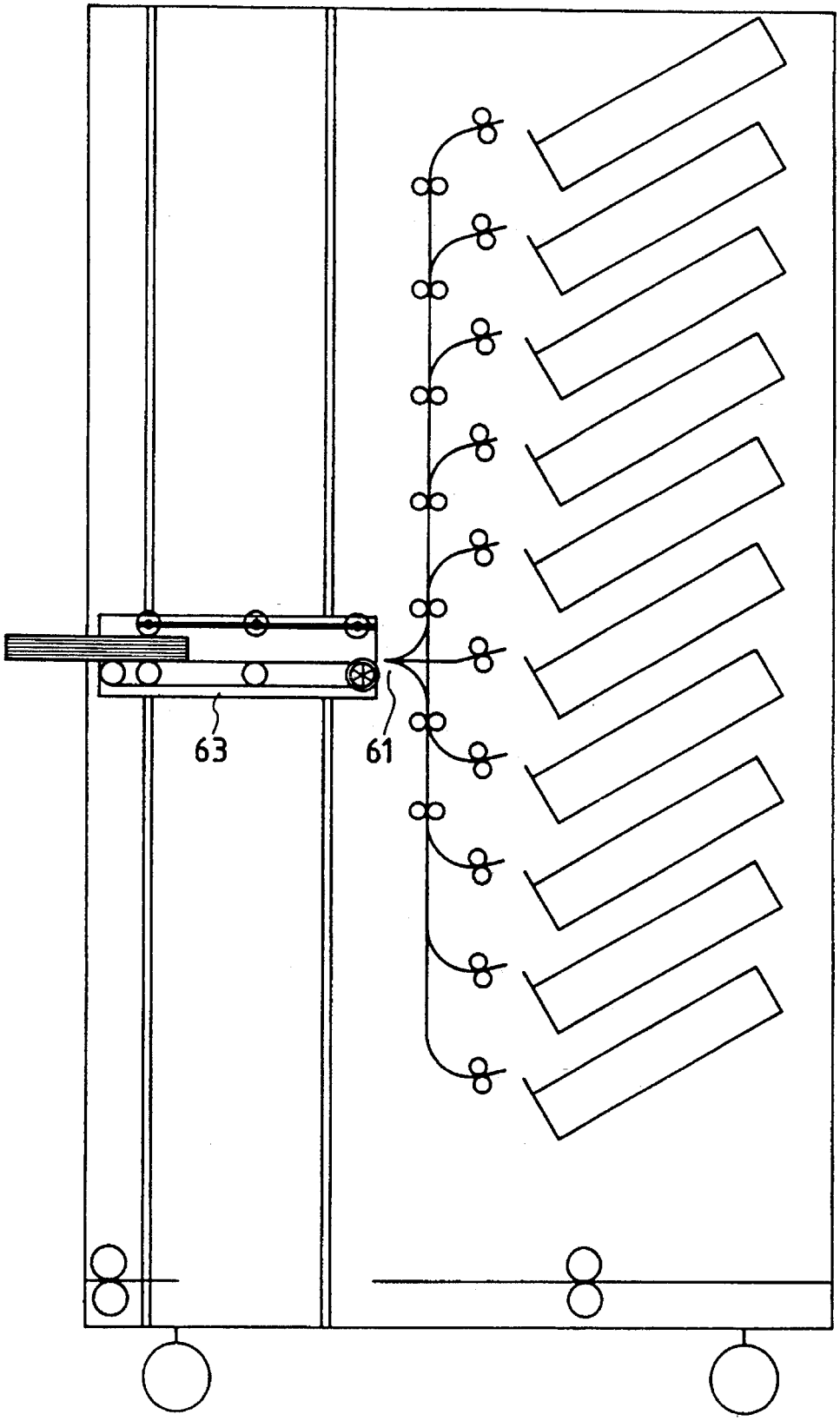
FIGS. 12 to 14 are front sectional views showing a condition that a sheet bundle is handled.
Figure 13:
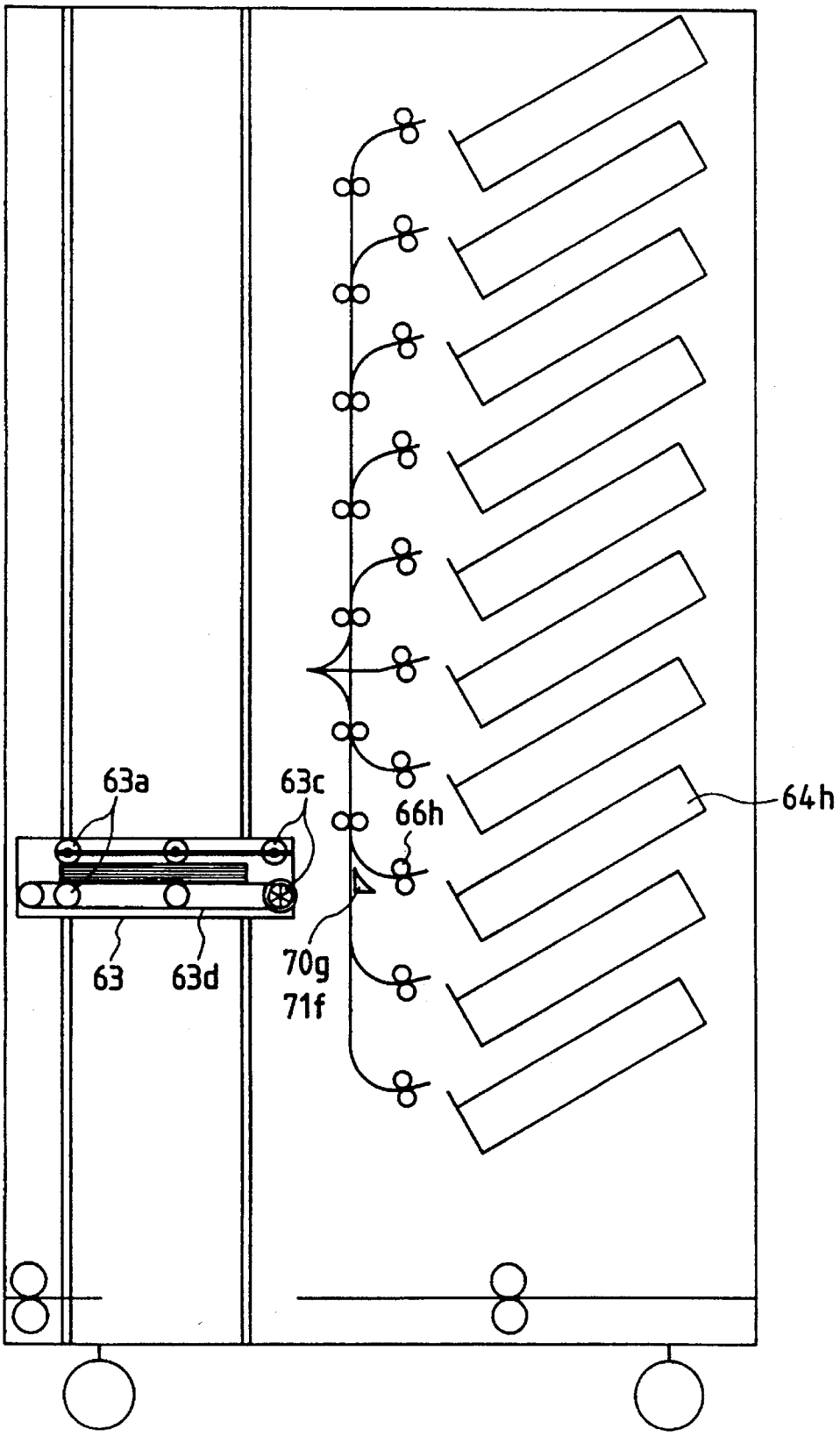
Figure 14:
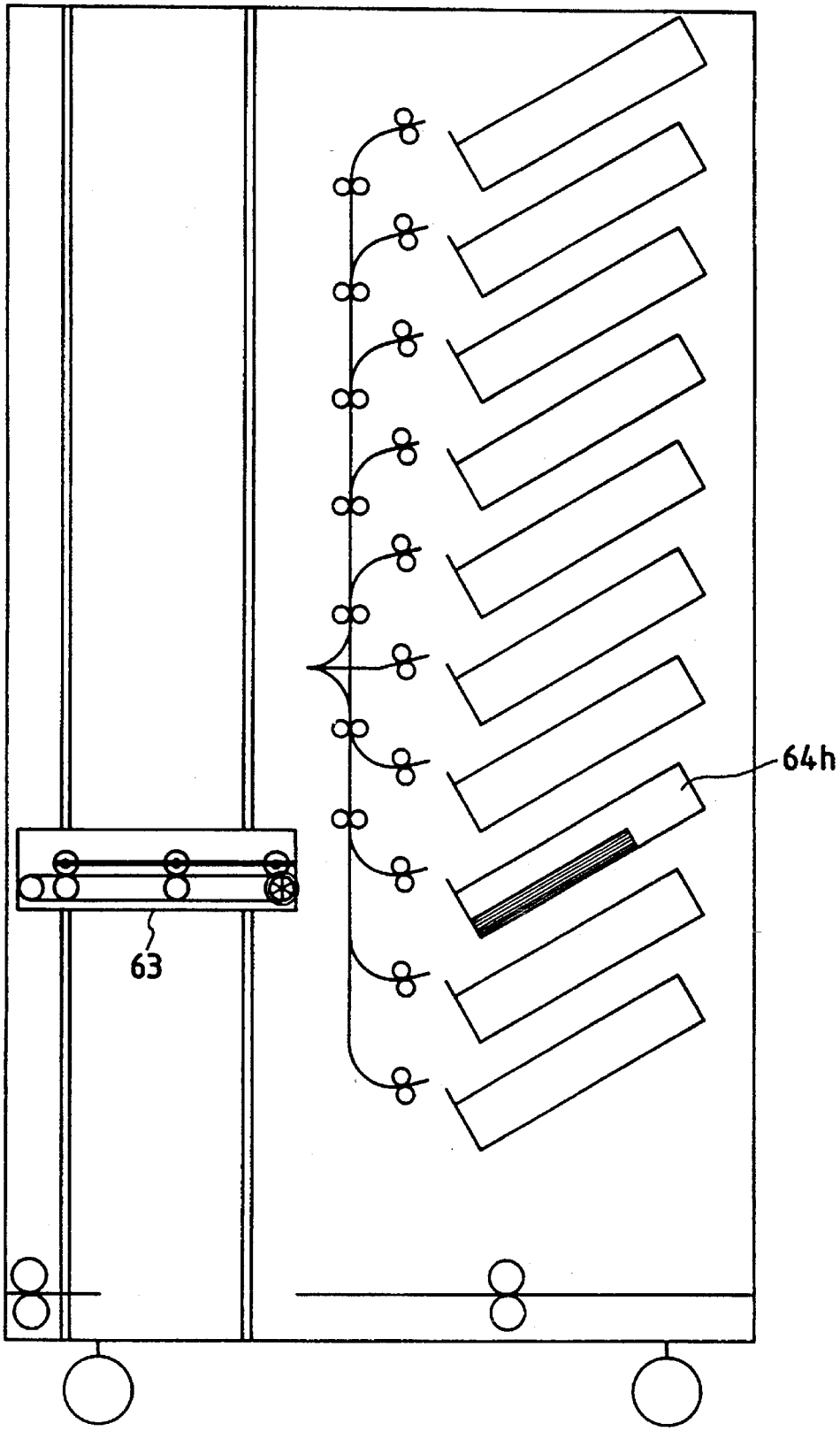

As shown in FIG. 12, the ascent/descent convey member 63 is aligned with the height position of the sheet entrance portion 61 and is stopped there, similar to FIG. 11, and the inlet portion of the ascent/descent convey member 63 is aligned with the outlet portion 19 of the image forming apparatus or the like. Then, the sheet bundle having the thickness greater than the predetermined value is pinched by the pairs of rollers of the ascent/descent convey member 63. Thereafter, as shown in FIG. 13, the ascent/descent convey member 63 is lowered to be aligned with a desired tray (for example, tray 64) and is stopped there. In this condition, the stepping motor 82 is activated to separate the driven roller from the drive roller of the pair of discharge rollers 66*h* associated with the tray 64*h*. Then, the pairs of rollers 63*a*–63*c* and the convey belt 63*d* are rotated to pass the sheet bundle pinched by the ascent/descent convey member 63 through between the drive roller and the driven roller (of the pair of discharge rollers 66*h*), thereby discharging the sheet bundle onto the tray 64*h*. FIG. 14 shows a condition that the sheet bundle has been discharged. Thereafter, the ascent/descent convey member 63 is lifted to be aligned with the sheet entrance portion 61 again and is stopped there. The ascent/descent convey member 63 is maintained in this position to receive the next sheet bundle.

[In the case where a number of sheets are bound in the bookbinding apparatus 203]

When the sheet bundle bound in the bookbinding apparatus 203 is sorted into one of the trays 64*a*–64*j*, the ascent/descent convey member 63 is previously lowered to be aligned with the straight path 67*b*. The sheet bundle bound (glued) at the gluing portion of the bookbinding apparatus 203 shown in FIG. 9 is conveyed to the elevator 160, and is normally stored on the stacker 172. On the other hand, when the sheet bundle is desired to be discharged onto a desired one of the trays 64*a*–64*j*, the elevator 160 is lowered to a lowermost position, where a belt is rotated to shift the sheet bundle to the right. The sheet bundle shifted to the right enters between the pair of the separated introduction rollers 67*a* and is pinched by the rollers 67*a*. Then, the sheet bundle is further shifted to the right by the paired rollers 67*a* to be introduced between and pinched by the pairs of rollers 63*a*–63*c* of the ascent/descent convey member 63 aligned with the straight path 67*b*. Thereafter, the ascent/descent convey member 63 is lifted to convey the sheet bundle to the desired one of the trays 64*a*–64*j*. Then, the sheet bundle is discharged onto the desired tray through the corresponding pair of discharge rollers.

In the normal utilizing condition wherein the single sheet S or the sheet bundle having the thickness smaller than the predetermined value is conveyed, in response to the command signal from the control means 69, the ascent/descent convey member 63 is positioned in alignment with the sheet entrance portion 61 so that the inlet portion of the ascent/descent convey member 63 is connected to the outlet portion of the stapling apparatus. The single sheet or the sheet bundle having the thickness smaller than the predetermined value is guided to the flappers 65*a*, 65*b* through the ascent/descent convey member 63 and then is introduced into the convey guide 62*j* of the convey vertical path 62 so that the sheet or the sheet bundle can be conveyed by the pairs of rollers 62*a*–62*j*. The sheet or the sheet bundle having the thickness smaller than the predetermined value is directed to one of the branch paths 75*a*–75*i* by one of the flappers 71*a*–71*g* corresponding to the desired one of the trays 64*a*–64*j* and then is discharged onto the desired tray by the corresponding pair of discharge rollers 66*a*–66*j*.

Figure 15:
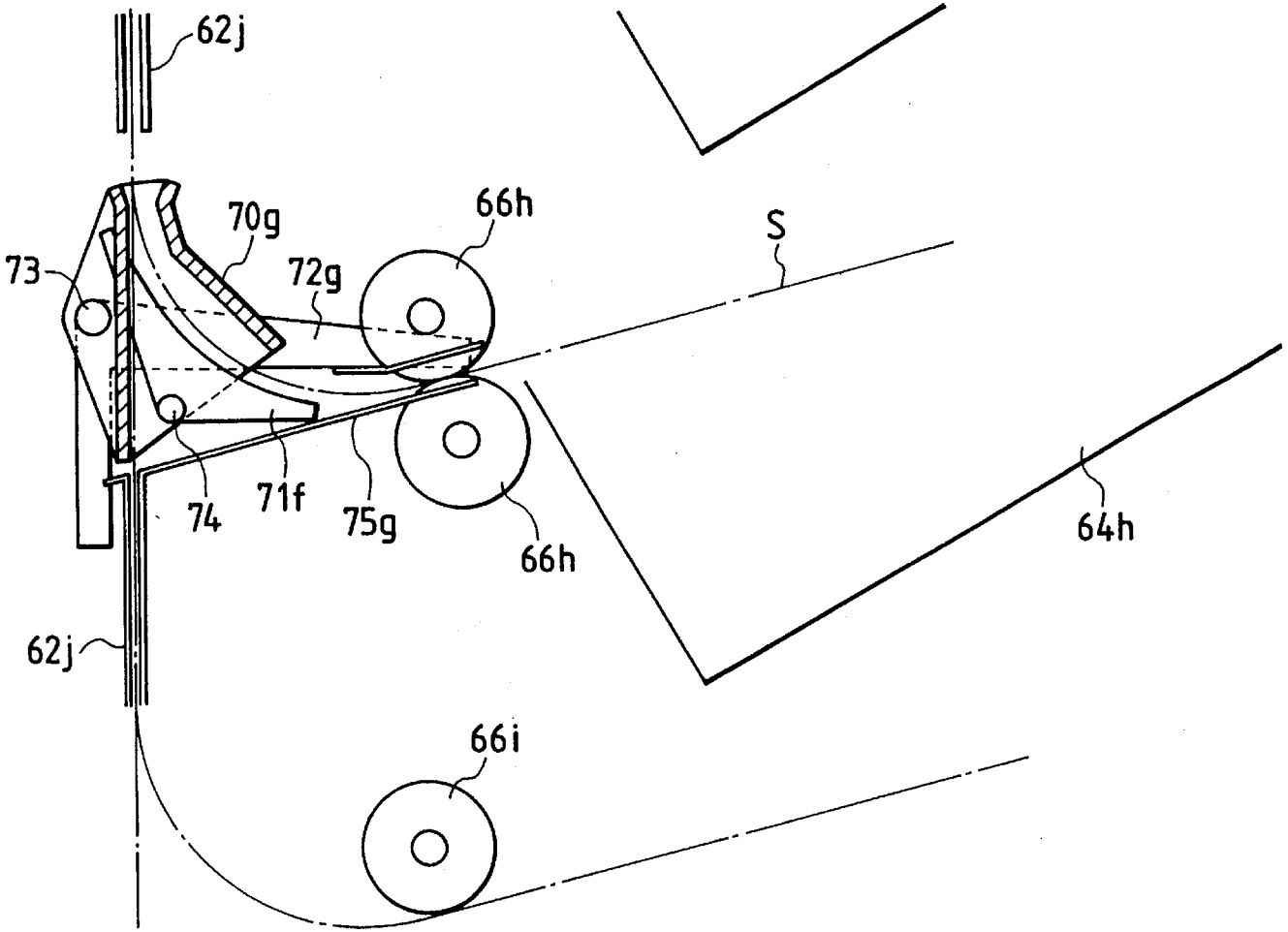
FIG. 15 is an enlarged sectional view of an opening/closing guide portion.
Figure 16:
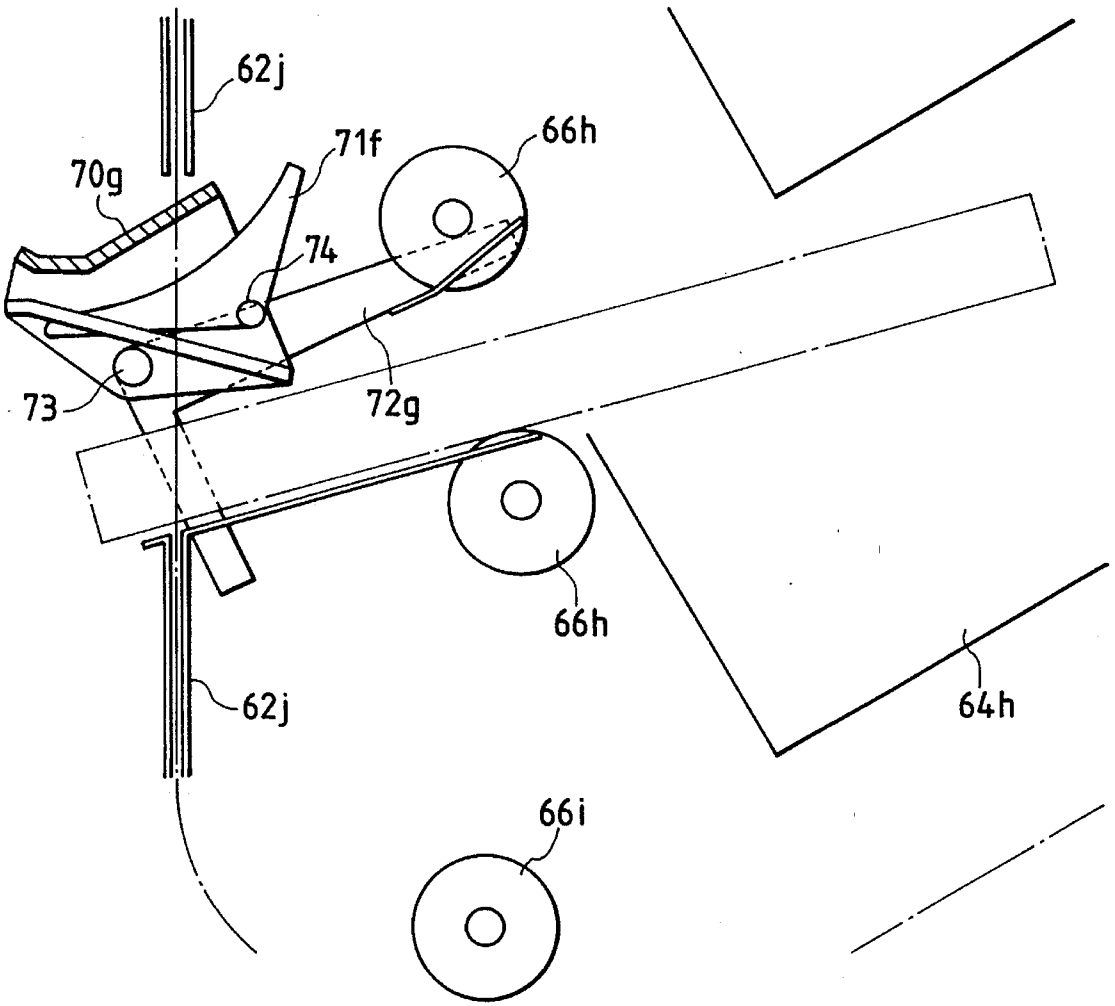
FIGS. 16 and 17 are views for explaining the opening/closing guide portion of FIG. 15.

In this way, when the single sheet S or the sheet bundle having the thickness smaller than the predetermined value is conveyed, the upper driven roller and the lower drive roller of each pair of discharge rollers 66*a*–66*j* are abutted against each other, and the sheet or the sheet bundle is shifted by the rotation of the lower drive roller. The flappers 71*a*–71*g* are individually controlled by the corresponding solenoids (not shown). That is to say, as shown in FIG. 15, the flapper corresponding to the desired tray is rocked leftwardly to guide the sheet S or the sheet bundle.

Figure 17:
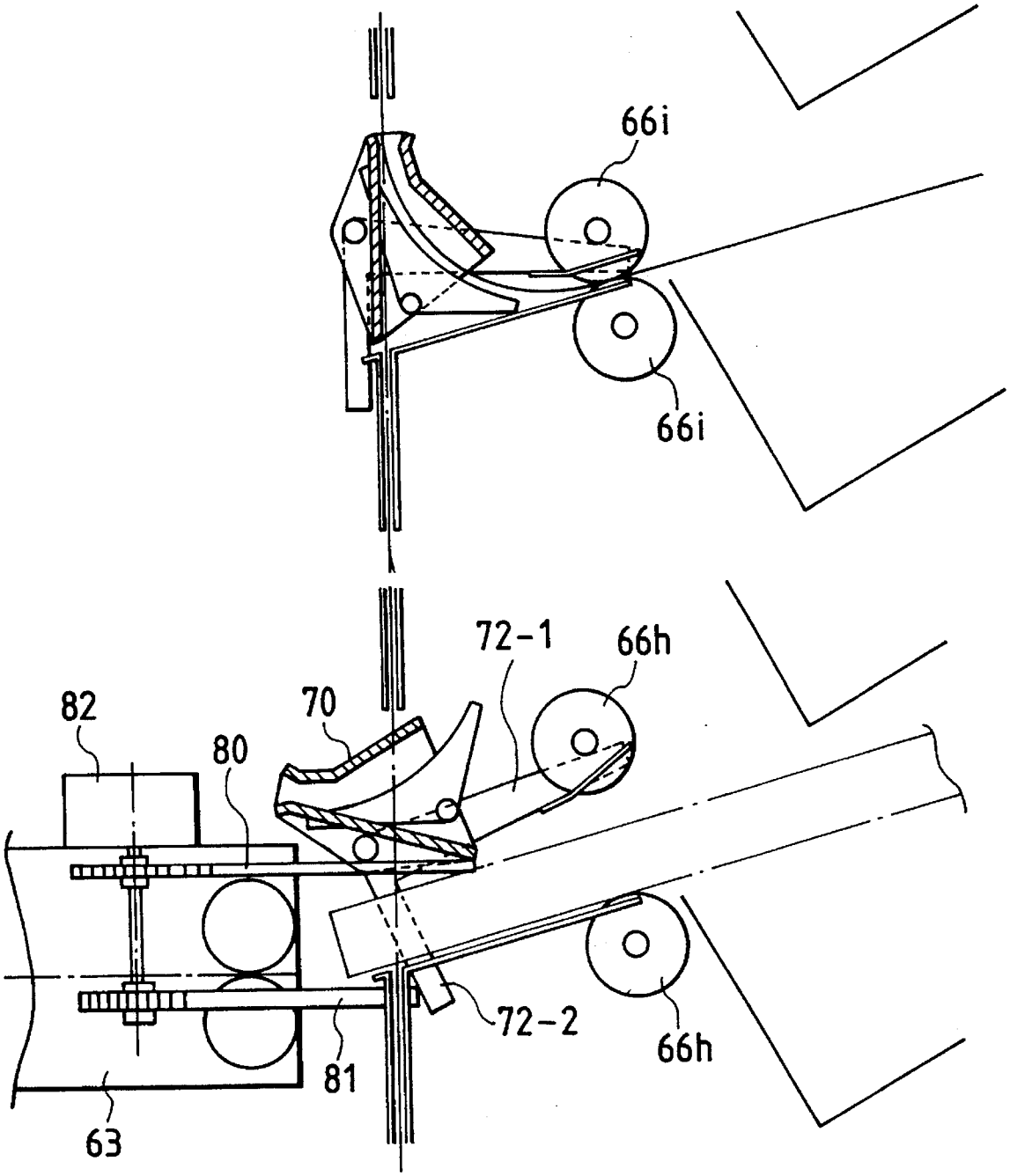
Figure 18:
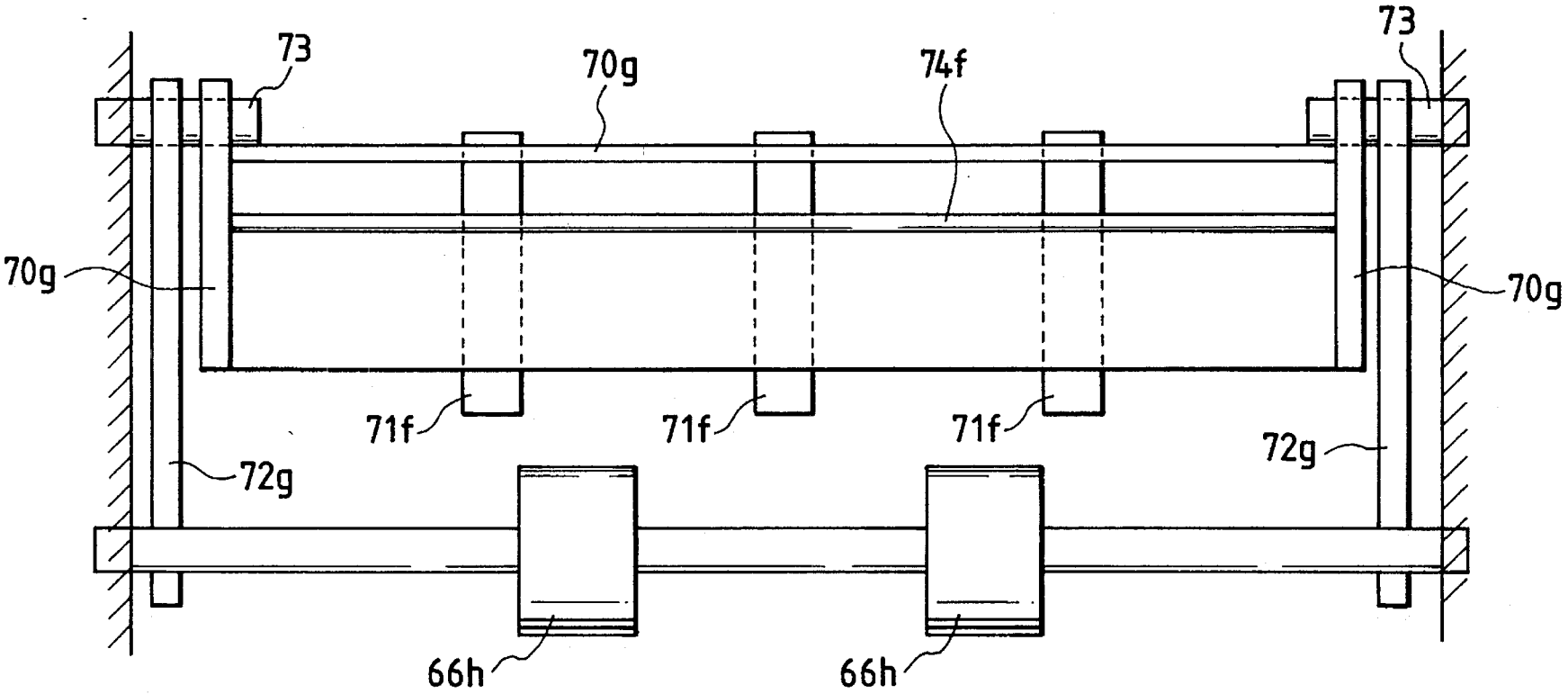
FIG. 18 is a plan view of the opening/closing guide portion.

On the other hand, when the sheet bundle having the thickness greater than the predetermined value is conveyed, as shown in FIGS. 13 and 17, in response to the thick sheet bundle convey signal, the ascent/descent convey member 63 is shifted to the position corresponding to the desired or selected tray. Then, the stepping motor 82 shown in FIG. 17 is activated to rotate the opening/closing guide 70 in the counterclockwise direction via the first slide lever 80 and to lift the driven roller of the corresponding pair of discharge rollers 66*a*–66*j* via the second slide lever 81. As a result, the sheet bundle pinched by the ascent/descent convey member 63 is shifted by the pairs of rollers 63*a*–63*c* to enter between the drive roller and the driven roller of the pair of discharge rollers. Then, the sheet bundle is sorted and contained in the desired tray 64*a*–64*j* by the rotation of the drive roller of the pair of discharge rollers 66*a*–66*j*.

When the stepping motor 82 is rotated, the first and second slide levers 80, 81 are shifted to the right, with the result that the opening/closing guide 70 is lifted by the first slide lever 80 to be rotated in the counterclockwise direction and the second arm 72-2 of the release lever 72 is lifted by the second slide lever 81 to be rotated in the counterclockwise direction. By the counterclockwise rotation of the release lever 72, a roller shaft of the driven roller of the corresponding pair of discharge rollers 66*a*–66*j* is lifted by the first arm 72-1, thereby separating the driven roller from the drive roller. In this way, a convey path for guiding the sheet bundle is formed between the driven roller and the drive roller. In this condition, in response to the convey path formation finishing signal, when the convey belt 63*d* of the ascent/descent convey member 63 is rotated in the clockwise direction to shift the sheet bundle to the right, the sheet bundle is further shifted to the right by the rotation of the drive roller of the paired discharge rollers, thereby discharging the sheet bundle onto the desired tray 64*a*–64*j*. After the discharging operation, the rotation of motor 82 is reversed to retract the first and second slide levers 80, 81, and the ascent/descent convey member 63 is returned to its initial position.

Incidentally, in the above-mentioned embodiments, while an example that the single sheet sorting and containing apparatus is used was explained, two sheet sorting and containing apparatuses having the same construction may be arranged side by side so that an outlet portion of a connection convey path of the first apparatus is communicated with a sheet entrance portion of the second apparatus. With this arrangement, the number of trays in the containing portion is doubled.

In the arrangement as mentioned above, the ascent/descent convey member can receive the single sheet, the stapled sheet bundle or the glue-bound sheet bundle, and the sheet or the sheet bundle can be sorted and contained without worsening the operating efficiency of the system.

Further, with the arrangement as mentioned above, (i) a pair of rollers can be omitted from the sheet entrance portion; and (ii) when the single sheet is contained, it is not required to shift the ascent/descent convey member to the position corresponding to the desired or selected tray in the containing portion, and the ascent/descent convey member can act as a convey path at a height position corresponding to the sheet entrance portion. That is to say, the ascent/descent convey member can be lifted or lowered at a slower speed. This contributes the improvement of the reliability and reduction of noise.

Next, the bookbinding apparatus 203 will be fully explained with reference to FIG. 19.

Figure 19:
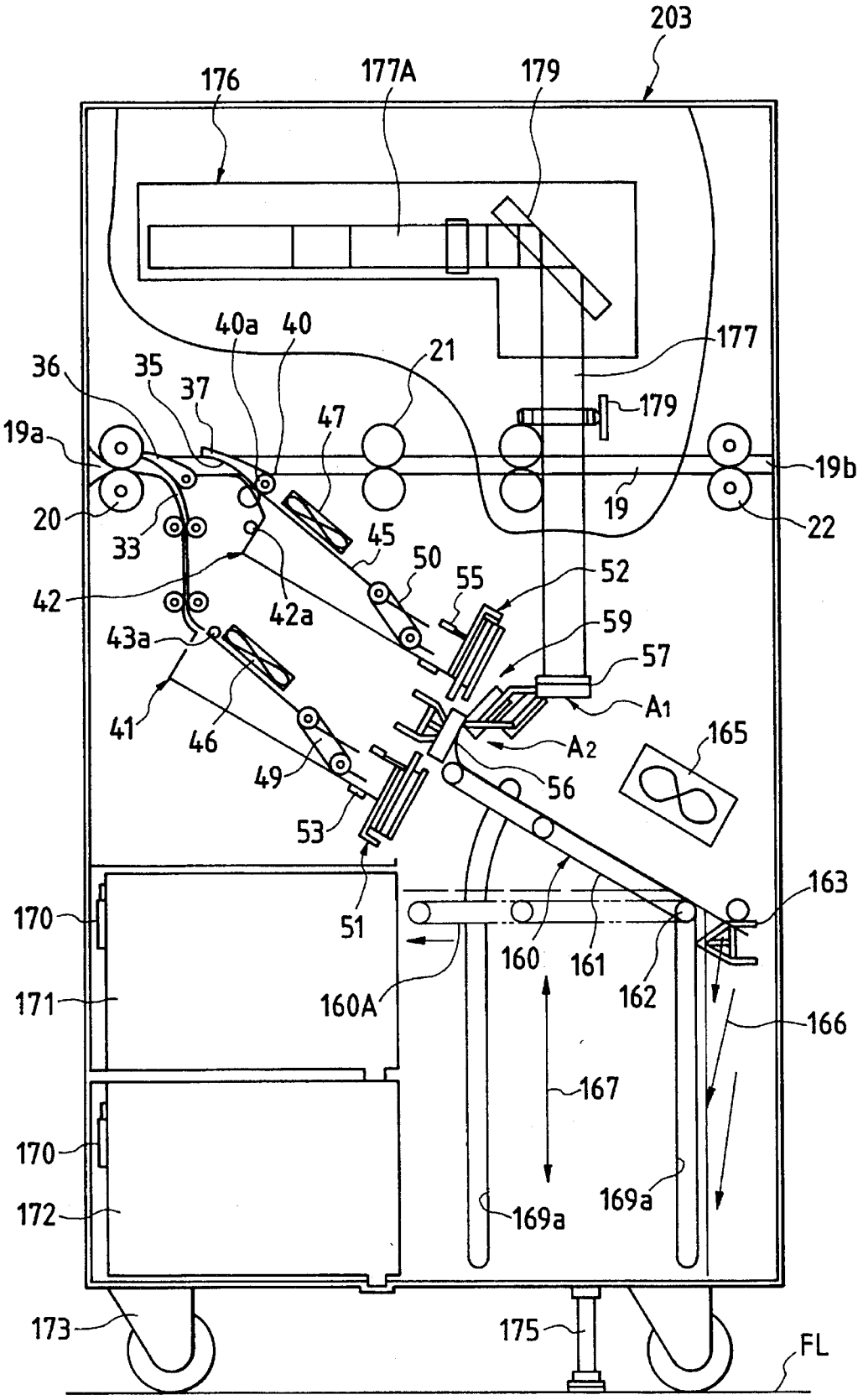
FIG. 19 is an elevational sectional view of a bookbinding apparatus.

In FIG. 19, the bookbinding apparatus 203 includes a sheet convey path 19 for the sheet sent from the image forming apparatus 202, and the sheet convey path 19 has an inlet end 19*a* and a discharge end 19*b*. A pair of introduction rollers 20, a plurality of pair of convey rollers 21 and a pair of discharge rollers 22 are arranged along the sheet convey path 19 from an upstream side to a downstream side thereof.

In the proximity of the downstream side of the pair of introduction rollers 20, there are arranged first and second flappers (branching means) 36, 37 capable of guiding the sheet from the sheet convey path 19 to guide portions 33, 35, respectively. The branching means 36, 37 are selectively operated to direct the sheet S to either of the guide portions 33, 34. When both of the branching means 36, 37 are not operated, the sheet S is conveyed through the sheet convey path 19.

A first sheet align tray 41 having an upper guide plate 43*a* is disposed at a downstream side of the guide portion 33, and a first abutment member 51 against which the sheet S is abutted is formed on a tip end of the sheet align tray. The sheets S sent to the first align tray 41 by a pair of convey rollers 39 are shifted toward the first abutment member 51 by a sweeping and collecting member (sweeping and collecting means) 49 comprising a rotatable belt which can be rocked around its one end (upper left end in FIG. 19) so that the sheets are abutted against the first abutment member to be aligned with each other. A fan (air sending means) 46 arranged above the upper guide plate 43*a* serves to urge the sheets S against the first sheet align tray 41 by air to prevent the folded sheets from swelling. Incidentally, the reference numeral 53 denotes a clamp member for clamping the sheet bundle having a predetermined number of sheets.

A second sheet align tray 42 disposed above the first sheet align tray 41 is constituted in a manner similar to the tray 41, and a pair of convey rollers 40, an upper guide plate 45, a second abutment member 52, a sweeping and collecting member 50, a fan 47 and a clamp member 55 are associated with the second sheet align tray.

A tape reel 177A is housed in a tape unit 176 arranged within the bookbinding apparatus 203 at an upper part thereof. A bind tape 177 unwound from the tape reel is directed in a vertical direction via an inclined deflection roller 178. The bind tape 177 is cut to a predetermined length by a cutter 179 and is sent to a tape supply position where a second tape heating apparatus 57 which will be described later is arranged. A first tape heating apparatus 56 serves to heat a back surface of the bind tape 177, thereby bonding the sheet bundle. A pass-by path 59 serves to guide the first and second tape heating apparatuses 56, 57 without collision therebetween.

A carriage 160 includes a convey belt (convey means) 161A and a handling member 163 movable together with the convey belt. The carriage can be rocked around a roller shaft of a roller 162 and be shifted in a vertical direction shown by the arrow 167 along a pair of vertical slots 169*a*, 169*b*. The sheet bundle bookbound by the handling member 163 and the first tape heating apparatus 56 is shifted toward the roller 162 by rotation of the convey belt 161 to be rested on the carriage 160.

A fan 165 serves to cool the bookbound sheet bundle by flowing air in a direction shown by the arrows 166. The sheet bundle is sent from the carriage 160 into a stacker 171 or 172. The stackers 171, 172 are retractably supported by rails 170. Incidentally, the reference numeral 173 denotes casters for shiftably supporting the bookbinding apparatus; and 175 denotes a leveller for adjusting the height of the bookbinding apparatus.

Figure 20:
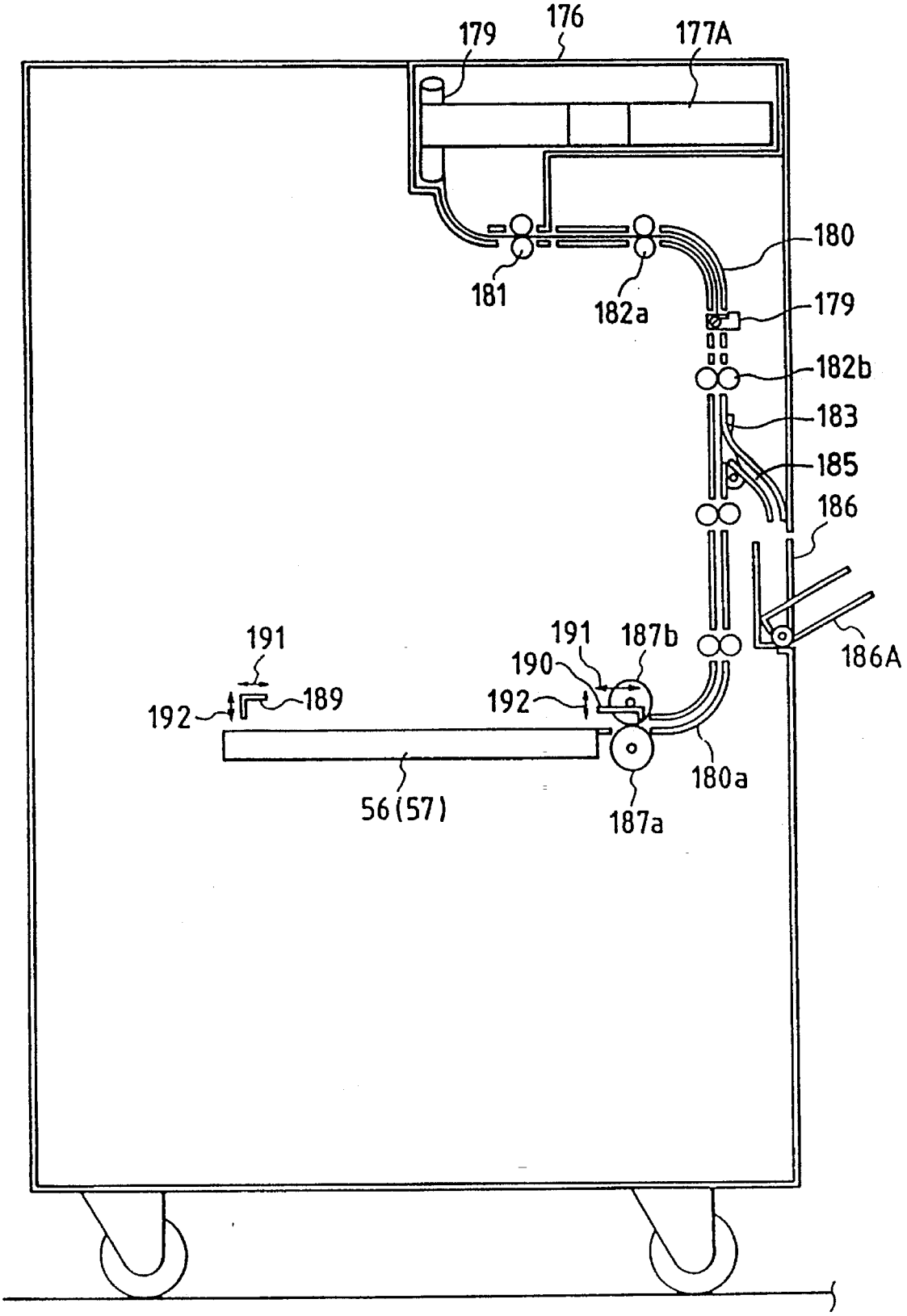
FIGS. 20 to 22 are front views of a tape supply portion.

FIG. 20 is a front view showing a convey path for the bind tape 177. The bind tape 177 unwound from the tape reel 177A is fed out by a pair of feed rollers 181 and is guided downwardly along a guide path 180. Between a pair of convey rollers 182*b* and a pair of convey rollers 182*c* which are arranged in the convey path 180 on the way, a dust path 185 is branched from the convey path 180 and a flapper 183 serves to switch to the dust path. A dust box 186 is disposed below the dust path 185 and can be rocked out of the apparatus. A pair of tape supply rollers (tape supply means) 187 comprising a rubber roller 187*a* and an urging roller 187*b* is arranged in the proximity of a lower end 180*a* of the convey path 180.

The first or second tape heating apparatus 56 or 57 is positioned at a tape supply position $A_1$ (FIG. 41) opposed to the pair of tape supply rollers 187 to receive the tape 177. A finger 189 for regulating a tip end of the supplied tape and a finger 190 for regulating a trailing end of the supplied tape can be shifted in directions shown by the arrows 191, 192.

Figure 21:
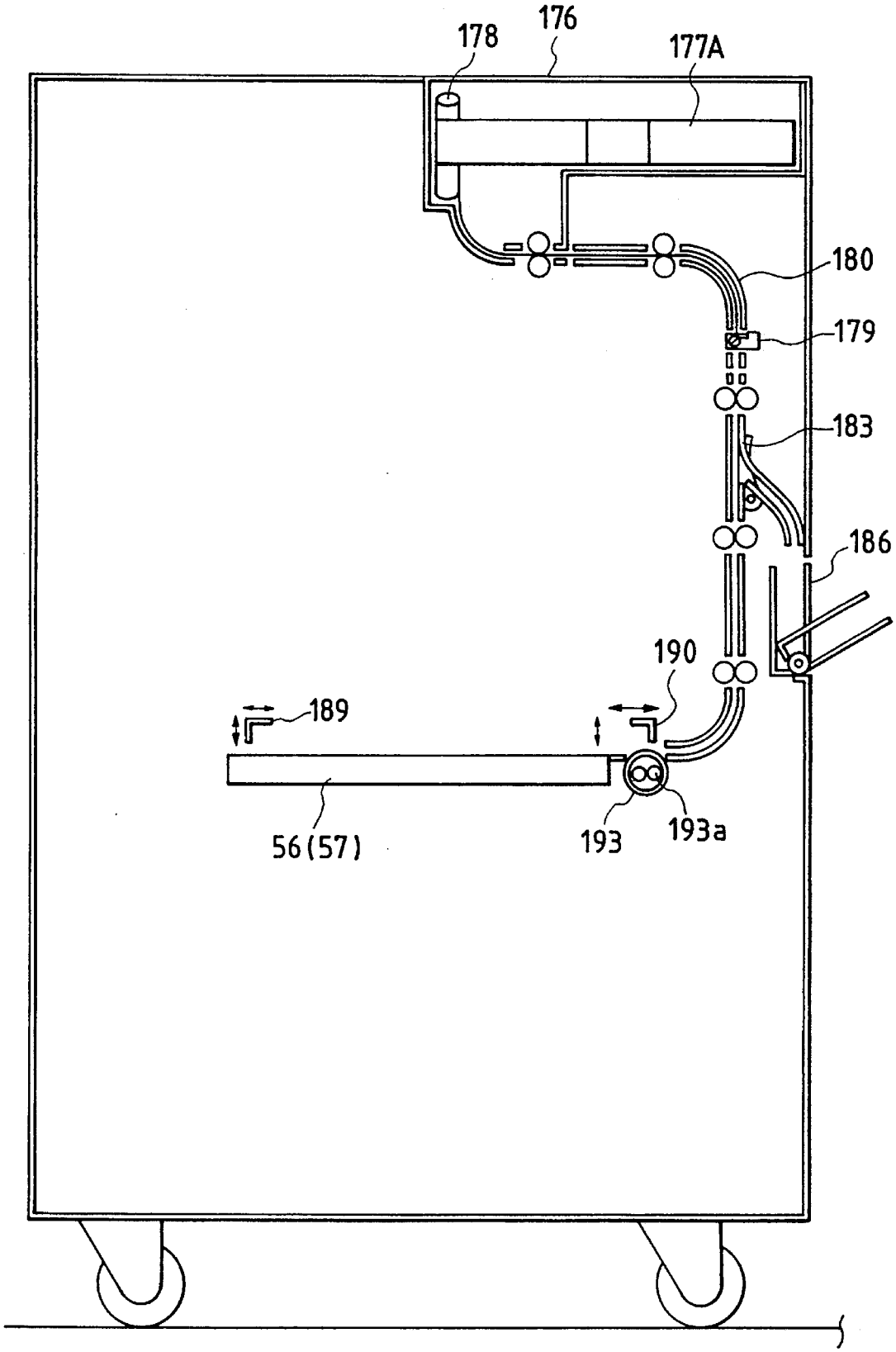

FIG. 21 shows another tape supply means for directing the bind tape 177 conveyed through the convey path 180 to the tape heating apparatus 56 (57). In FIG. 21, a hollow roller 193 having a vacuum fan 193*a* therein is arranged in the proximity of the lower end 180*a* of the convey path 180. A number of air suction holes (not shown) are formed in a peripheral surface of the hollow roller 193 so that the bind tape is supplied to the tape heating apparatus 56 (57) while absorbing the tape by the hollow roller.

Figure 22:
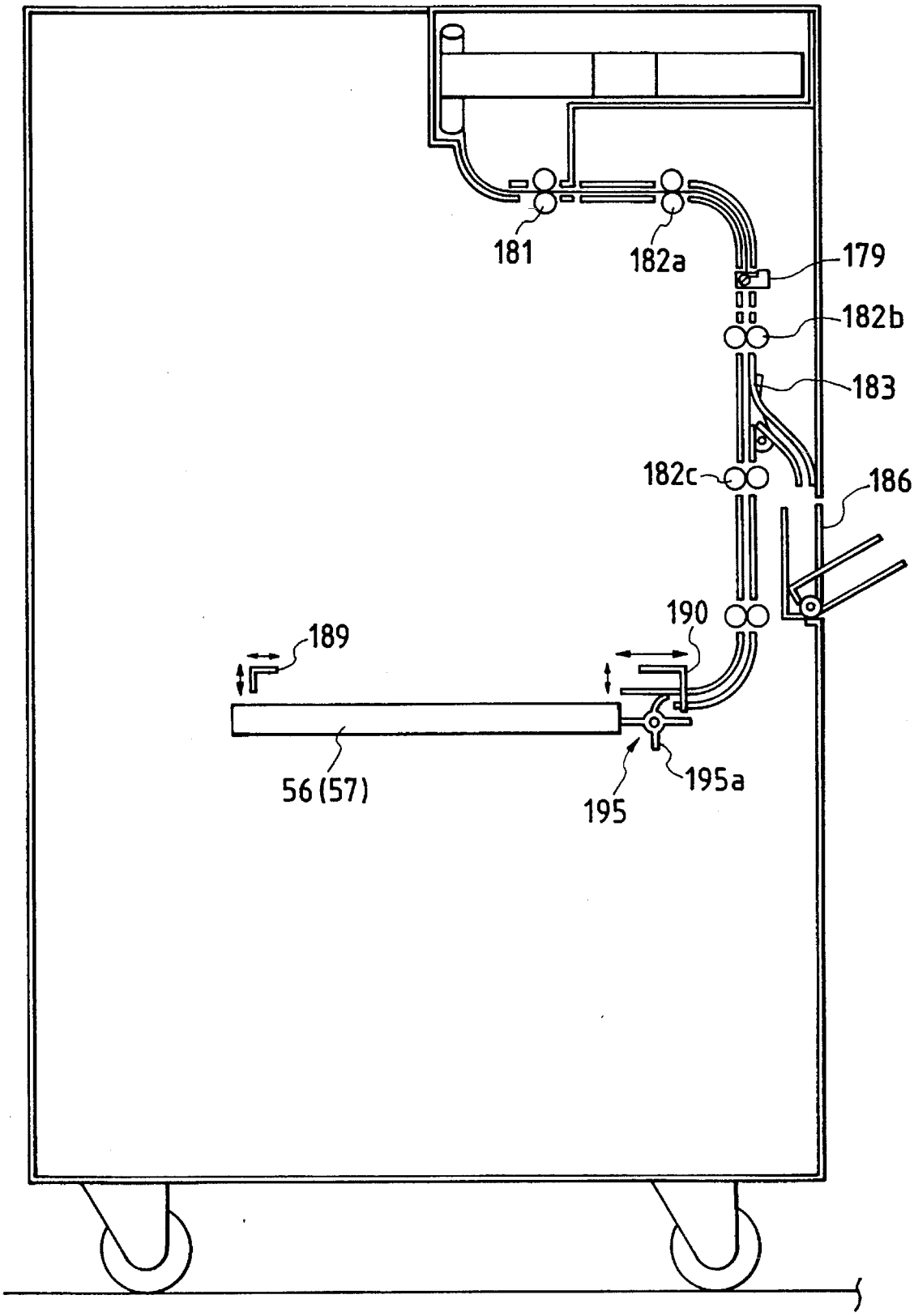

FIG. 22 shows a further tape supply means which can apply a small conveying force to the bind tape 177. A paddle 195 has a plurality of elastic plates 195*a* having high coefficient of friction so that the bind tape separated from the tape supply means 187 or 193 can be conveyed with the small conveying force.

Figure 23A:
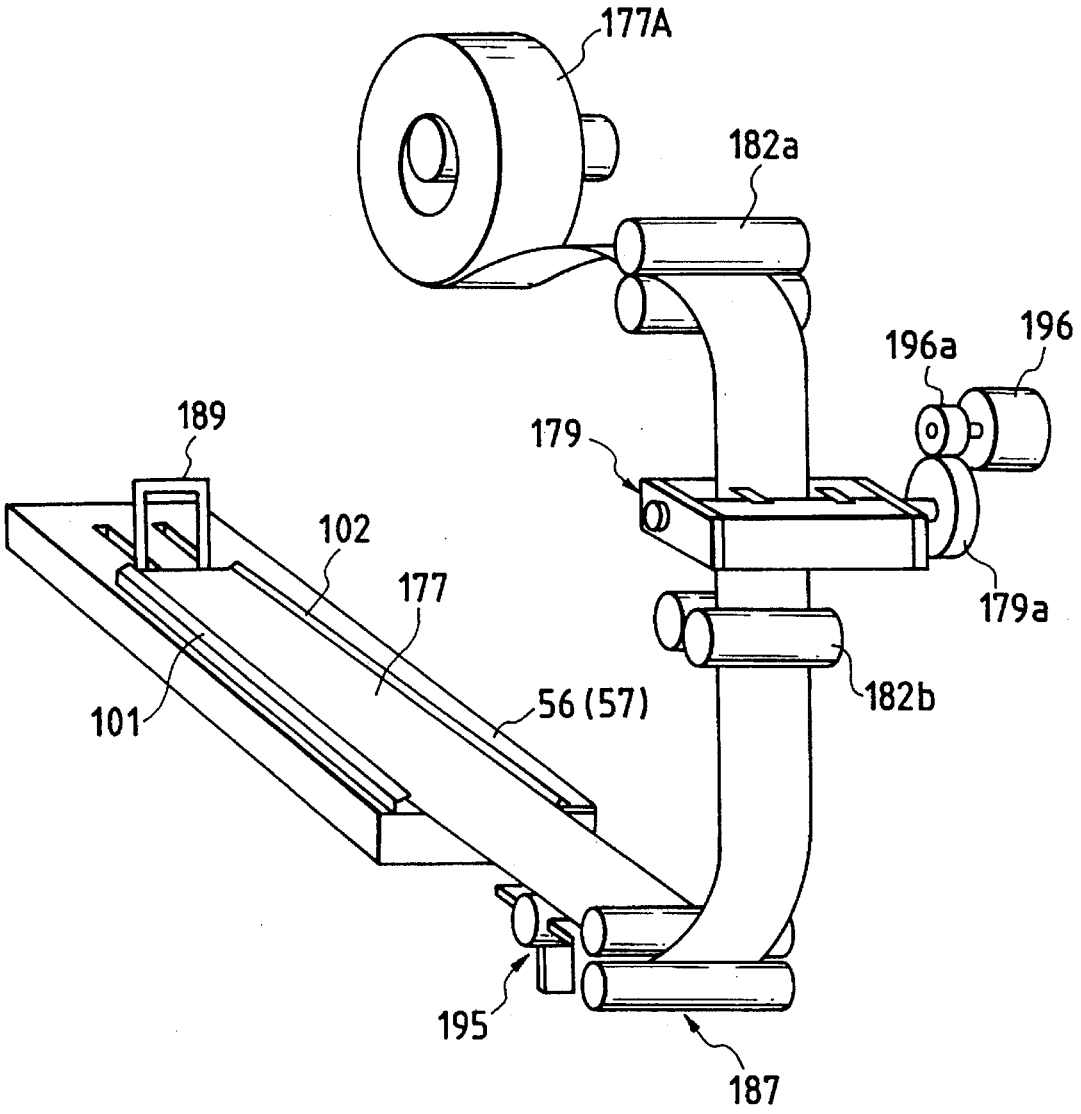
FIG. 23A is a perspective view of the tape supply portion.
Figure 23B:
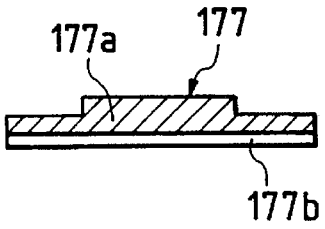
FIG. 23B is a sectional view of the tape supply portion.

FIG. 23A is a perspective view of a tape supply portion, and FIG. 23B is a sectional view of the bind tape 177.

The cutter 179 has a rotary cutter (not shown), and a gear 179*a* secured to a shaft of the rotary cutter is meshed with an output gear 196*a* of a motor 196. Incidentally, a detection sensor (not shown) is arranged in the convey path 180 in place to detect the presence/absence and length of the bind tape 177. If the length of the bind tape 177 cut by the cutter 179 is smaller than a predetermined value, the cut bind tape 177 is discharged into the dust box 186 through the dust path 185.

The tape heating apparatus 56 (57) is provided with a pair of left and right guide members 101, 102 which will be described later so that the bind tape 177 supplied by the tape supply rollers 187 and the paddle 195 is guided by the guide members 101, 102 and is positioned at a predetermined position by the fingers 189, 190. As shown in FIG. 23B, the bind tape 177 comprises a flexible substrate film 177*b* and an adhesive layer 177*a* of hot melt type adhered to the substrate film. The bind tape 177 supplied onto the tape heating apparatus 56 (57) is previously heated by the tape heating apparatus 56 (57).

Figure 24A:
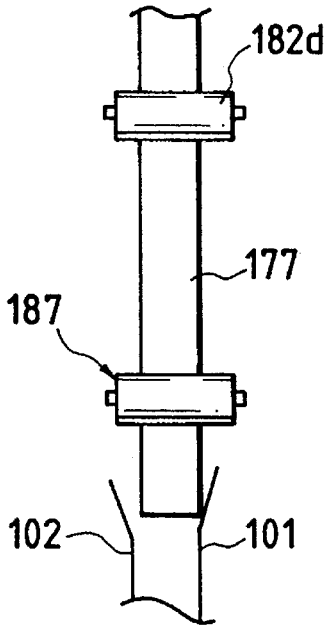
FIG. 24A is a development view of a lower portion of a bind tape path.
Figure 24B:
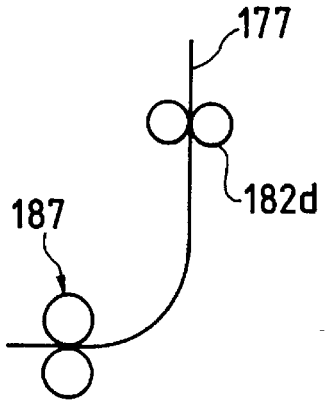
FIG. 24B is a side view of the lower portion of the bind tape path.

FIG. 24A is a development view of the bind tape 177 and the guide members 101, 102 at the tape supply portion, and FIG. 24B is a side view showing the elements of FIG. 24A.

Figure 25:
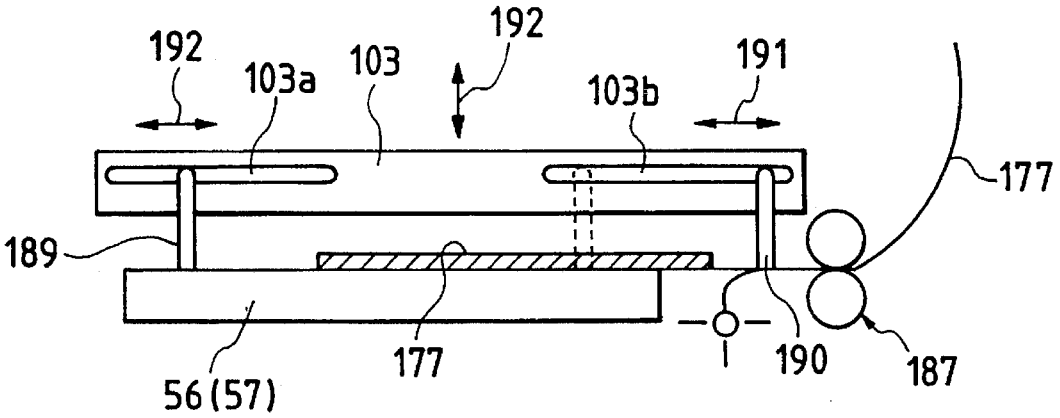
FIG. 25 is a side view of a tape heating apparatus and a positioning member at a tape supply position.
Figure 26:
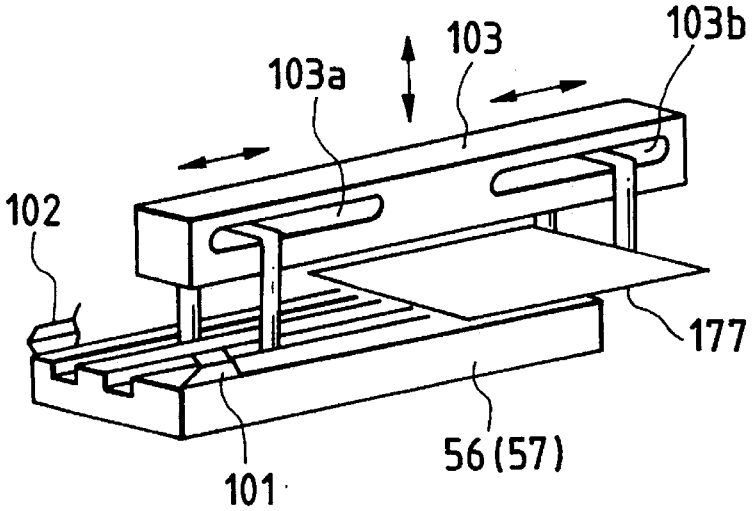
FIG. 26 is a perspective view of the heating apparatus and the positioning member.

In FIGS. 25 and 26, the fingers 189, 190 can be shifted in a front and rear direction shown by the arrows 191 along elongated slots 103*a*, 103*b* formed in a positioning member 103, thereby positioning the bind tape 177 supplied onto the tape heating apparatus 56 (57). After the positioning operation, the positioning member 103 is shifted in an upward direction shown by the arrow 192 to be retarded from the tape.

Figure 27:
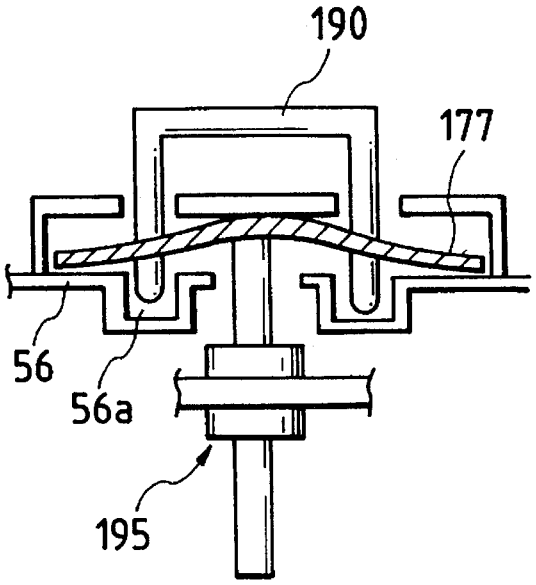
FIG. 27 is a front sectional view of a tape guide portion.
Figure 28:
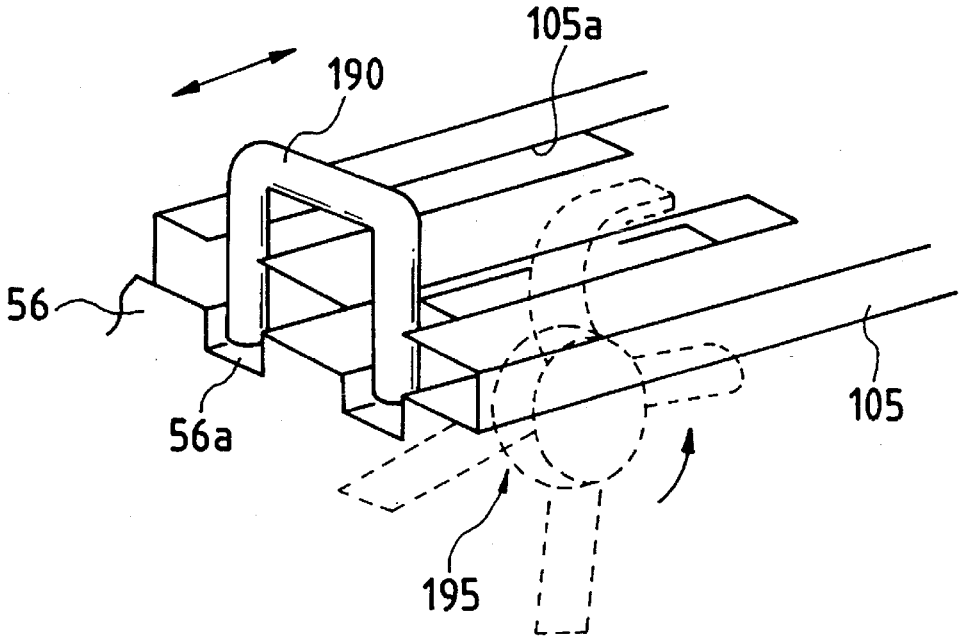
FIG. 28 is a perspective view of the tape guide portion.

In FIGS. 27 and 28, a table guide 105 extends from a lower end of the upper guide plate defining the convey path 180 and is provided with slots 105*a* within which the finger 190 can be freely moved. Further, the table guide 105 is overlapped with the end portion of the first tape heating apparatus 56 so that the lower end of the finger 190 can be freely moved within grooves 56*a* formed in the tape heating apparatus. With this arrangement, the trailing end of the bind tape 177 fed out by the paddle 195 is further shifted toward the first tape heating apparatus 56 and is positioned there.

Figure 29:
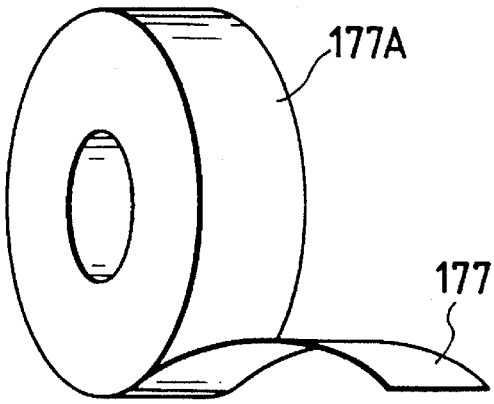
FIG. 29 is a perspective view of a tape reel.
Figure 30:
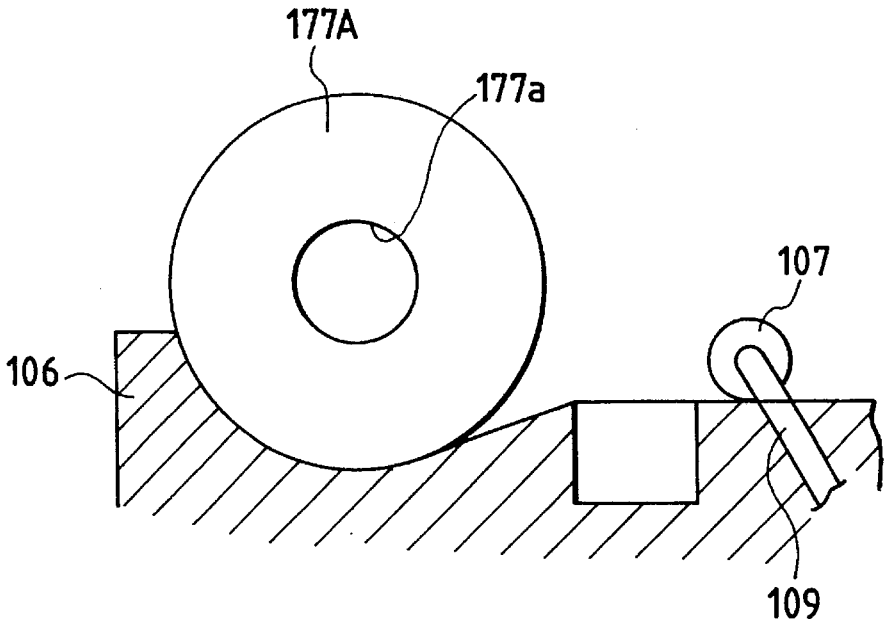
FIG. 30 is a side view of a support member for supporting a plurality of tape reels.
Figure 31:
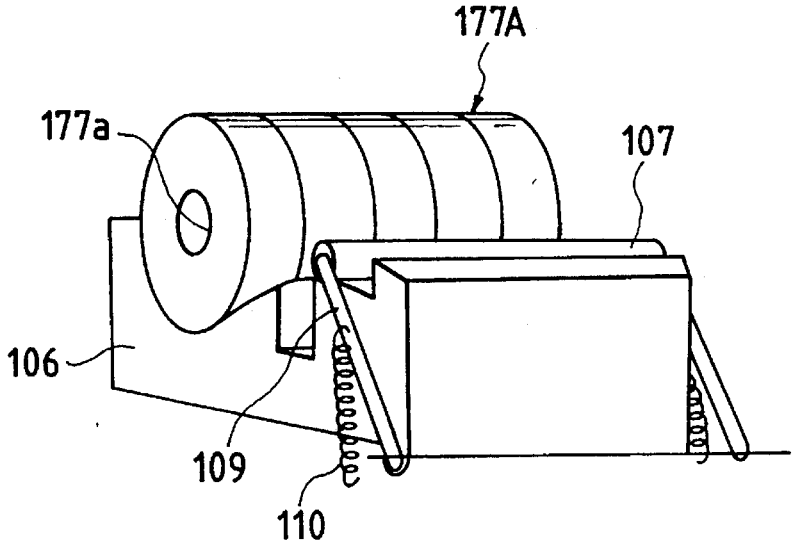
FIG. 31 is a perspective view of the support member of FIG. 30.

In FIGS. 30 and 31, a plurality of tape reels 177A shown in FIG. 29 are housed side by side in a recess formed in a support member 106. The bind tape 177 supplied from the tape reel 177A is urged against the support member 106 by a hold-down roller 107. A pair of support levers 109 for rotatably supporting the hold-down roller 107 is biased by a tension spring 110 to lower the hold-down roller 107.

Figure 32:
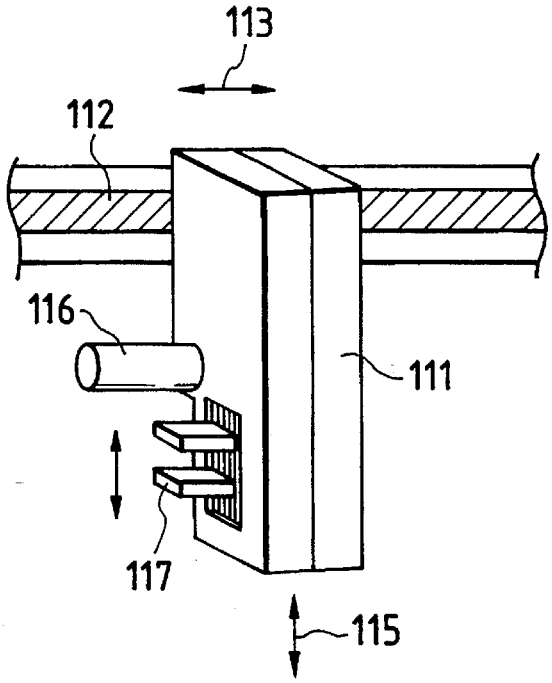
FIG. 32 is a side view of a movable member portion.

A movable member 111 (FIG. 32) is arranged at one end of an array of the tape reels 177A. The movable member 111 is provided at its side surface with a support shaft 116 for supporting a core 177*a* of the tape reel 177A and a pair of guide plates 117 for guiding the bind tape 177 supplied from the tape reel 177A. Further, the movable member 111 has a pinion (not shown) meshed with a rack 112 so that the movable member is reciprocally shifted in directions shown by the arrow 113 by rotation of the pinion. Further, the movable member 111 can be shifted in directions shown by the arrow 115 via a supporting means (not shown).

Figure 33:
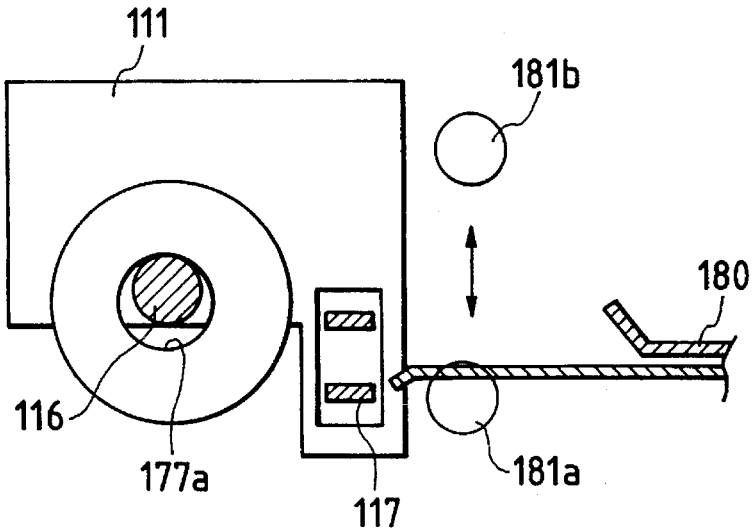
FIG. 33 is a front view of the support member for supporting a plurality of tape reels.

FIG. 33 shows a condition that the bind tape 117 of the tape reel 177A is set in the pair of feed rollers 181 of the tape unit 176. When the bind tape 177 is set, a driven roller 181*b* of the pair of feed rollers 181 is retarded upwardly. In this condition, the end of the bind tape 177 is inserted between the pair of feed rollers 181 and is positioned between the pair of guide plates 117 and the pair of feed rollers 181. Then, the driven roller 181*b* is urged against a drive roller 181*a* again. In this condition, when the pair of feed rollers 181 are rotated, the bind tape 177 of a new tape reel 177A can be supplied into the convey path 180.

Figure 34A:
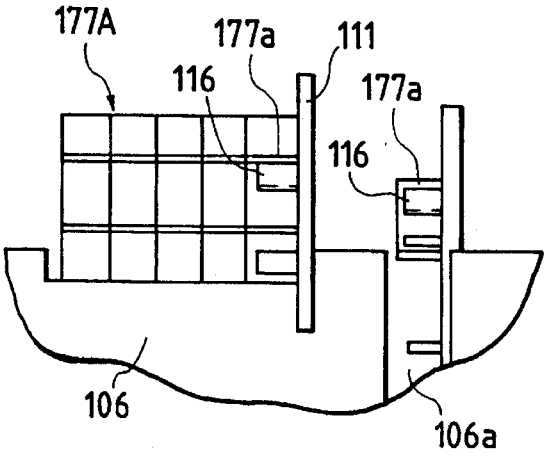
FIG. 34A is a front view of the support member and a tape reel portion.
Figure 34B:
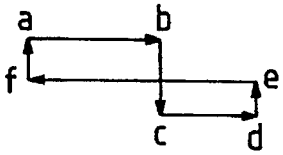
FIG. 34B is a view showing shifting directions of the support member.

In FIGS. 34A and 34B, in a condition that the tape reel 177A is supported by the movable member 111, the support member 106 is shifted upwardly (between f–a in FIG. 34B) and then is shifted to the right (between a–b in FIG. 34B). In this condition, the tape reel 77A is housed in the recess 106*a* of the support member 106 to permit the supplying of the bind tape 177.

Figure 35A:
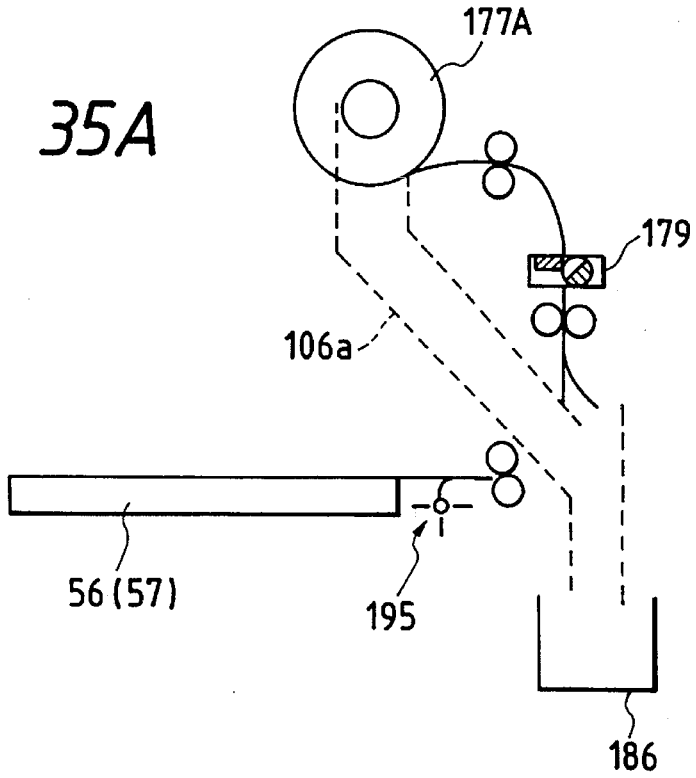
FIG. 35A is a front view of a discharge path.
Figure 35B:
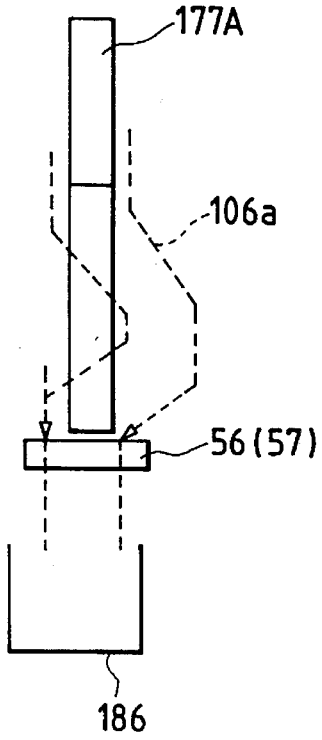
FIG. 35B is a side view of the discharge path.

When the bind tape 177 is used up, the movable member 111 is lowered (i.e. shifted between b–c in FIG. 34B) and then is shifted to the right (between c–d in FIG. 34B), with the result that the core 117*a* of the tape reel 117A is dropped into the recess to be sent to the dust box 186. Then, after the movable member 111 is lifted (between d–e in FIG. 34B), it is shifted to the left (between e–f in FIG. 34B), with the result that the support shaft 116 of the movable member 111 enters into a new tape reel 177A and supports the reel. FIG. 35A is a front view of the dust box 186, and FIG. 35B is a side view of the dust box.

Figure 36:
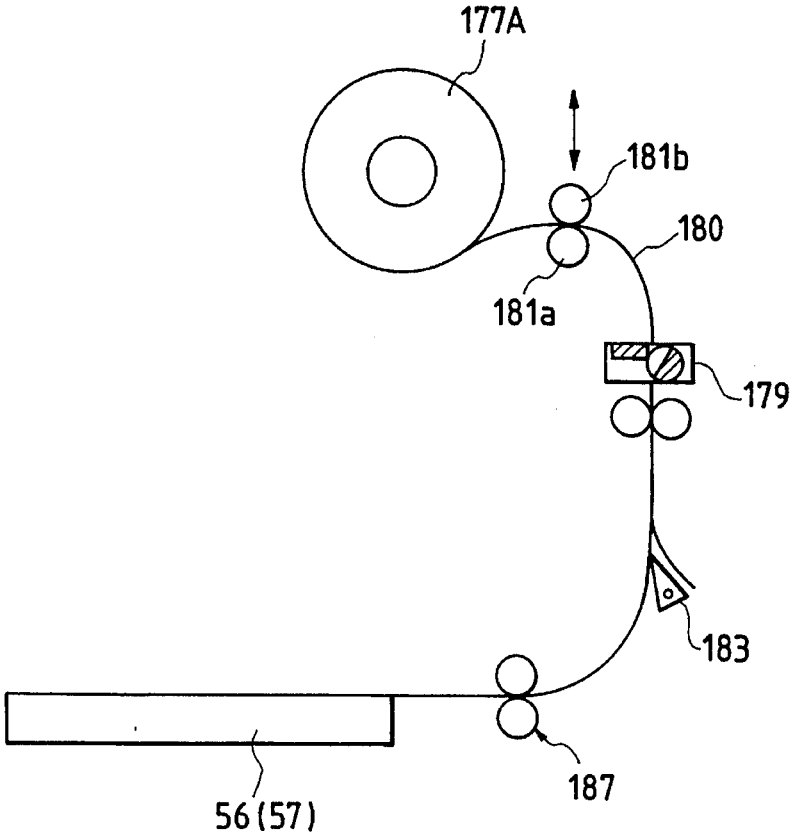
FIG. 36 is a front view of the bind tape path.

FIG. 36 shows the convey path for the bind tape 117. The convey path is arranged not to intersect with the recess 106*a* shown in FIG. 35A.

Figure 37:
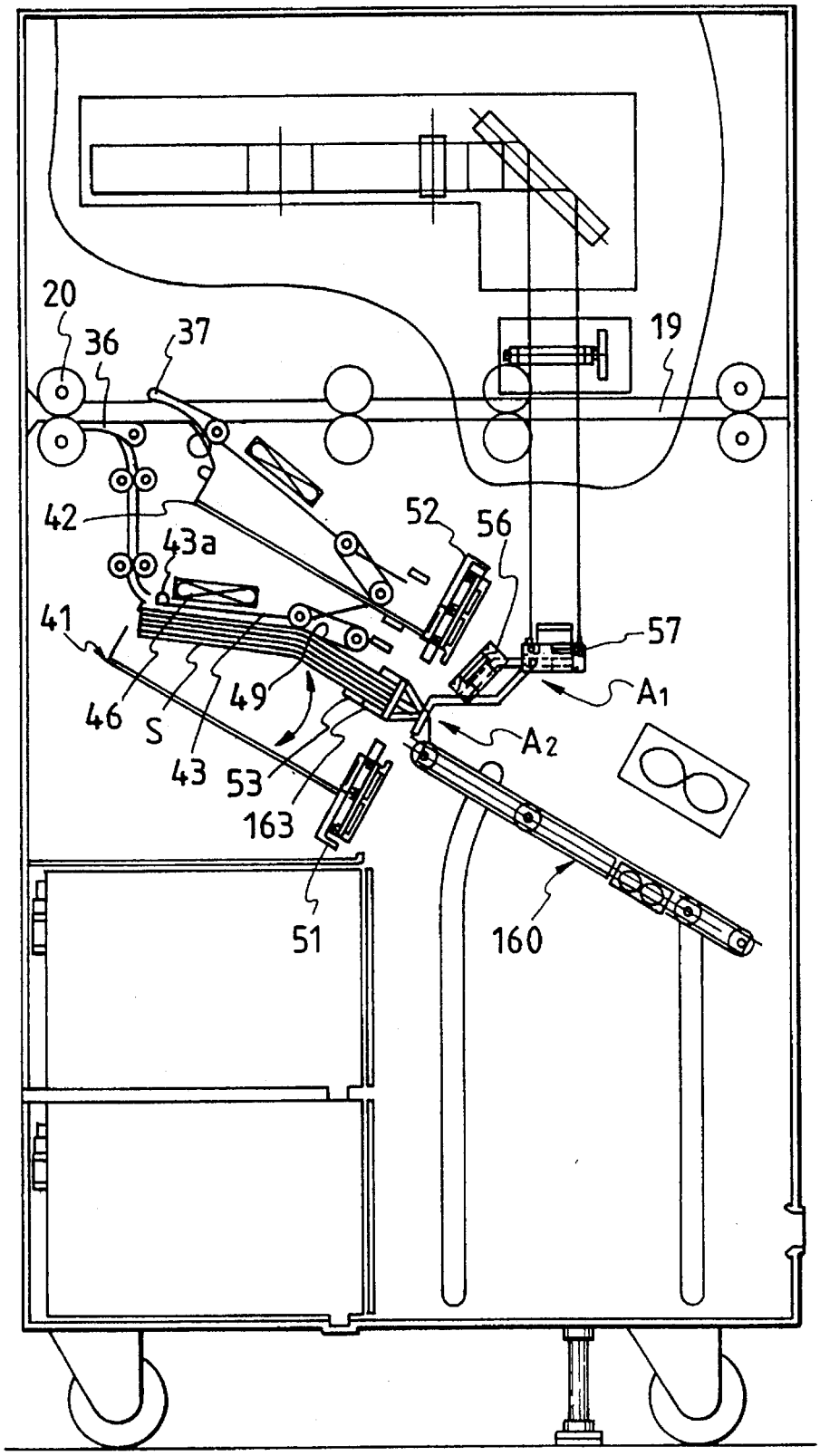
FIGS. 37 to 40 are sectional side views of a bookbinding apparatus.
Figure 38:
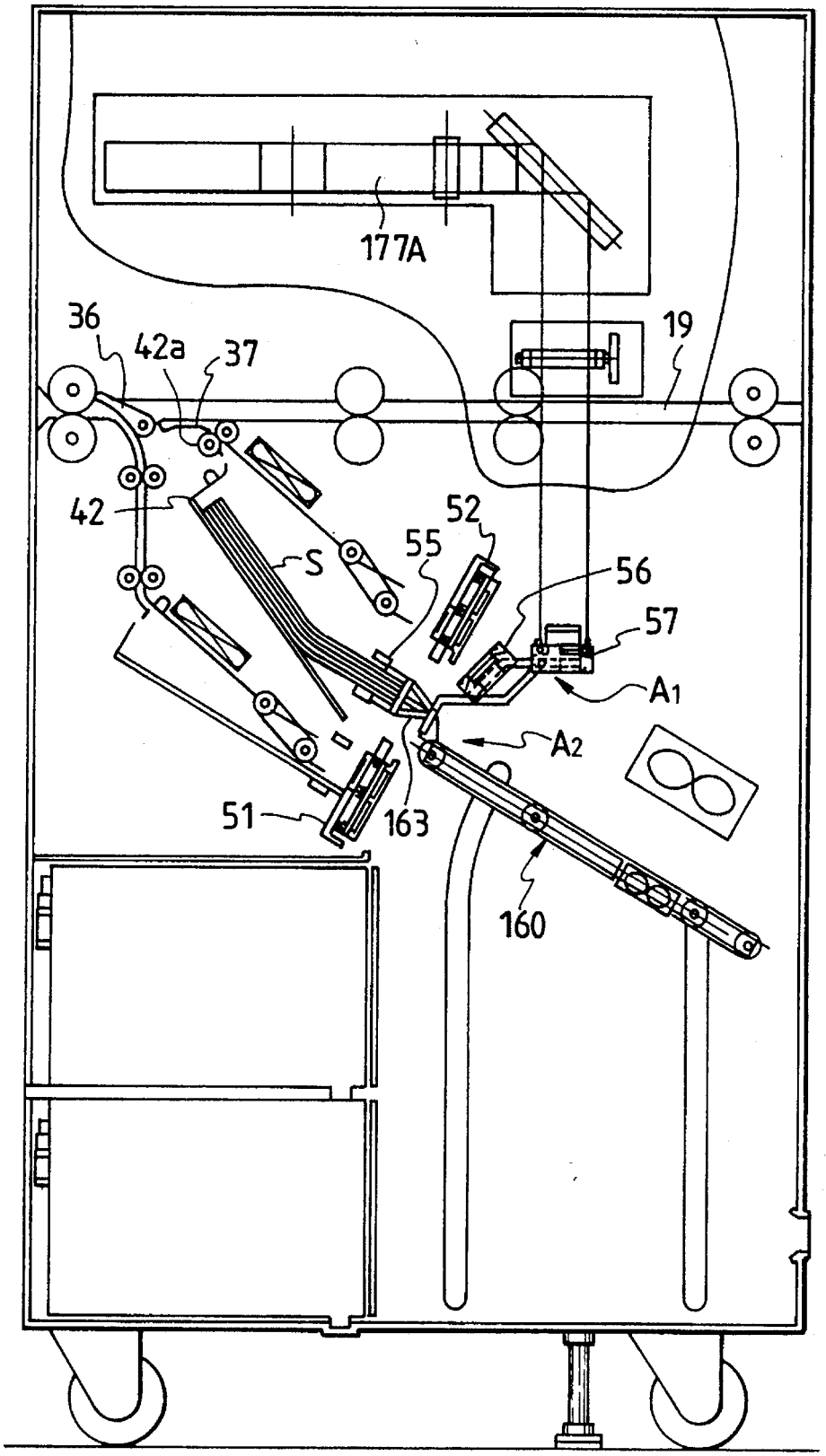
Figure 39:
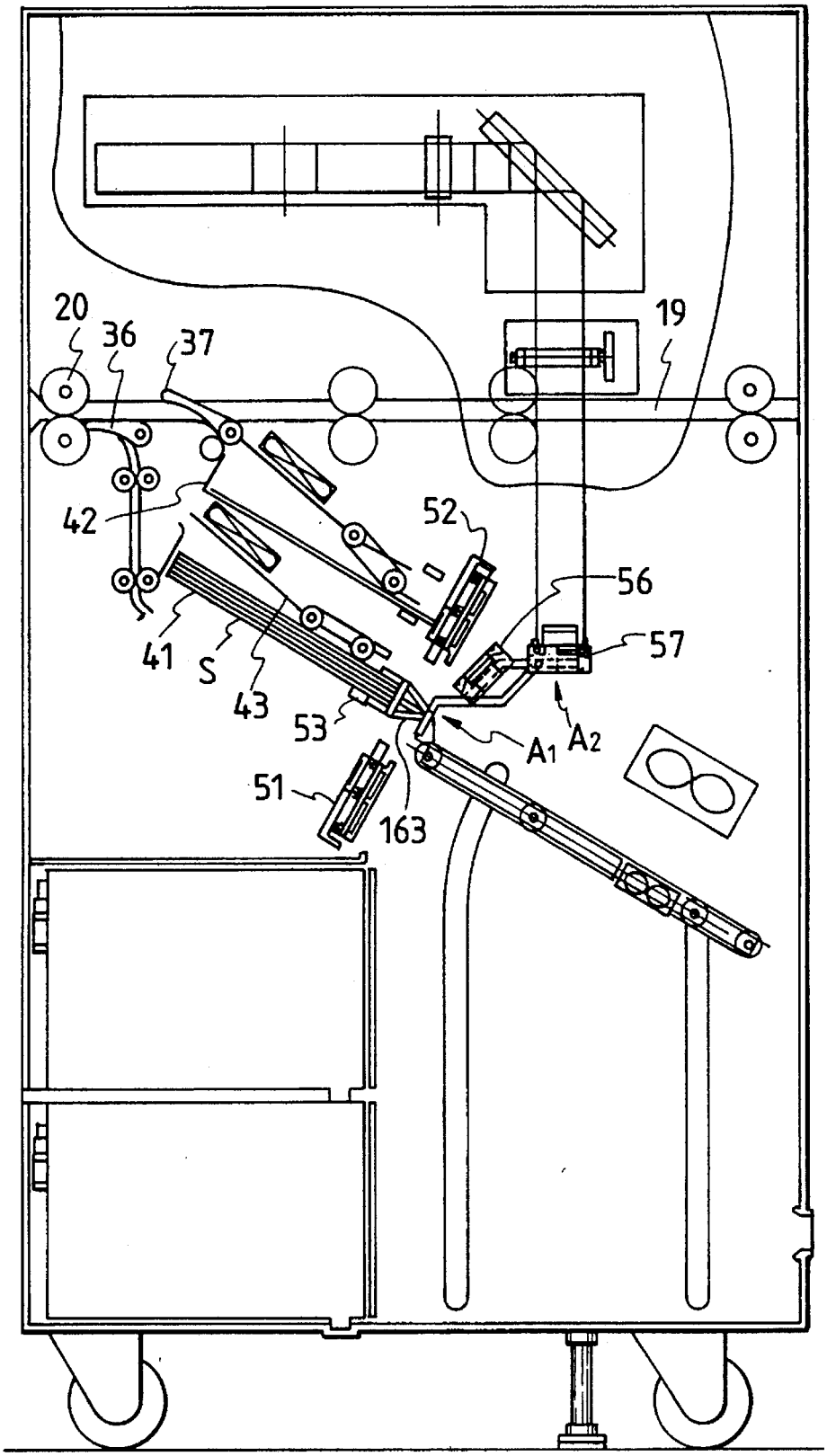
Figure 40:
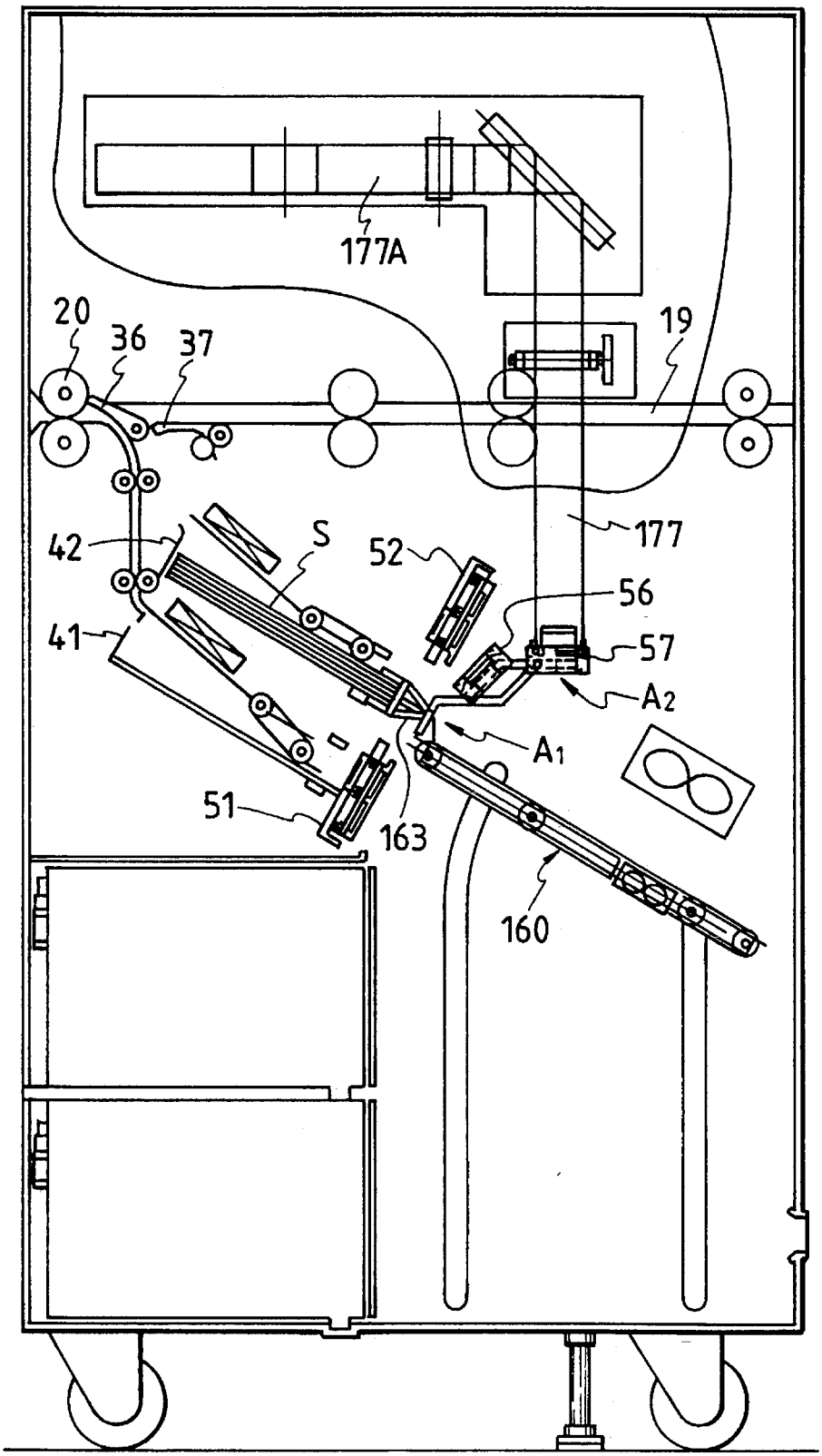

Next, the setting of the sheet bundle to the tape heating apparatus positioned at a back abutment position $A_2$ will be explained. FIGS. 37 and 38 show a system wherein the sheet align tray is stationary and the sheet bundle is set by the clamp member, and FIGS. 39 and 40 show a system wherein the sheet bundle is set by shifting the sheet align tray.

In FIG. 37, the sheet bundle sent in the first sheet align tray 41 is clamped by the clamping member 53 and is shifted to the back abutment position $A_2$ defined by central portions of the abutment members 51, 52. In this case, the upper guide plate 43, sweeping and collecting member 49 and fan 46 are retarded upwardly. In this case, the first flapper 36 associated with the first sheet align tray is closed to prevent the succeeding sheets S from entering into the first sheet align tray 41, and the second flapper 37 is opened toward the sheet convey path 19 to direct the succeeding sheets S to the second sheet align tray 42.

Incidentally, FIGS. 37 to 40 show a condition that, after the sheet bundle is bookbound by the first tape heating apparatus 56 positioned at the back abutment position $A_2$, the first tape heating apparatus 56 is retarded, and a condition that the bookbound sheet bundle is being handled by the handling member 163.

FIG. 38 shows a condition that the sheet bundle in the second sheet align tray 42 is set in the back abutment position $A_2$. The sheet bundle positioned by the clamping member 55 is set in the back abutment position $A_2$ by shifting the clamping member 55 to the center. In this case, the lower guide of the second sheet align tray 42 is also retracted downwardly.

FIG. 39 shows a condition that the sheet bundle in the first sheet align tray 41 is set in the back abutment position $A_2$. The first sheet align tray 41 containing the sheet bundle is translated to the center, thereby setting the sheet bundle in the back abutment position $A_2$.

FIG. 40 shows a condition that the sheet bundle in the second sheet align tray 42 is set in the back abutment position $A_2$. The second sheet align tray 42 containing the sheet bundle is translated to the central back abutment position $A_2$, thereby setting the sheet bundle in the back abutment position $A_2$.

Figure 41:
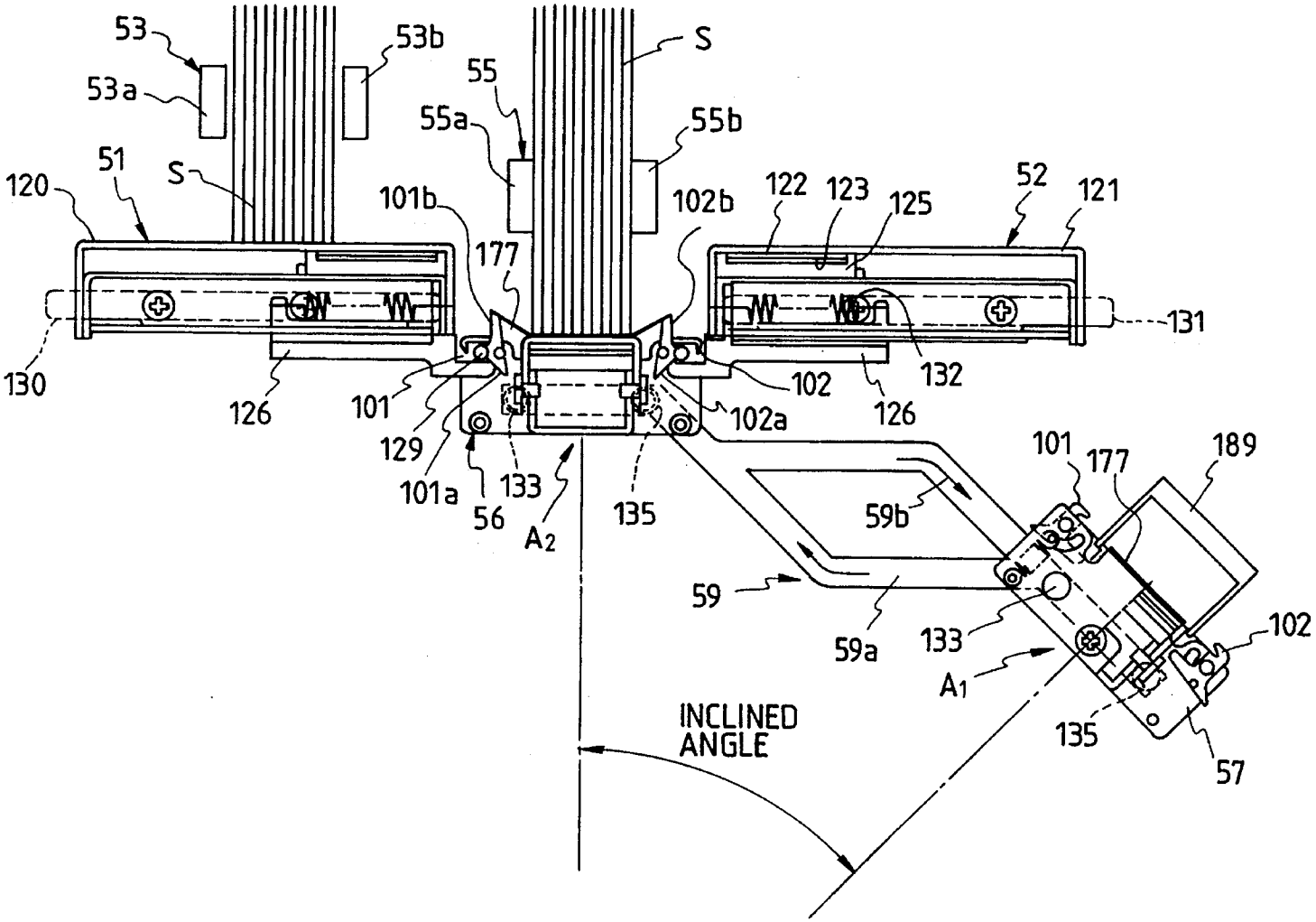
FIG. 41 is a front view showing abutment members, heating apparatuses and a bypass path.

In FIG. 41, two tape heating apparatuses as the second heating means are provided. One of them, i.e. the first tape heating apparatus 56 already received the bind tape 177 and is positioned at the back abutment position $A_2$. The second tape heating apparatus 57 receives the bind tape 177 at the tape supply position $A_1$ in the manner as mentioned above, and the bind tape is guided by the guide members 101, 102. The second tape heating apparatus 57 positioned at the tape supply position $A_1$ previously heats the received bind tape 177 and is waiting.

In the first tape heating apparatus 56 positioned at the back abutment position $A_2$, the pair of guide members 101, 102 are rotatably mounted on support shafts 129. The first and second abutment members 51, 52 are retractably supported by guide shafts 120, 121 and are provided with tape openers 126, 127 biased inwardly (centrally) by tension springs 132.

Between the tape supply position $A_1$ and the back abutment position $A_2$, there is arranged a bypass path 59 having a plurality of branched bypass passages 59*a*, 59*b*. The bypass path 59 comprises guide grooves along which guide rollers 133, 135 of the tape heating apparatus 56, 57 can be guided. When the tape heating apparatus 56 (or 57) is shifted from the tape supply position $A_1$ to the back abutment position $A_2$, the tape heating apparatus passes through the pass-by passage 59*a*, whereas, when the tape heating apparatus is shifted from the back abutment position $A_2$ to the tape supply position $A_1$, the tape heating apparatus passes through the bypass passage 59*b*. In this way, when the tape heating apparatuses 56, 57 are shifted, they are not struck against each other. Incidentally, the tape heating apparatuses 56, 57 have motors therein so that the tape heating apparatuses can be shifted in the guide grooves by rotating the guide rollers by the motors. The stop positions of the tape heating apparatuses can be detected by sensors, and the motors are controlled by the control means.

Now, in the condition that the first tape heating apparatus 56 is set at the back abutment position $A_2$, when the abutment members 51, 52 are shifted to approach each other, lower ends 101*a*, 102*a* of the guide members 101, 102 are urged by inner ends of the tension springs 132, thereby rotating the guide members. As a result, the guiding action of the guide members 101, 102 regarding the bind tape 177 is released. At the same time, upper ends 101*b*, 102*b* of the guide members 101, 102 are lifted to cock both ends of the bind tape 177 as shown in FIG. 41.

The second abutment member 52 has a case 121 formed from a radiator plate within which a ceramic heater 122, silicone rubber 123 and an insulation member 125 are arranged to heat the second abutment member 52. Similarly, the first abutment member 51 also has a ceramic heater.122 and the like. The sheet bundle on the second abutment member 52 is previously heated by the ceramic heater 122. This sheet bundle is shifted above the back abutment position $A_2$ by the clamping member 55 pinching the sheet bundle and then is shifted toward the first tape heating apparatus 56 to be abutted against the bind tape 177.

Figure 42:
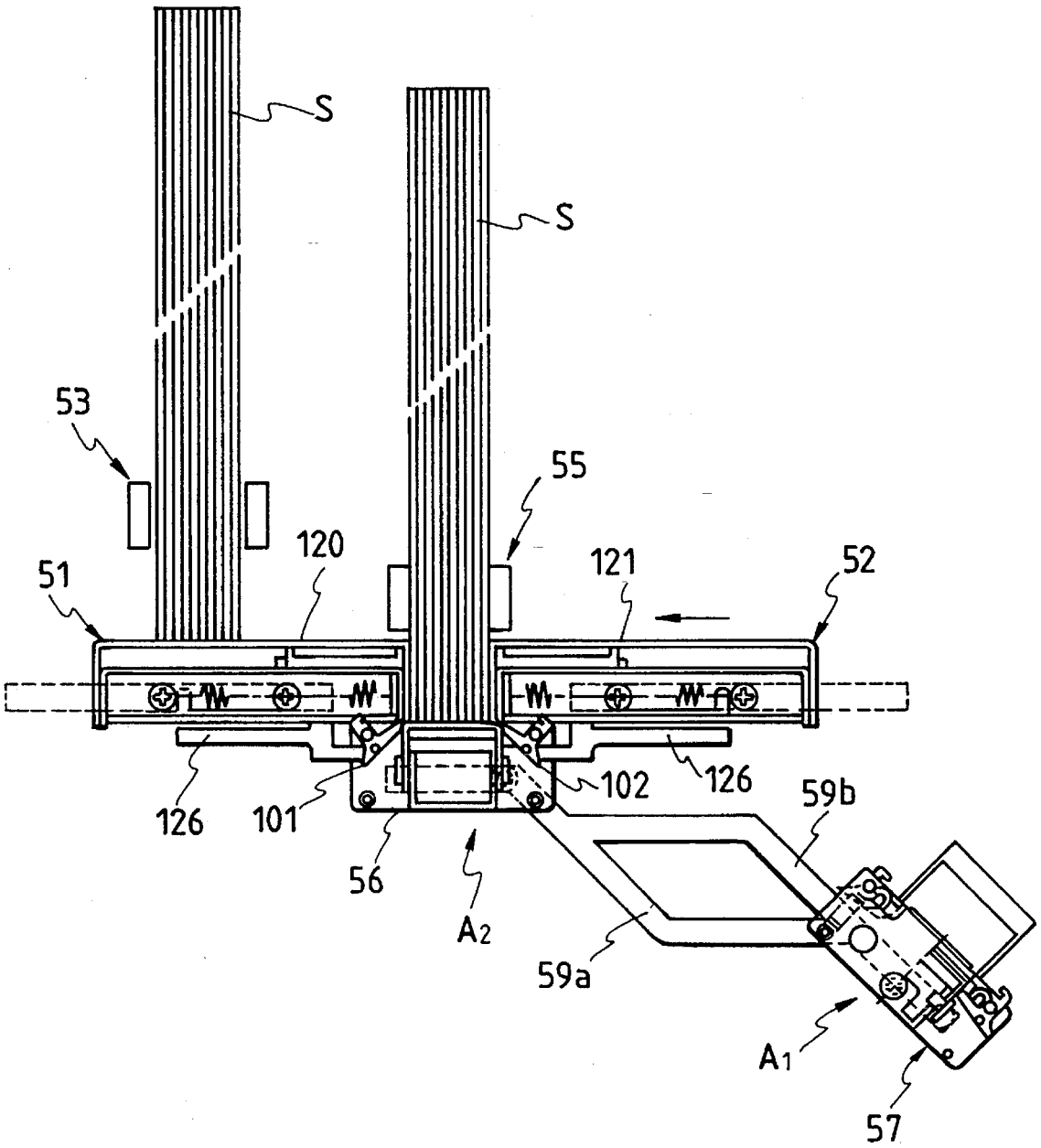
FIG. 42 is a view for explaining the operation of the system of FIG. 41.

In this condition, when the abutment members 51, 52 are approached to each other, as shown in FIG. 41, both ends of the bind tape 177 are cocked. And, by further shifting movements of the abutment members 51, 52, as shown in FIG. 42, both ends of the bind tape 177 are urged against the sheet bundle by the inner surfaces of the cases 121, thereby adhering the bind tape 177 to the sheet bundle.

After the bind tape 177 is adhered to the sheet bundle, the first tape heating apparatus 56 positioned in the back abutment position $A_2$ is shifted toward the tape supply position $A_1$ through the bypass passage 59*b* of the pass-by path 69. Then, the tape heating apparatus 56 receives the bind tape 177 at that tape supply position. On the other hand, the second tape heating apparatus 57 which was preheated and to which the bind tape 177 was supplied at the tape supply position $A_1$ during the bookbinding of the sheet bundle is shifted toward the back abutment position $A_2$ through the bypass passage 59*a* of the bypass path 69. Then, the sheet bundle preheated at the first abutment member 51 is handled by the second tape heating apparatus in the same manner as mentioned above, thereby bookbinding the sheet bundle.

In this way, by aligning the tip ends of the sheets and previously heating the sheet bundles by using two abutment members, the inconvenience caused when the sheet bundle is heated from the room temperature can be eliminated and the bookbinding time can be reduced. Further, while the bookbinding operation is effected at the back abutment position $A_2$, since the bind tape 177 is supplied and is heated at the tape supply position $A_1$, the time for supplying the bind tape can be reduced and the pre-heat is not required at the back abutment position $A_2$, thereby reducing the bookbinding time.

Figure 43:
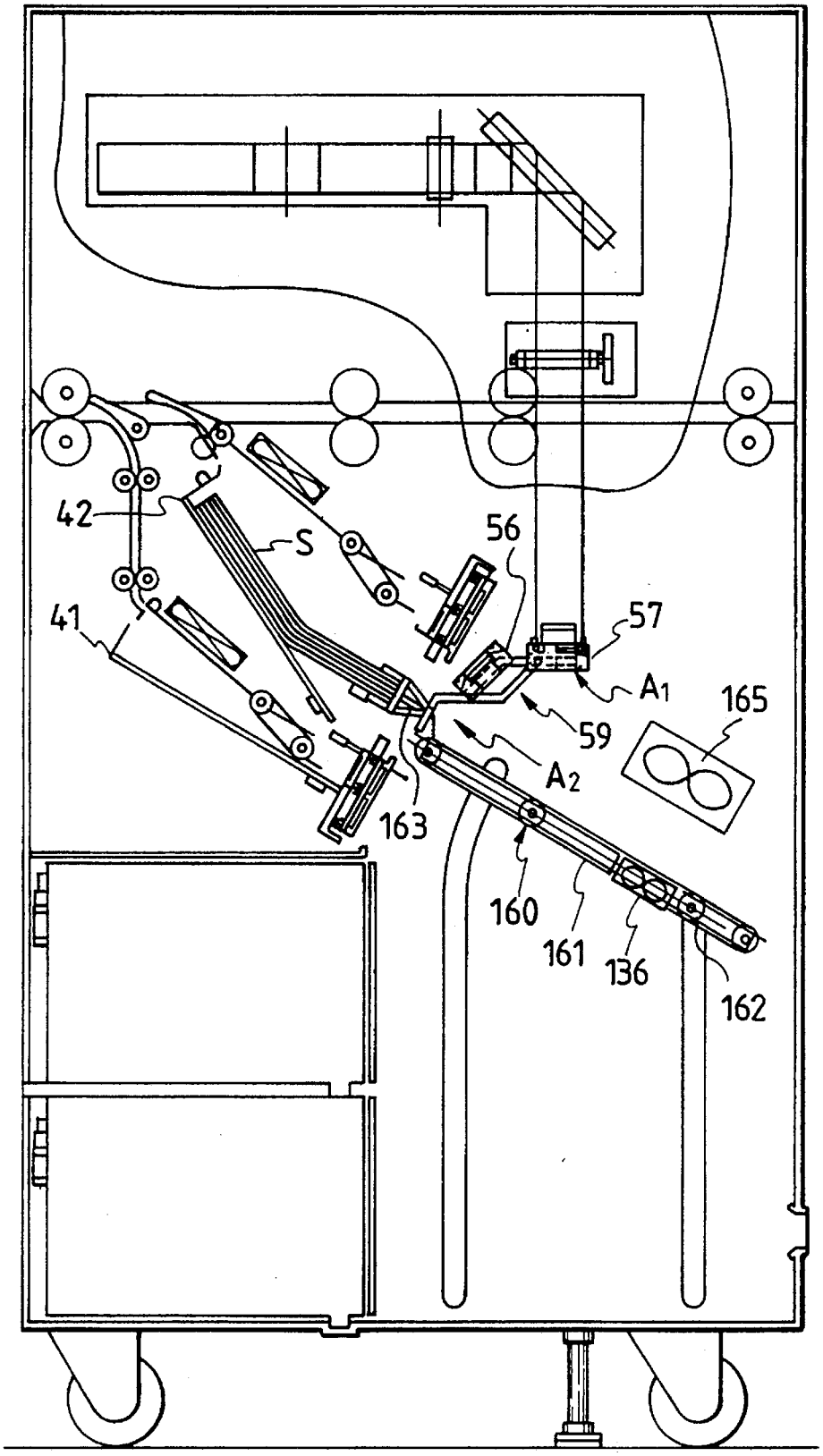
FIG. 43 is a side view of a carriage portion.

In FIG. 43, the carriage 160 a free end of positioned at the tape supply position $A_1$ has the convey belt 161, the handling member 163 movable together with the convey belt, and the fan 136 for cooling the bookbound sheet bundle. The carriage 160 is rockable around the roller shaft of the roller 162 between an inclined position as shown and a horizontal position.

Figure 44:
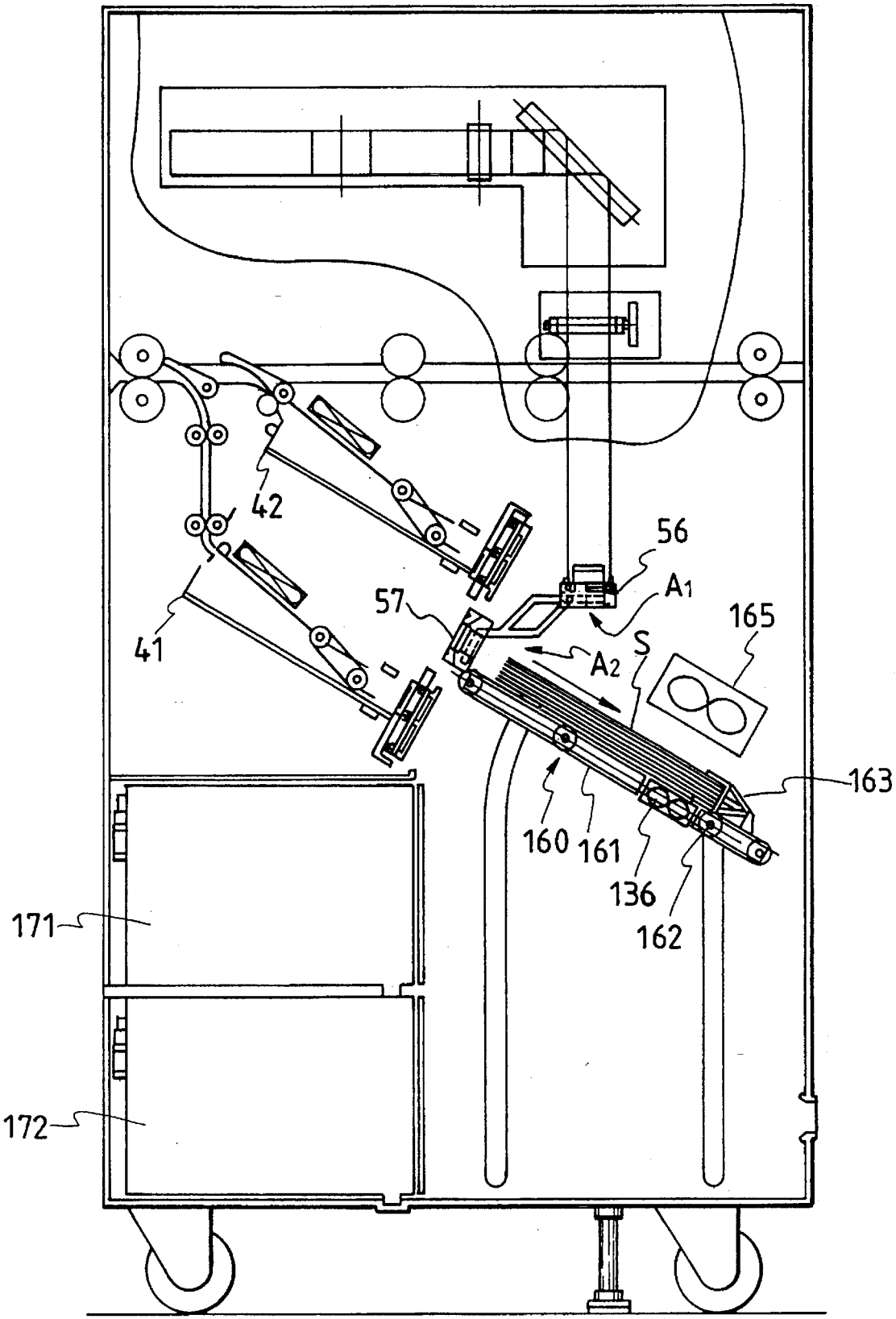
FIGS. 44 to 47 are side views for explaining the operation of the carriage portion.
Figure 45:
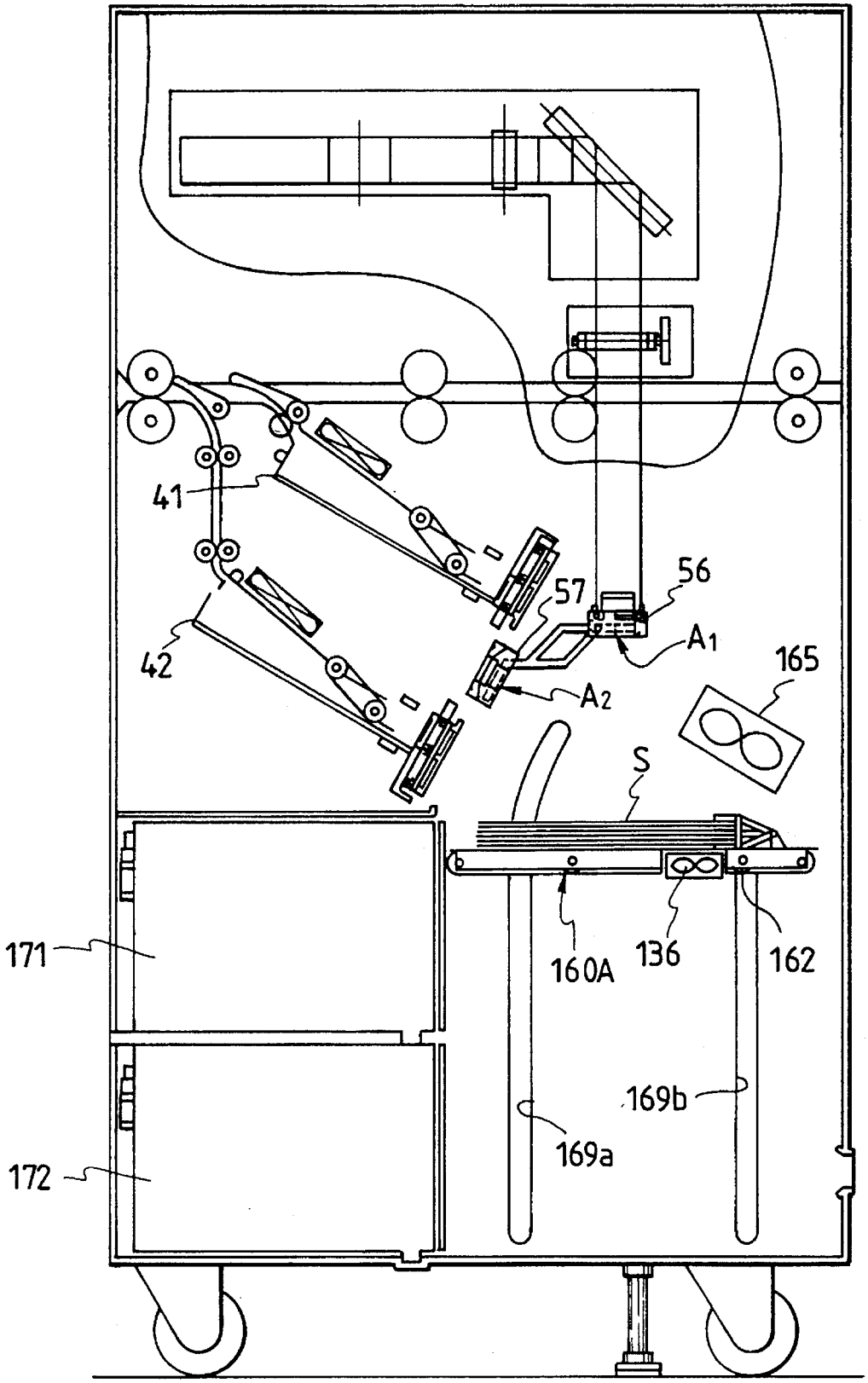
Figure 46:
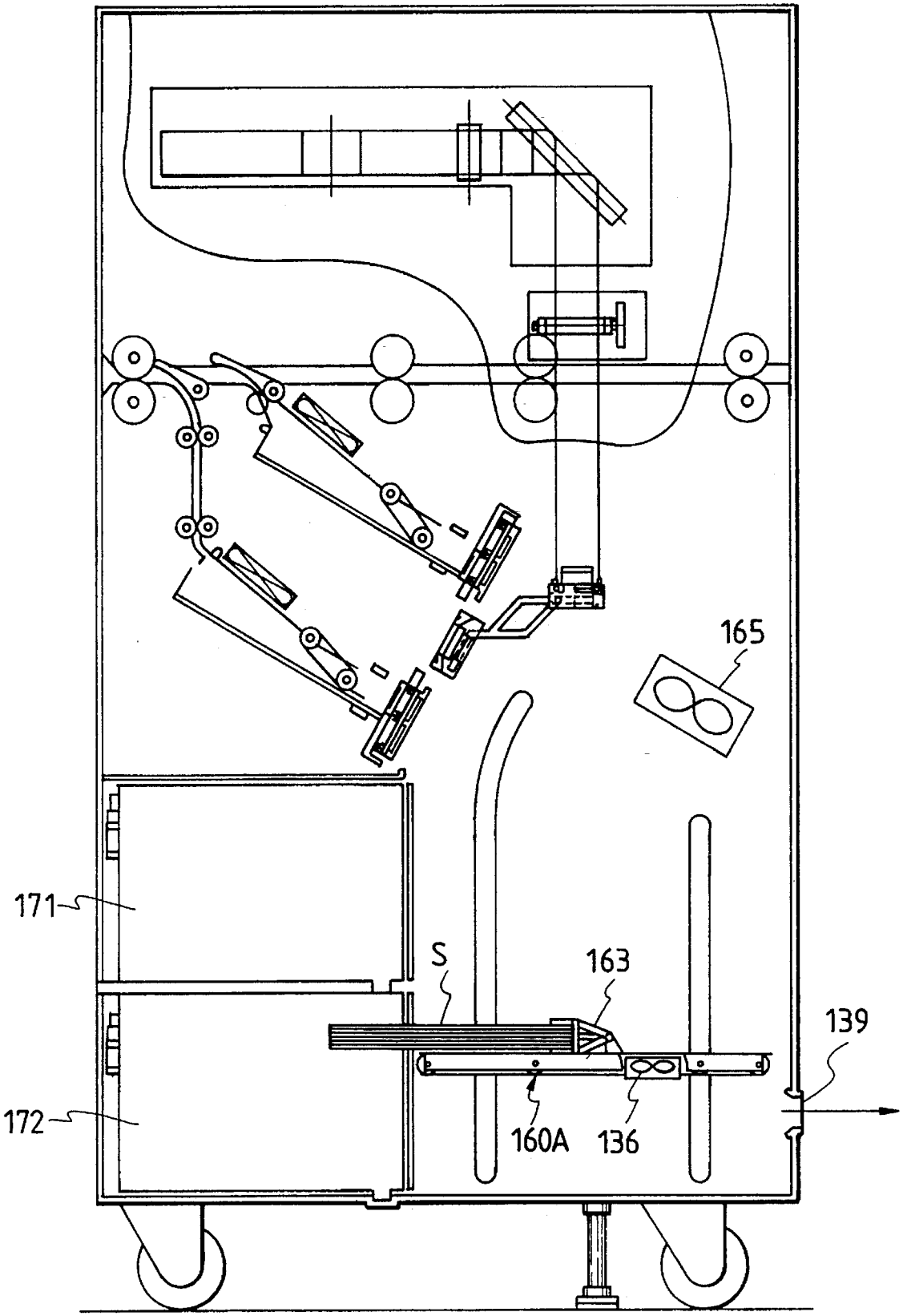

The sheet bundle bookbound at the back abutment position $A_2$ is handled by the handling member 163 and is conveyed by the convey belt 161 to be shifted on the carriage 160 (FIG. 44). As shown in FIG. 46, the carriage 160 is lowered to a predetermined position and is stopped there. Then, the bookbound sheet bundle is contained into the stacker 172 by the convey belt 161. Each of the stackers 171, 172 is provided with a sensor (not shown) for detecting the presence/absence of the bookbound sheet bundle and a sensor (not shown) for detecting a height of the bookbound sheet bundles (i.e. detecting the stacking amount). The carriage 160 is stopped at the position corresponding to the stacking amount.

Figure 47:
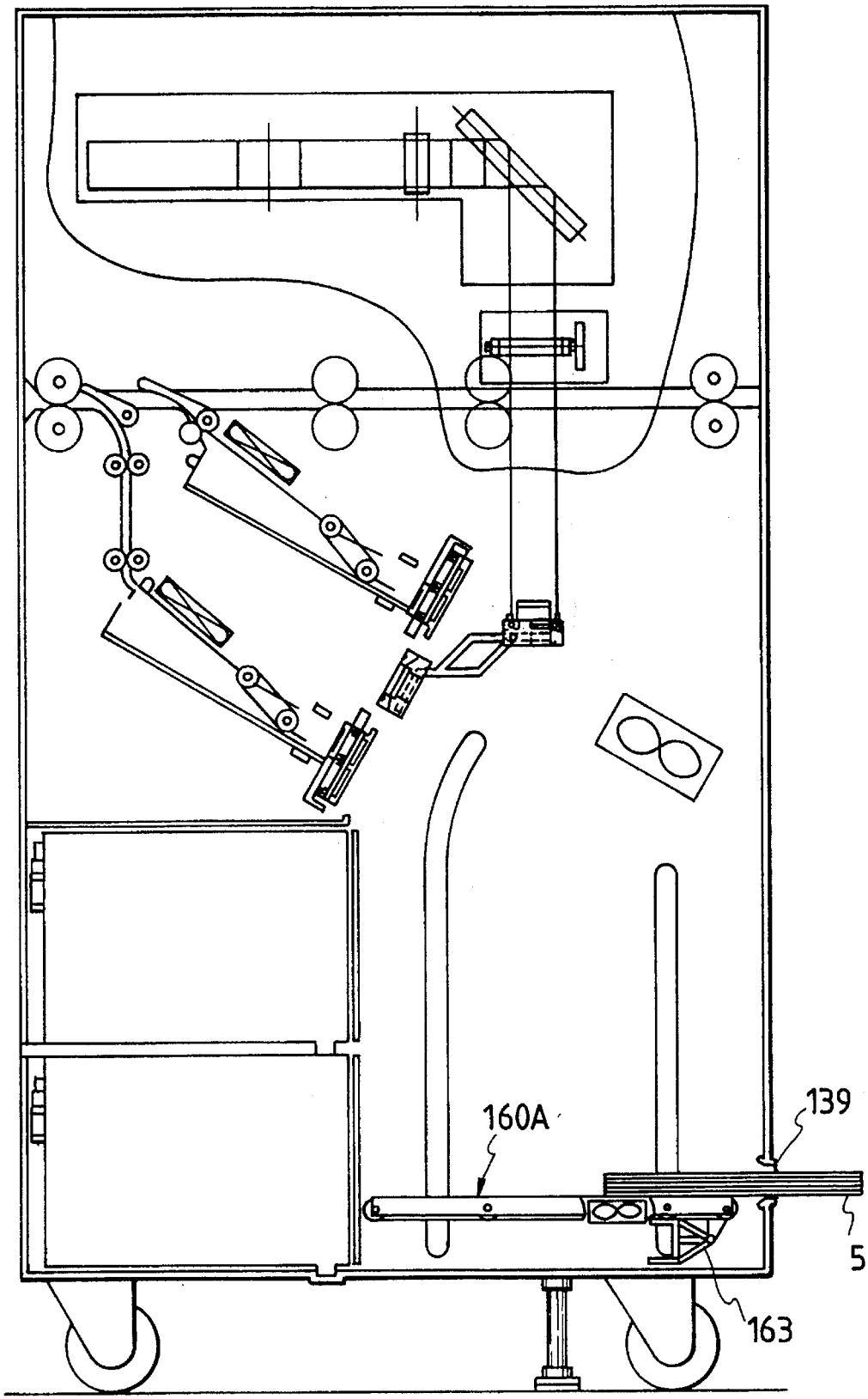
Figure 48:
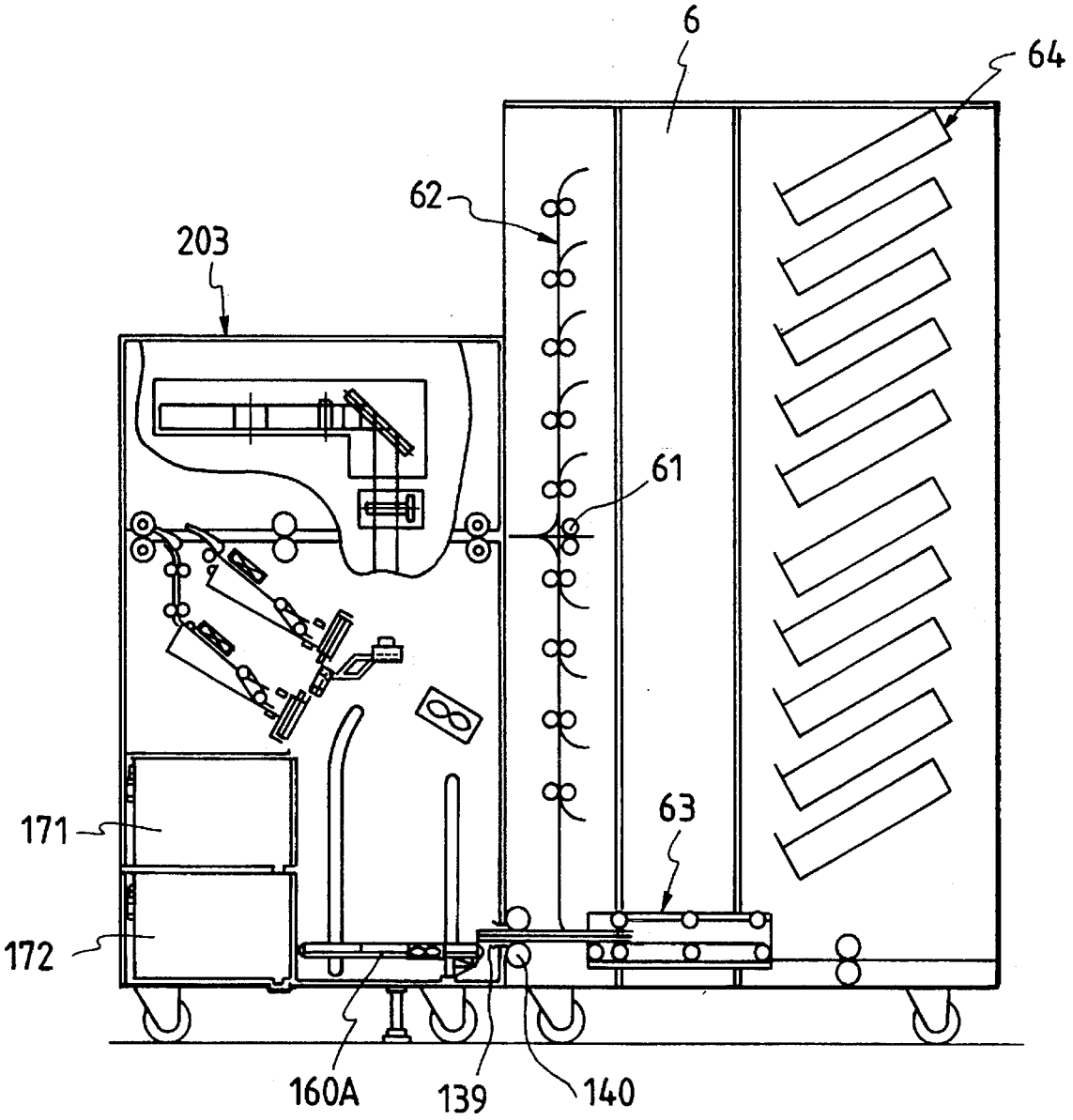
FIG. 48 is a sectional side view of the bookbinding apparatus and the sheet sorting and containing apparatus.

On the other hand, when the bookbound sheet bundle on the carriage 160 is not contained in the stacker 171 or 172, as shown in FIG. 47, the bookbound sheet bundle is discharged out of the apparatus through the discharge opening 139. In FIG. 48, the bookbound sheet bundle discharged from the bookbinding apparatus 203 is sent to the elevator 63 positioned at the lower portion of the sheet sorting and containing apparatus 216. Then, by lifting or lowering the elevator 63, the bookbound sheet bundle is contained into a desired discharge tray 64. Incidentally, when it is not required to discharge the sheet bundle onto the discharge tray 64, the bookbound sheet bundle is discharged out of the sheet sorting and containing apparatus 216 through the elevator 63 positioned at the lowermost position.

Figure 49:
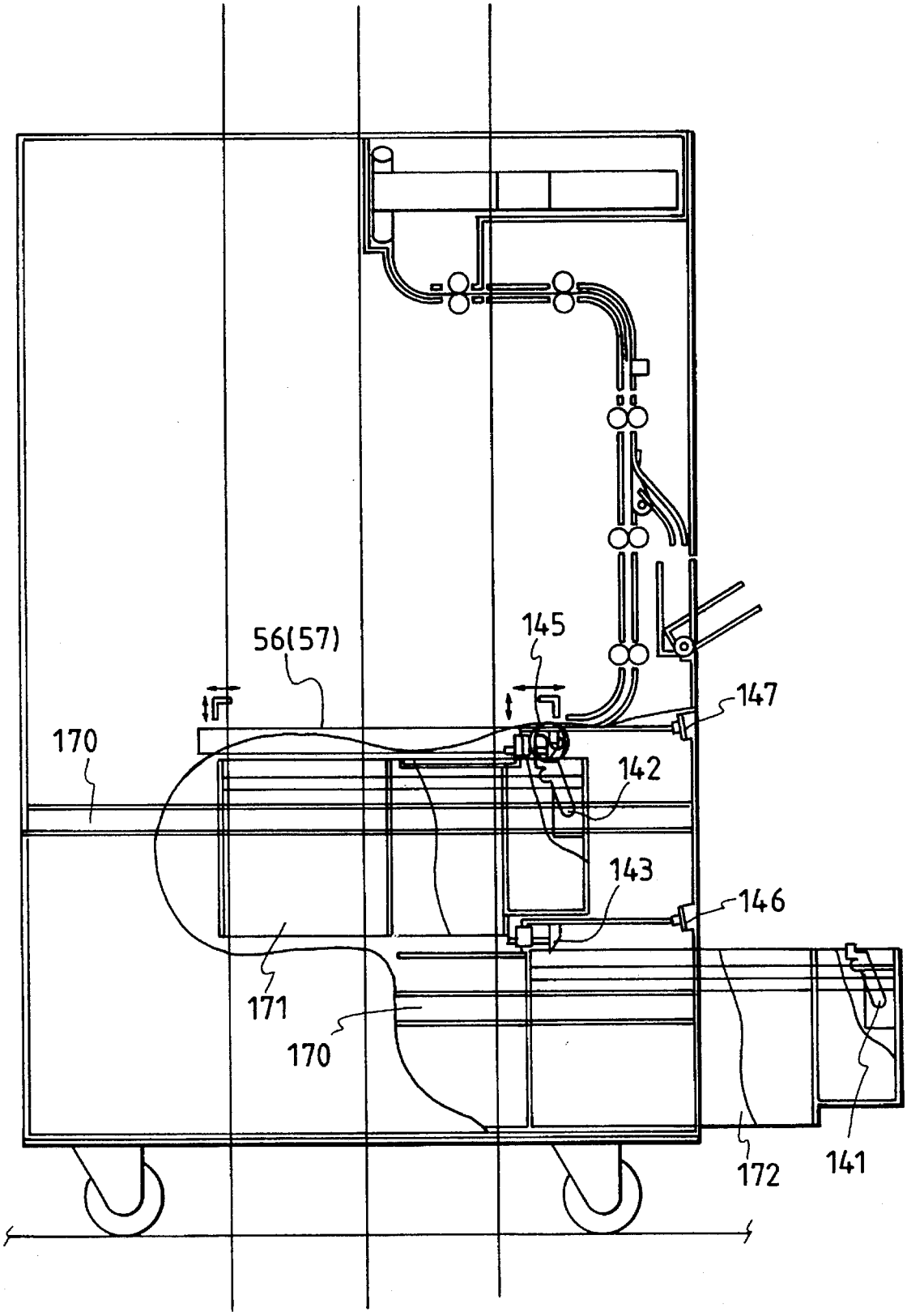
FIG. 49 is a sectional side view of a stacker portion.

FIG. 49 is a side view of the stackers 171, 172. The stacker 172 has a gripper 141 which can be engaged by a lock device 143 of the apparatus. The reference numeral 146 denotes an indicator. Similarly, a gripper 142, a lock device 145 and an indicator 147 are associated with the stacker 171. The reference numeral 170 denotes rails. Since two stackers are provided so that, while the bookbound sheet bundle is being conveyed to one of the stacker, the other stacker can be retracted or drawn out, the check of the sample or the removal of the fully stacked sheet bundles can be effected without stopping the bookbinding operation.

Next, a third embodiment of the present invention will be explained. In this third embodiment, the bookbinding apparatus in the second embodiment is replaced by another bookbinding apparatus.

Figure 50:
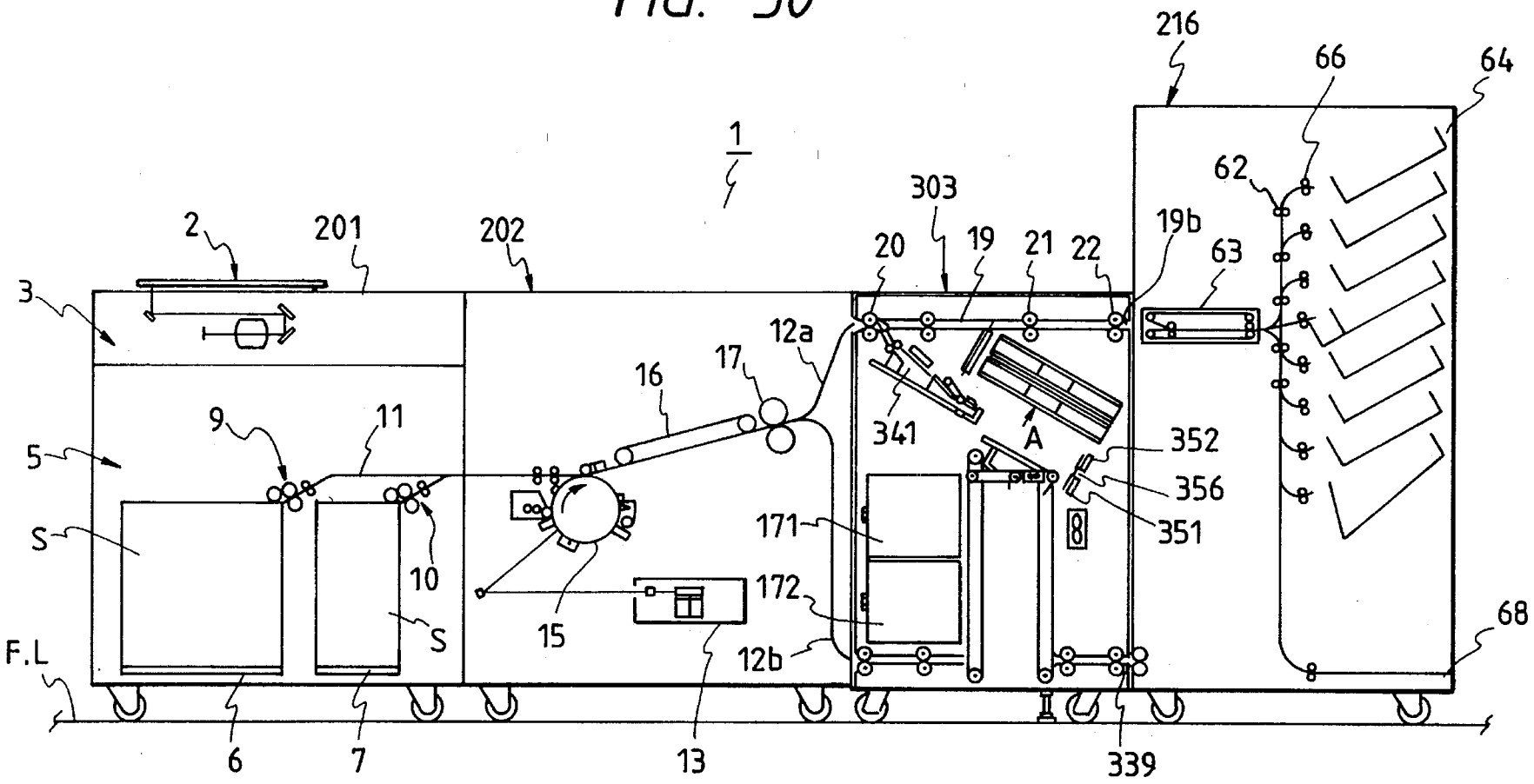
FIG. 50 is a front sectional view of the entire system according to a third embodiment of the present invention.

A bookbinding apparatus 303 (FIG. 50) includes a sheet align tray 341 which receives the sheets S conveyed through a path 12*a* and a sheet convey path 19 and aligns the sheets with each other, a first abutment member 359 against which the sheets are abutted, a tape heating apparatus 356 for heating the aligned sheet bundle and a bind tape, a carriage 360 which can be lifted or lowered and which is adapted to convey the bookbound sheet bundle, and stackers 171, 172 in which the bookbound sheet bundle is contained.

Incidentally, when the bookbinding apparatus is not connected to the sheet sorting and containing apparatus, a stacking tray (not shown) on which the discharged sheets are stacked and a stacking tray (not shown) on which the discharged sheet bundles are stacked are connected to a first discharge opening 19*b* and a second discharge opening 339 of the bookbinding apparatus 303, respectively.

Next, the bookbinding apparatus 303 will be fully explained with reference to FIG. 51.

Figure 51:
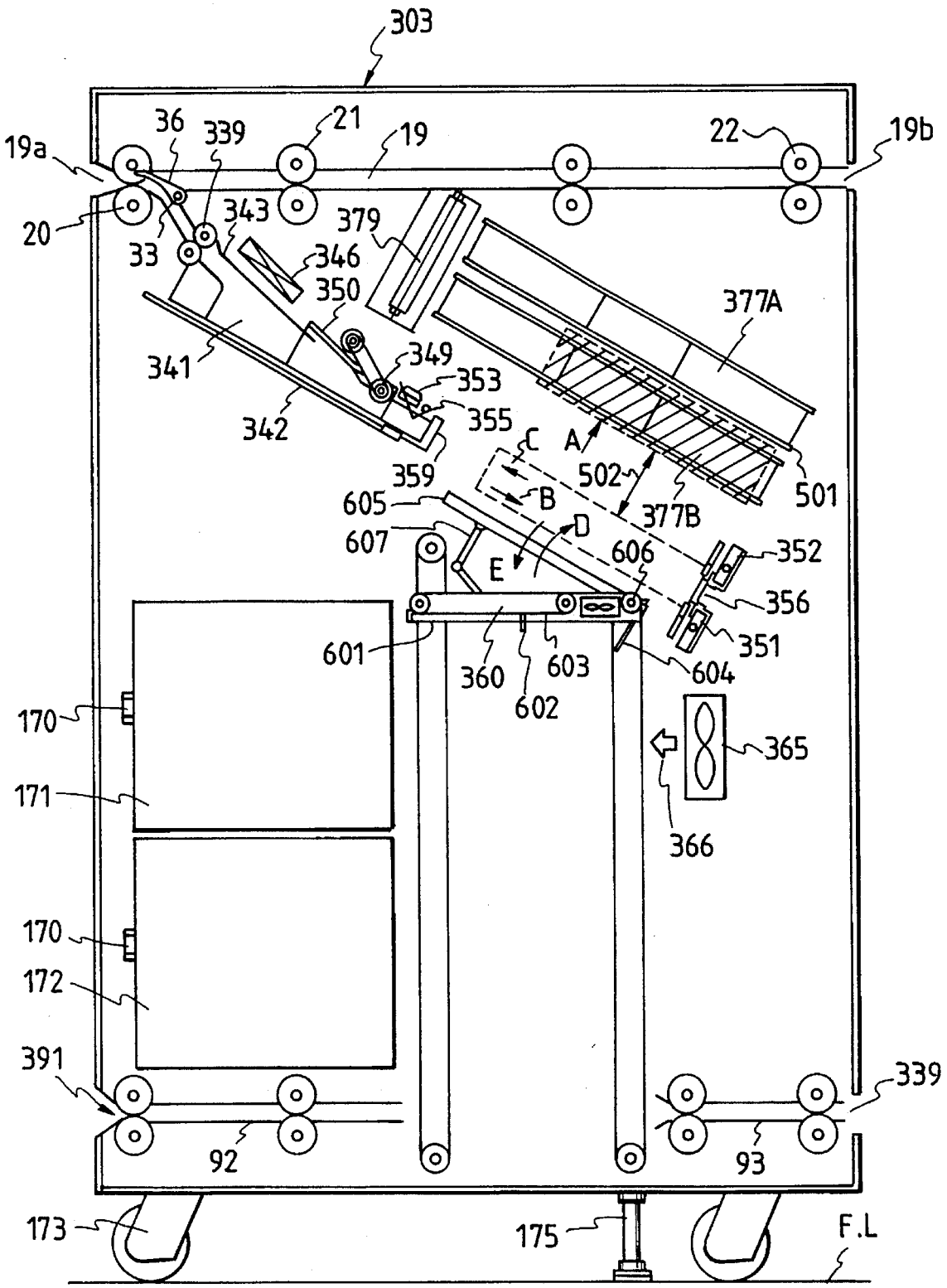
FIG. 51 is a front sectional view of a book-binding apparatus.

In FIG. 51, the bookbinding apparatus 303 includes a sheet convey path 19 for the sheet sent from the image forming apparatus 202, and the sheet convey path 19 has a first inlet end 19*a* and a first discharge end 19*b*. A pair of introduction rollers 20, a plurality of pair of convey rollers 21 and a pair of discharge rollers 22 are arranged along the sheet convey path 19 from an upstream side to a downstream side thereof. In the proximity of the downstream side of the pair of introduction rollers 20, there is arranged a flappers (branching means) 36 capable of guiding the sheet from the sheet convey path 19 to a guide portion 33. The branching means 36 is operated to direct the sheet S to either of the guide portions 33. When the branching means 36 is not operated, the sheet S is conveyed through the sheet convey path 19.

A sheet align tray 341 having an upper guide plate 343 is disposed at a downstream side of the guide portion 33, and a first abutment member 359 against which the sheet S is abutted is formed on a tip end of the sheet align tray. The sheets S sent to the align tray 341 by a pair of convey rollers 339 are shifted toward the first abutment member 359 by a sweeping and collecting member (sweeping and collecting means) 349 comprising a rotatable belt which can be rocked around its one end (upper left end in FIG. 51) so that the sheets are abutted against the first abutment member to be aligned with each other.

On the other hand, alignment of the sheets in a widthwise direction is effected by a side regulating means 350. A fan (air sending means) 346 arranged above the upper guide plate 343 serves to urge the sheets S against the sheet align tray 341 by air to prevent the folded sheets from swelling. Incidentally, the reference numeral 353 denotes a clamping member for clamping the sheet bundle having a predetermined number of sheets.

An auxiliary guide plate 355 acts as a stop finger (which is operated when the sheet bundle for one book is contained and reserves several sheets for a next sheet bundle).

A carriage 360 for conveying the bookbound sheet bundle $S_1$ is constructed as follows. That is to say, the carriage 360 includes a housing 601 supported by a chain and the like for movement in a vertical direction, a convey belt 603 rotatable reversibly with respect to the housing 601, a rear pushing member 602 movable together with the convey belt 603, a sheet bundle rear end supporting plate 604 which adapted to support the sheet bundle by abutting the trailing end of the sheet bundle conveyed by the auxiliary guide plate 342 against this supporting plate and which can be rotated around a support shaft 606 to be retarded from the trailing end of the sheet bundle, and a sheet bundle supporting rod 605 supported by a link 607 for movement between a position for receiving the bookbound sheet bundle and a horizontal position. The sheet bundle supporting rod 605 has a plurality of combs and can be rocked around the support shaft 606.

After the sheet bundle is separated from the tape heating apparatus 56 by the clamping member 353, the sheet bundle rear end supporting plate 604 is shifted to a position for supporting the trailing end of the sheet bundle. Then, the clamping member 353 is separated from the sheet bundle, with the result that the end of the sheet bundle is abutted against the supporting plate, thereby supporting the sheet bundle. The rear pushing member 602 is rotated together with the convey belt 603 of the carriage 360 to push the end of the sheet bundle rested on the convey belt 603.

A bind tape 377 fed out from a tape reel 377A ($R_1$ in FIG. 52) or a tape reel 377B ($R_2$ in FIG. 52) is cut to a predetermined length by a cutter 379.

In FIG. 51, a fan 165 serves to cool the bookbound sheet bundle by flowing air in a direction shown by the arrows 366. The sheet bundle is sent from the carriage 360 into a stacker 171 or 172. The stackers 171, 172 are retractably supported by rails 170. Incidentally, the reference numeral 173 denotes casters for shiftably supporting the book-binding apparatus; and 175 denotes a leveller for adjusting the height of the bookbinding apparatus.

Next, an operation for supplying the bind tape 377 from the tape reel $R_1$ will be explained with reference to FIGS. 52 to 56.

Figure 52:
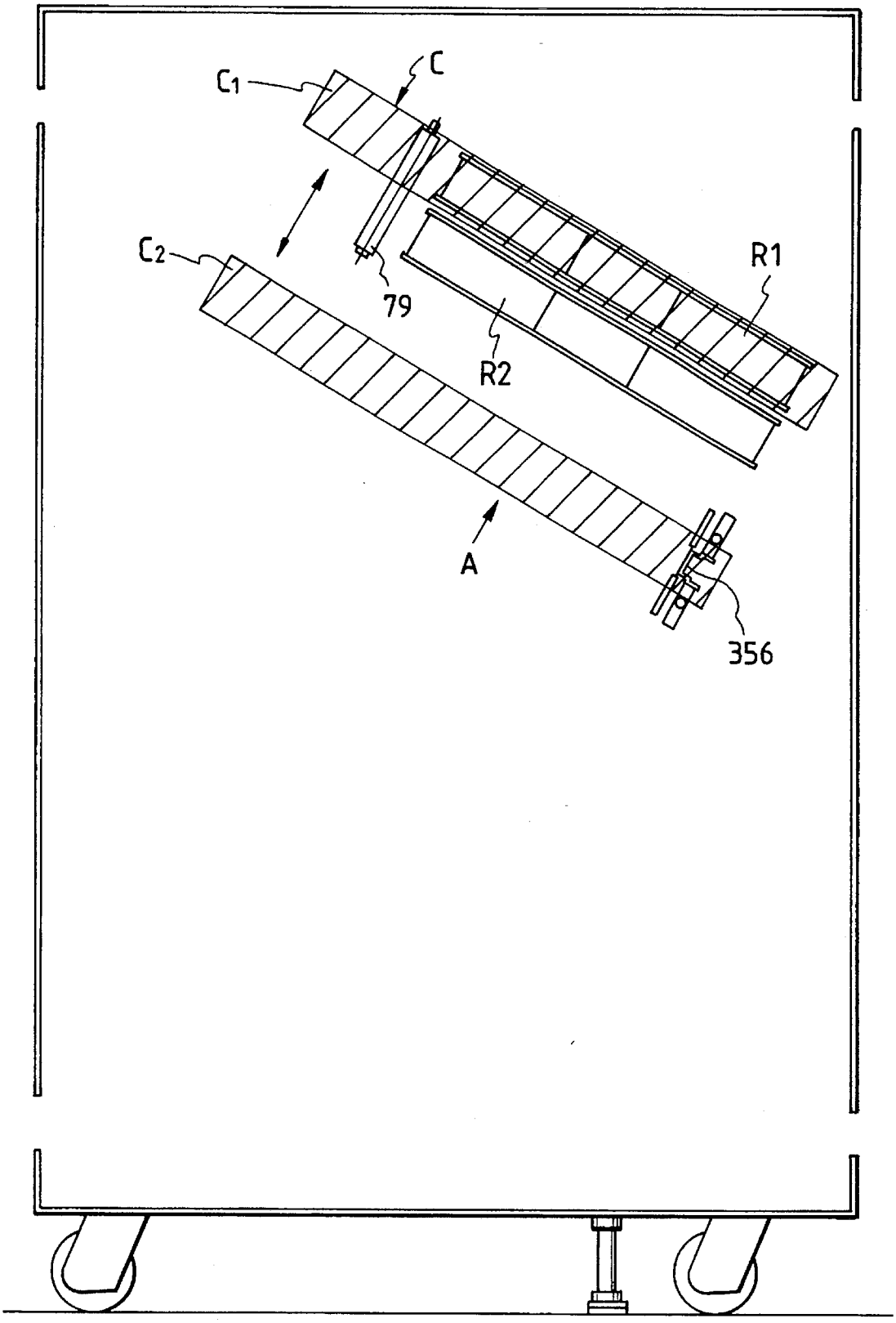
FIGS. 52 to 56 are front views of a tape supply portion.
Figure 53:
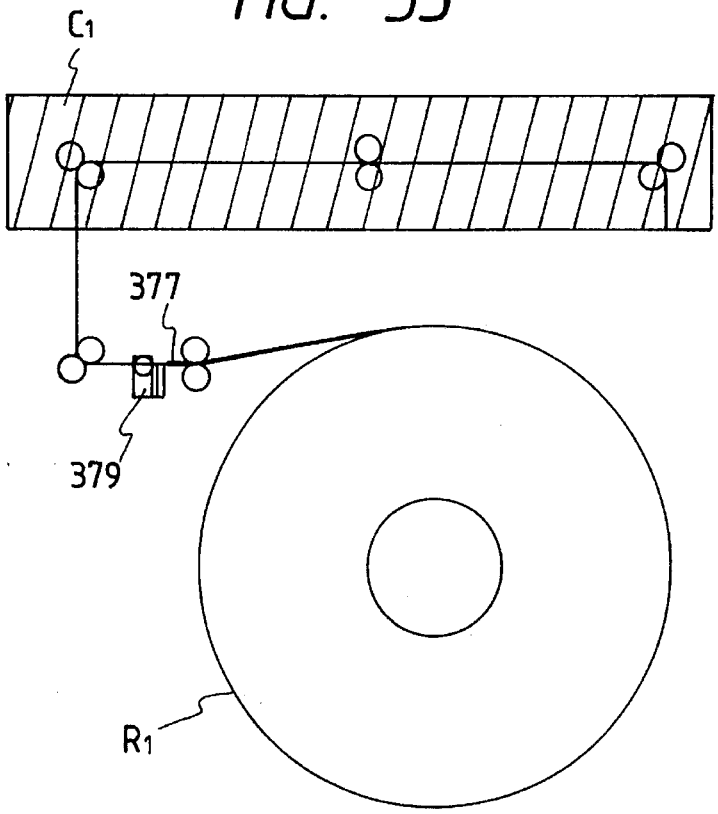
Figure 54:
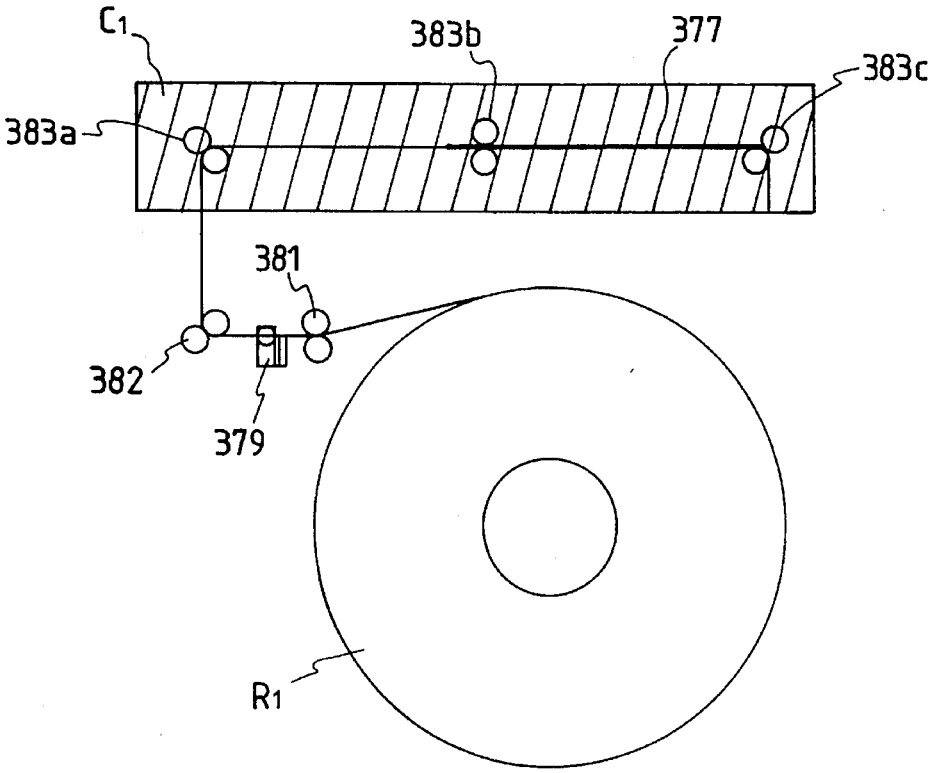
Figure 55:
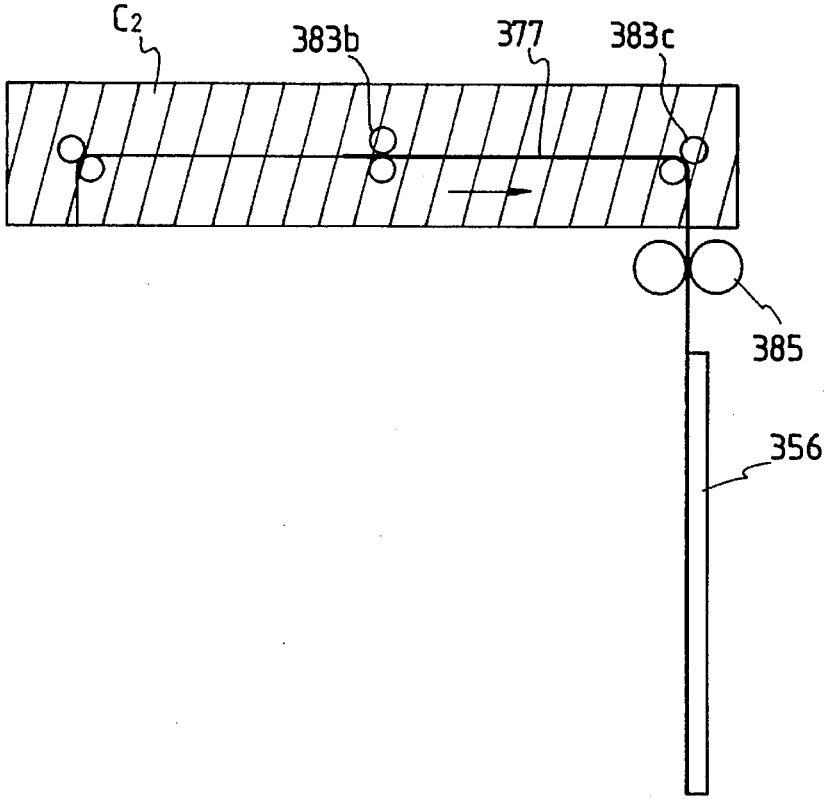

A carriage C for conveying the bind tape 377 can be shifted between a tape supply position 501 shown in FIG. 52 and a back abutment position H where the bookbinding operation is effected in directions shown by the arrow 502 (FIG. 51). As shown in FIG. 53, a tip end of the bind tape 377 fed out by a pair of convey rollers 381 is positioned on the cutter 379. The bind tape 377 cut to the predetermined length by the cutter 379 is supplied to the carriage C positioned at a position $C_1$ by means of a pair of convey rollers 382 and is held and conveyed by a plurality of pairs of rollers 383*a*, 383*b*, 383*c* (FIG. 54) arranged within the carriage.

Figure 56:
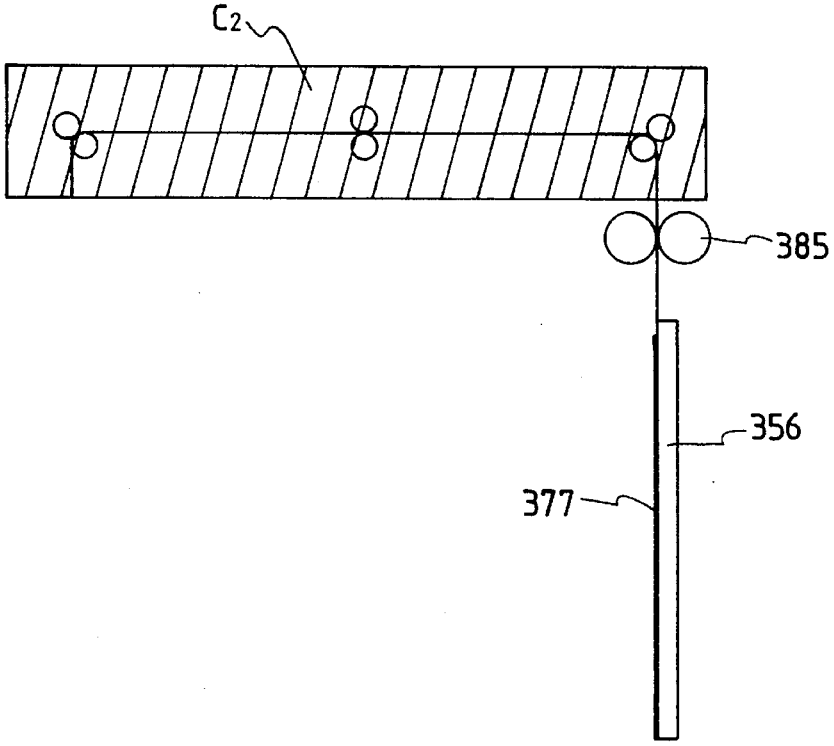

The carriage C to which the bind tape 377 was supplied is shifted from the position $C_1$ to a position $C_2$ (FIGS. 52 and 55), where the bind tape is fed out by rotations of the rollers 383. Then, the bind tape is shifted to the tape heating apparatus 356 positioned at the back abutment position H by means of a pair of convey rollers 385. FIG. 56 shows a condition that the bind tape 377 fed out from the carriage C is set on the tape heating apparatus 356.

FIGS. 57 to 60 show a condition that the sheets are conveyed to the sheet align tray 341 and a condition that the aligned sheet bundle is conveyed to the back abutment position H.

Figure 57:
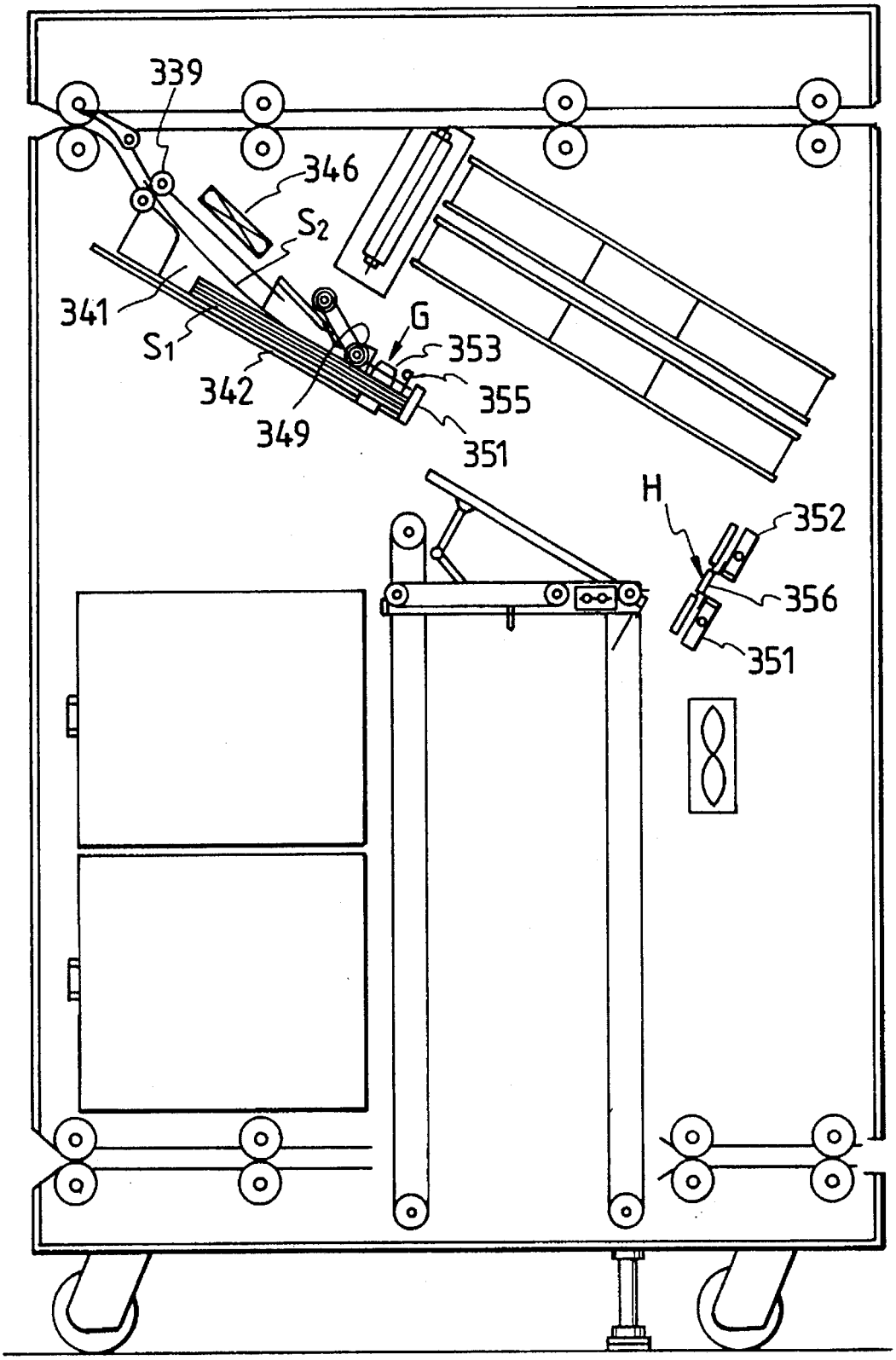
FIG. 57 is a side view showing a sheet bundle in an align tray and a tape heating apparatus for binding the sheet bundle.

In FIG. 57, when the sheets for one book are conveyed to the sheet align tray 341 and are aligned with each other, the clamping member 353 is operated in a direction shown by the arrow G to clamp the sheet bundle. When a plurality of sheet bundles are bookbound, the stop finger 355 is operated simultaneously with the clamping member to temporarily store several sheets of a next sheet bundle ($S_2$) until the sheet bundle $S_1$ clamped by the clamping member 353 is discharged out of the sheet align tray 341.

Figure 58:
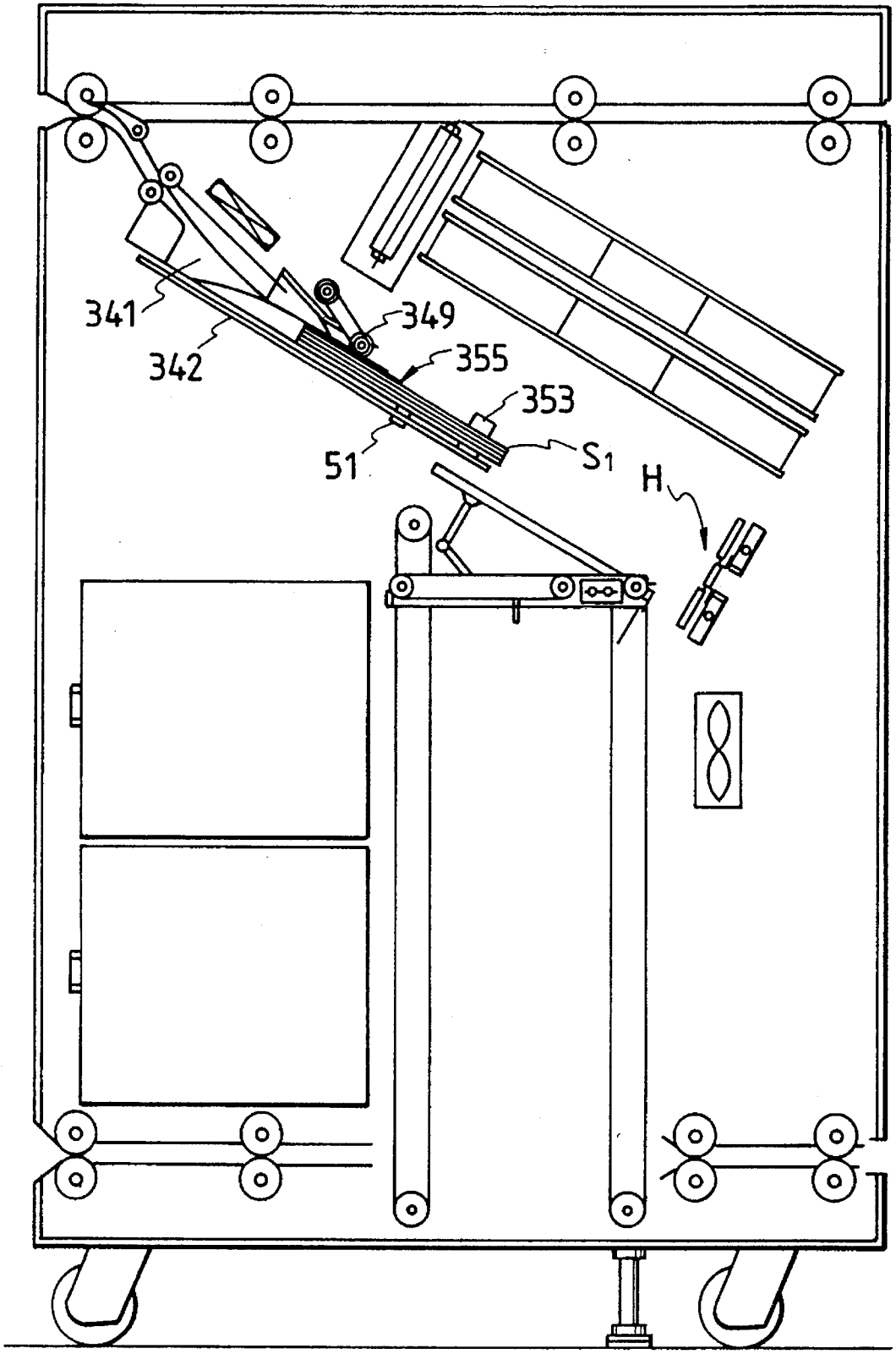
FIGS. 58 and 59 are views for explaining the operation of the system of FIG. 57.

In FIG. 58, the abutment member 359 is retarded and the clamping member 353 aids to shift the sheet bundle $S_1$ from the sheet align tray 341 to the back abutment position H. The clamping member 353 clamping the sheet bundle $S_1$ is moved straightly toward the back abutment position H. In this case, substantially in synchronous with the movement of the clamping member 353, an auxiliary guide plate 342 is shifted from a lower portion of the sheet align tray 341 toward the back abutment position H at the same speed as the clamping member to guide the lower surface of the sheet bundle $S_1$.

Figure 59:
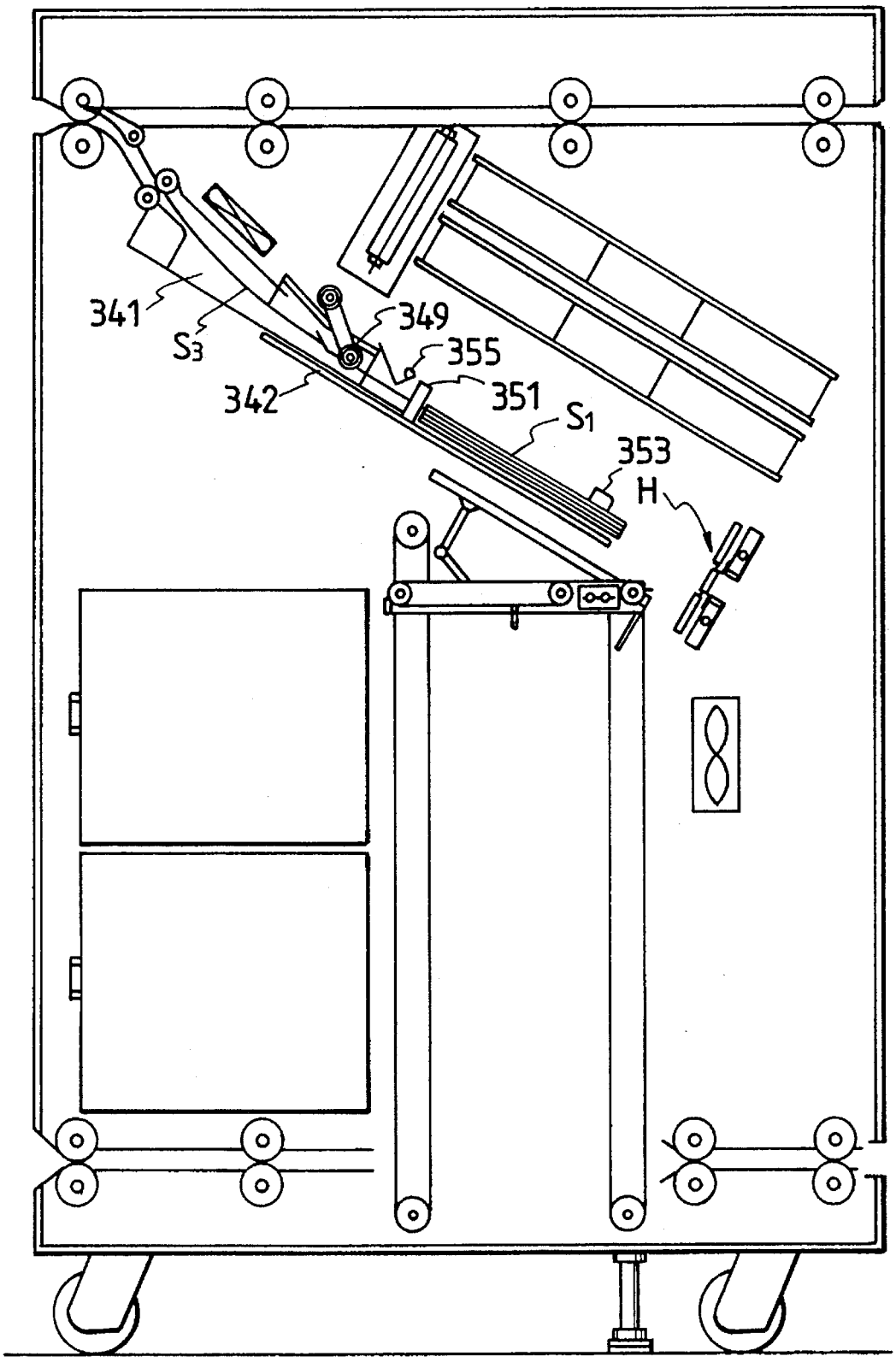

FIG. 59 shows a condition that the sheet bundle $S_1$ is fed out from the sheet align tray 341 by the clamping member 353. When the sheet bundle $S_1$ is fed out from the sheet align tray 341 by the clamping member 353, the abutment member 351 is returned to the abutment position and the stop finger 355 is retarded from the storing position to supply the several stored sheets onto the sheet align tray 341. Then, the succeeding sheets $S_3$ are also supplied to the sheet align tray, and these sheets are aligned with each other.

Figure 60:
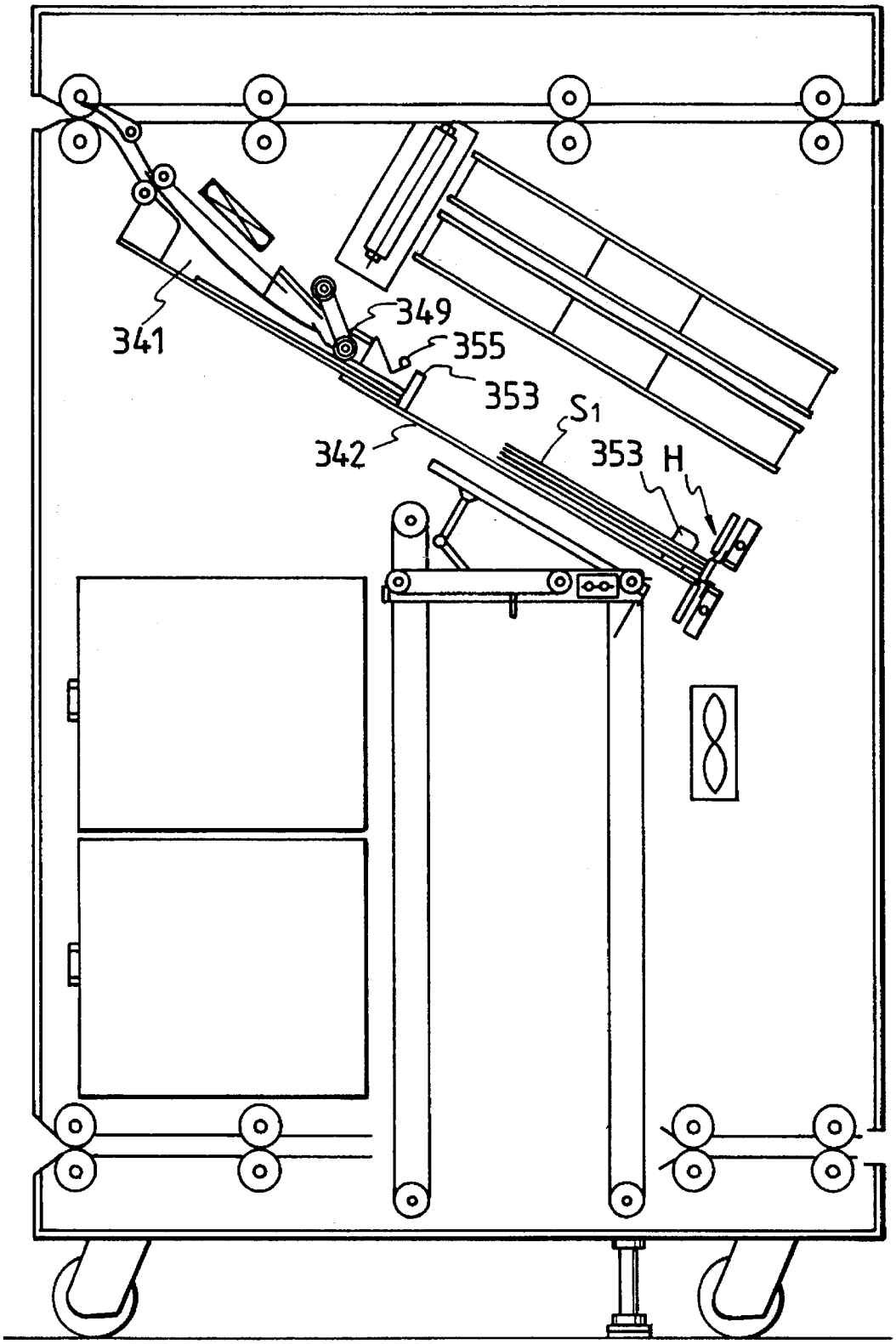
FIG. 60 is a side view showing the tape heating apparatus and a side heater portion.

FIG. 60 shows a condition that the sheet bundle $S_1$ is set at the back abutment position H by the clamping member 353. The sheet bundle $S_1$ is clamped by the clamping member 353 and is moved straightly (without excessive stress) while guiding the lower surface of the sheet bundle by the auxiliary guide plate 342, thereby setting the sheet bundle at the back abutment position H. Incidentally, a distance between the abutment member 351 and the tape heating apparatus 356 is selected to be greater than the dimension of the sheet bundle to be bookbound.

Figure 61:
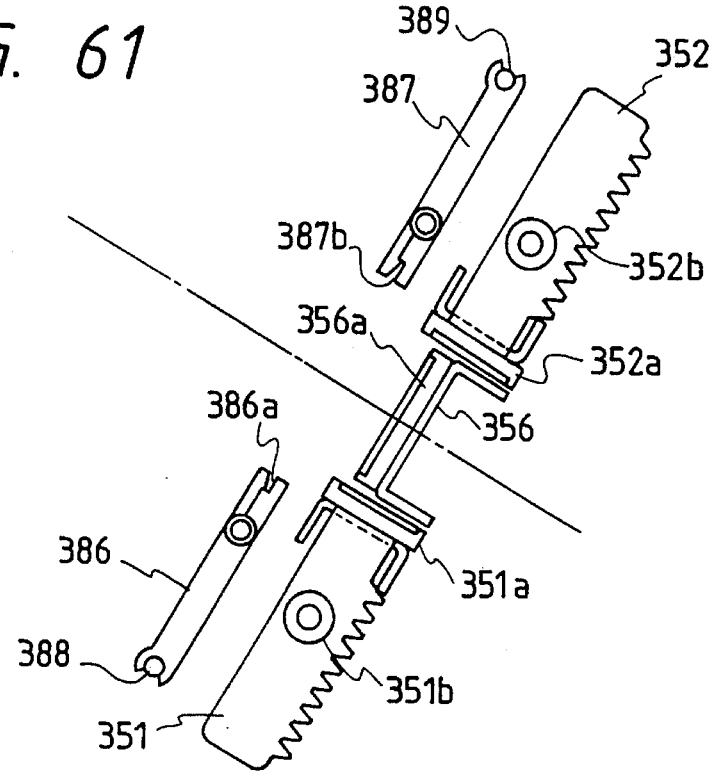
FIGS. 61 to 71 are views for explaining the operation of the system of FIG. 60.

FIG. 61 is a schematic front view of the tape heating apparatus 356.

In FIG. 61, the tape heating apparatus 356 has a back surface heater 356*a* for heating the bind tape 377. Side heaters 351, 352 arranged on both side of the tape heating apparatus 356 are provided at their inner ends with heaters 351*a*, 352*a* and are also provided at their sides with rollers 351*b*, 352*b*. In the proximity of the side heaters 351, 352, there are arranged tape guides 386, 387 having guide portions 386*a*, 387*a* at their inner ends. These tape guides are rotatably mounted on support shafts 388, 389 having fixed ends.

Figure 62:
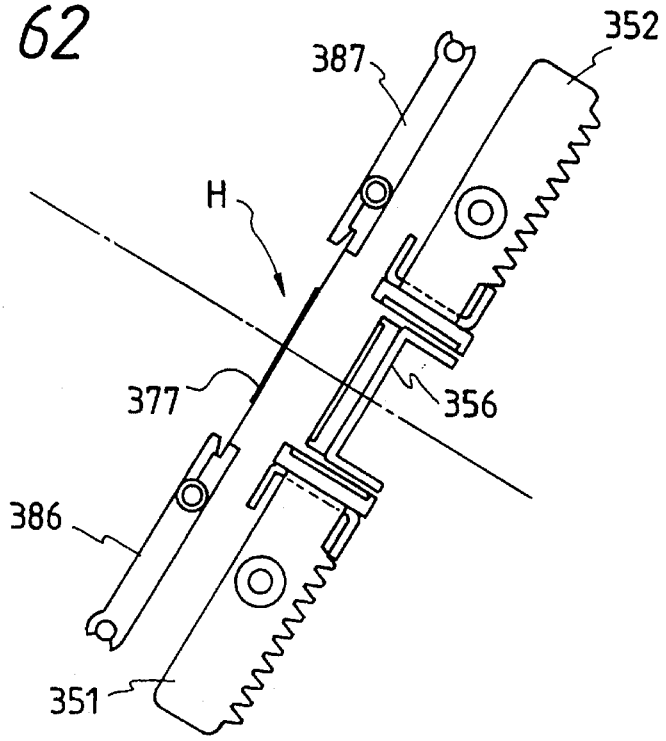

FIGS. 62 to 71 show the operation of the tape heating apparatus. In particular, FIG. 62 shows a condition that the bind tape 377 supplied from a tape supply means is guided by a tape guide to be supplied to the back abutment position H.

Figure 63:
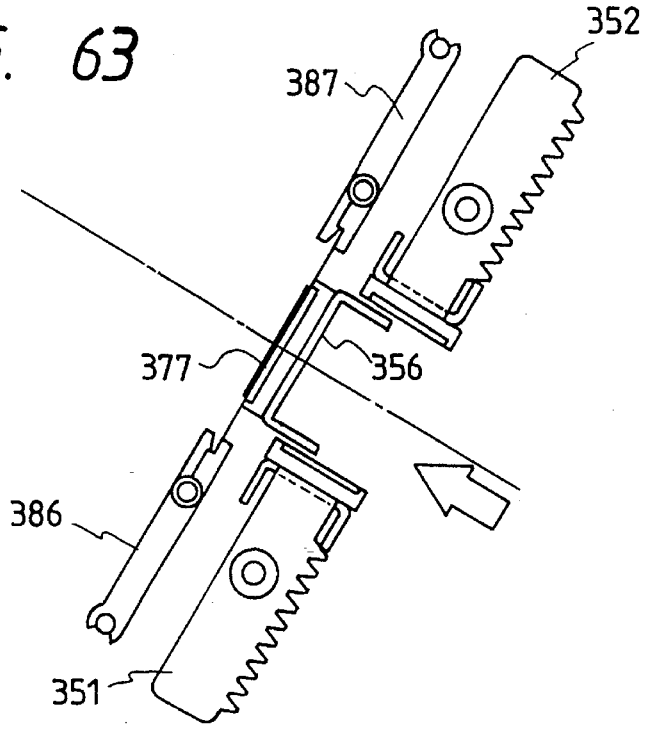

When the bind tape 377 is supplied to the back abutment position H by the tape supply means, the back surface heater 356*a* is shifted toward the tape to start the pre-heating of the bind tape 377 (FIG. 63).

Figure 64:
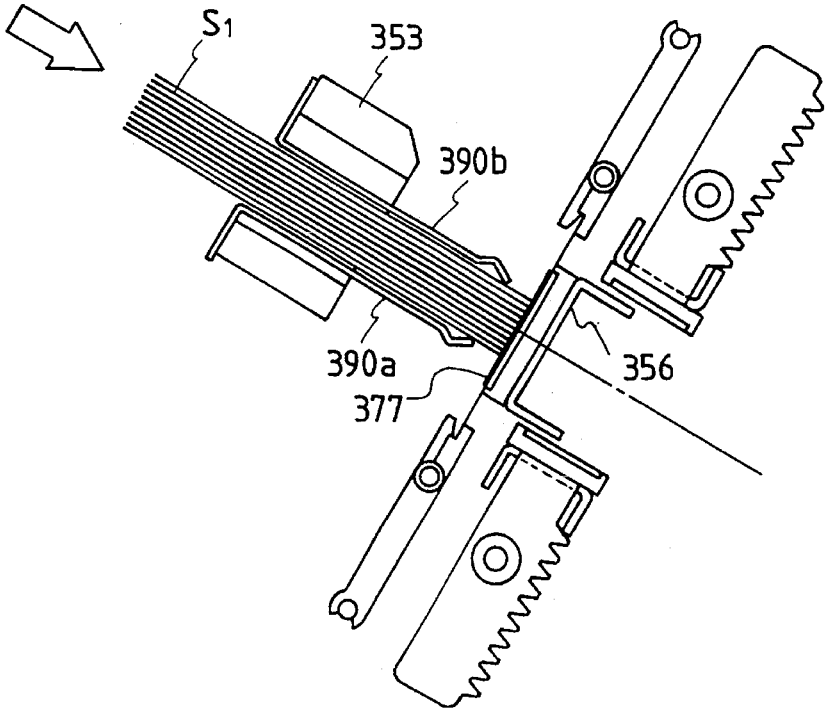

FIG. 64 shows a condition that the sheet bundle $S_1$ fed out of the sheet align tray 341 by the clamping member 353 is conveyed to the back abutment position H where the back surface of the sheet bundle is being bound. In this case, the sheet bundle $S_1$ is guided by upper and lower regulating guides 390*a*, 390*b* positioned in the proximity of the back surface of the sheet bundle, thereby preventing the sheet from spreading or swelling due to curl and/or weight of the sheet S and heat from the heating means.

Figure 65:
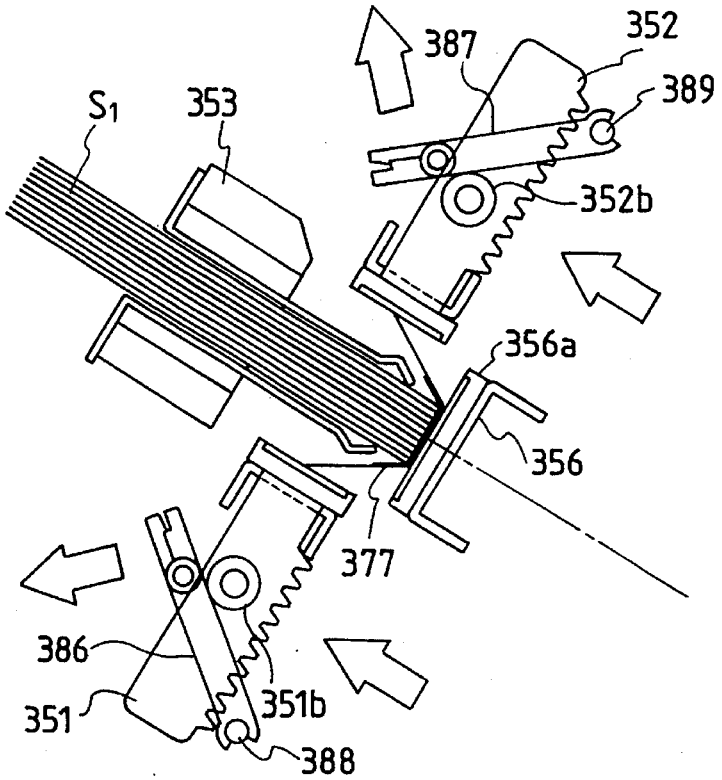

After the back surface of the sheet bundle is bound, as shown in FIG. 65, the side heaters 351, 352 start to bind the side surfaces of the sheet bundle while retracting the tape guides 386, 387 and cocking both end portions of the bind tape 377. In this case, the upper and lower regulating guides 386, 387 are retracted from the tip end of the sheet by the shifting movement of the side heaters 351, 352.

Figure 66:
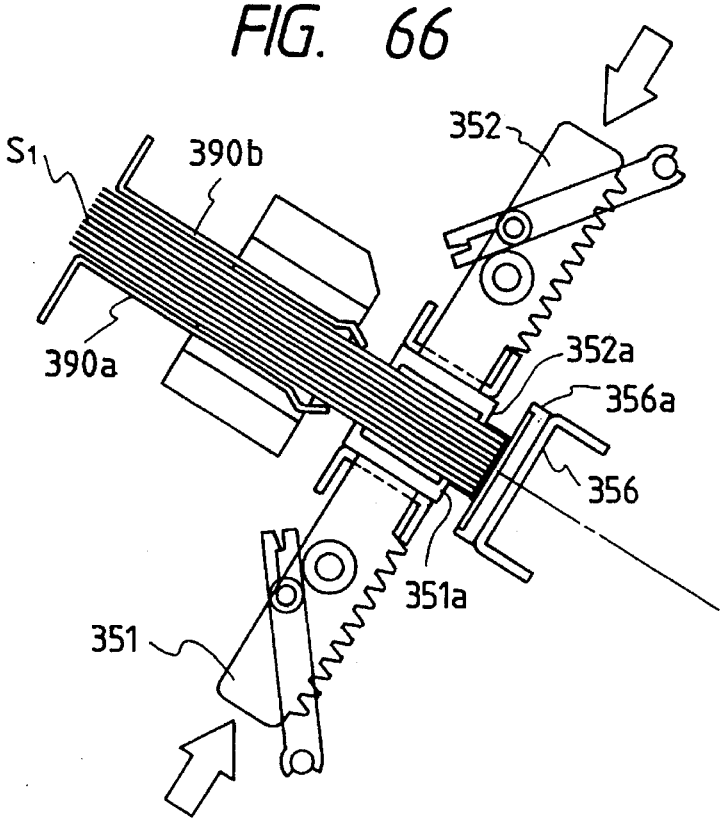

FIG. 66 shows a condition that the side surfaces of the sheet bundle is being bound. As shown in FIG. 66, the side heaters 351, 352 are shifted in directions shown by the arrows to urge the bind tape 377 against both side surfaces of the tip end portion of the sheet bundle $S_1$, thereby performing the side binding. In this case, as mentioned above, the tape guides and the upper and lower regulating guides are retracted as shown.

Figure 67:
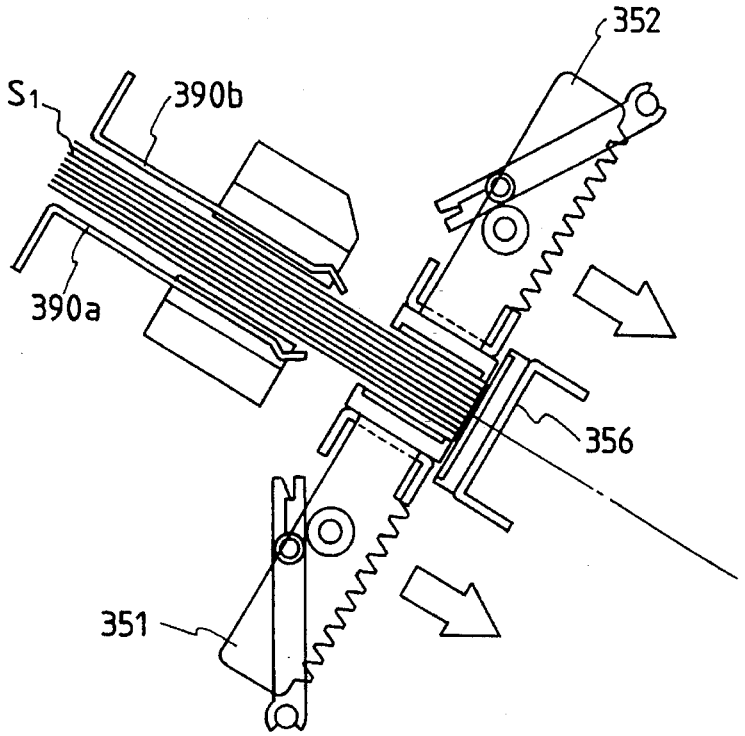
Figure 68:
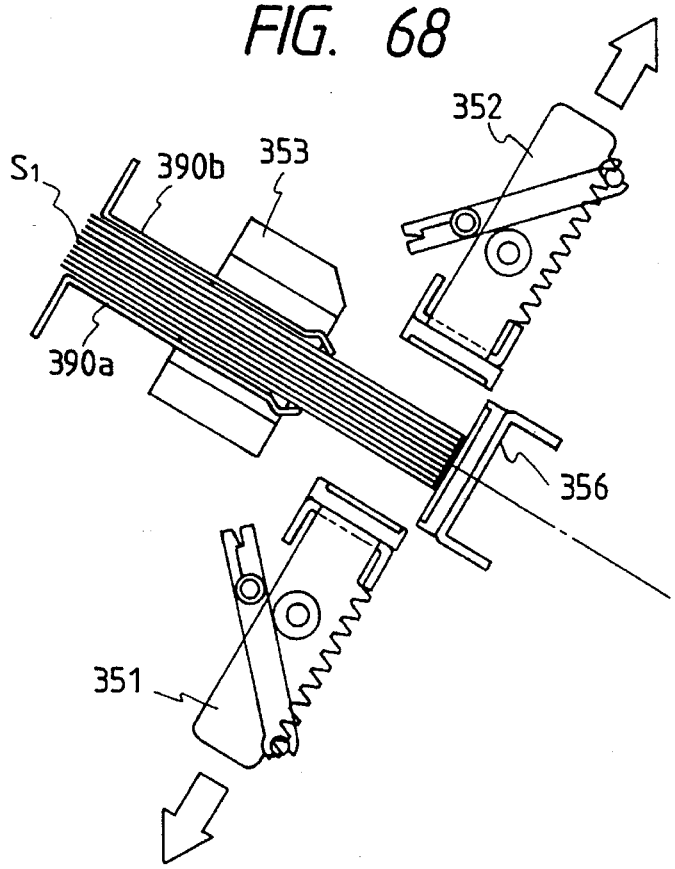
Figure 69:
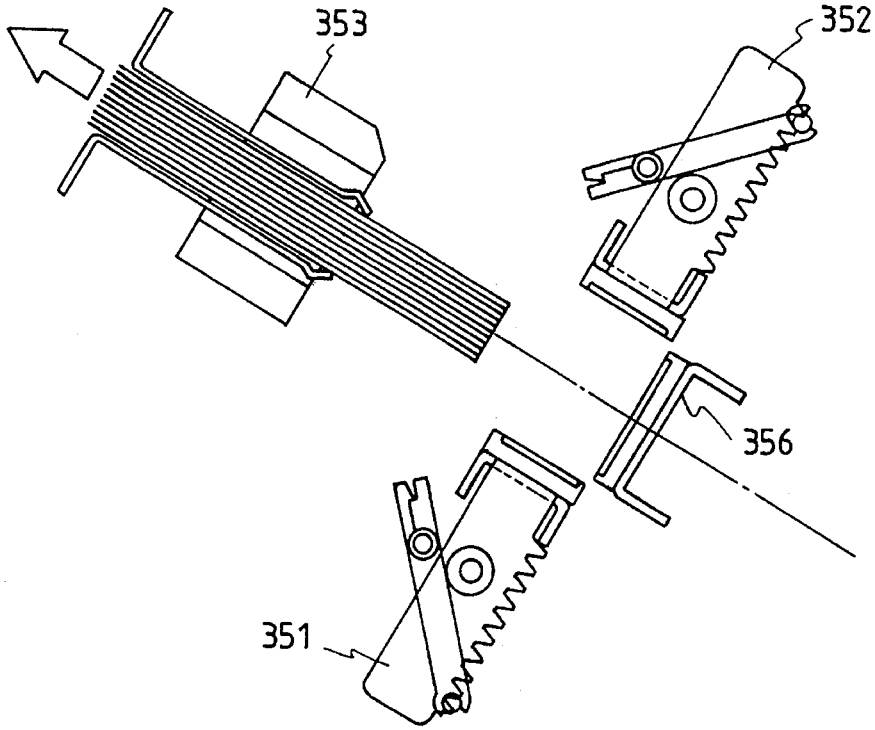

When the side binding is completed, in order to finish the bent portions of the bind tape 377, as shown in FIG. 67, the side heaters 351, 352 are shifted in directions shown by the arrows while urging the bent portions of the bind tape against the sheet bundle.

Then, the side heaters 351, 352 are shifted in directions shown by the arrows (FIG. 68) to release the sheet bundle.

When the sheet bundle is released from the side heaters 351, 352, the bookbound or finished sheet bundle $S_1$ is retarded from the back abutment position H by the clamping member (sheet bundle conveying means) 353, thereby shifting the sheet bundle to a position (FIG. 72) where the sheet bundle is received by the carriage 360.

Figure 70:
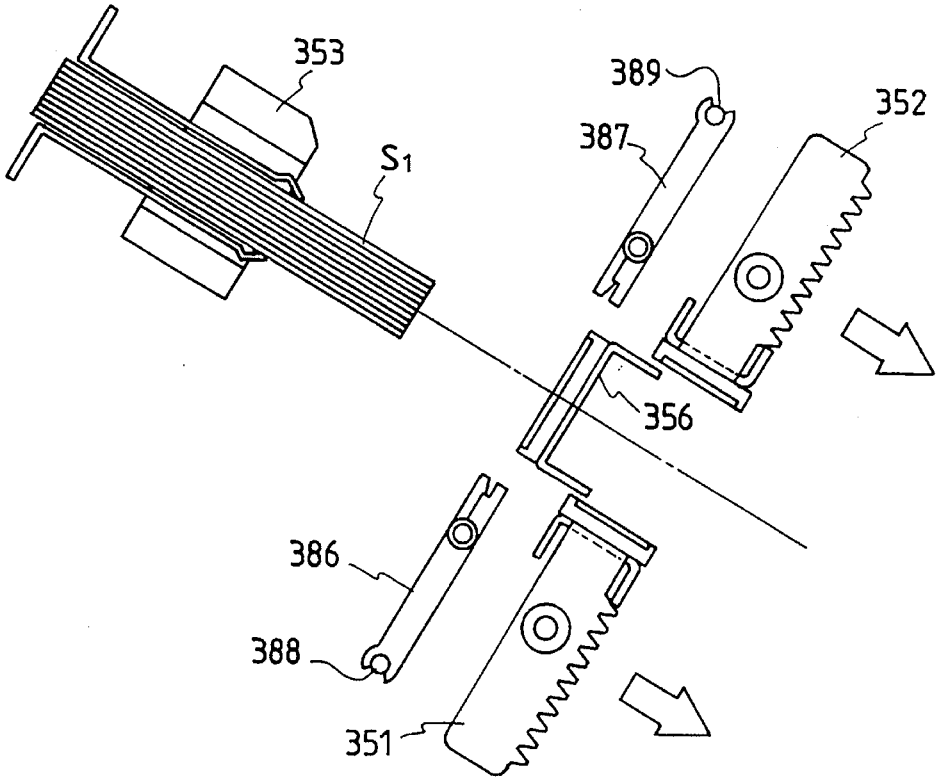
Figure 71:
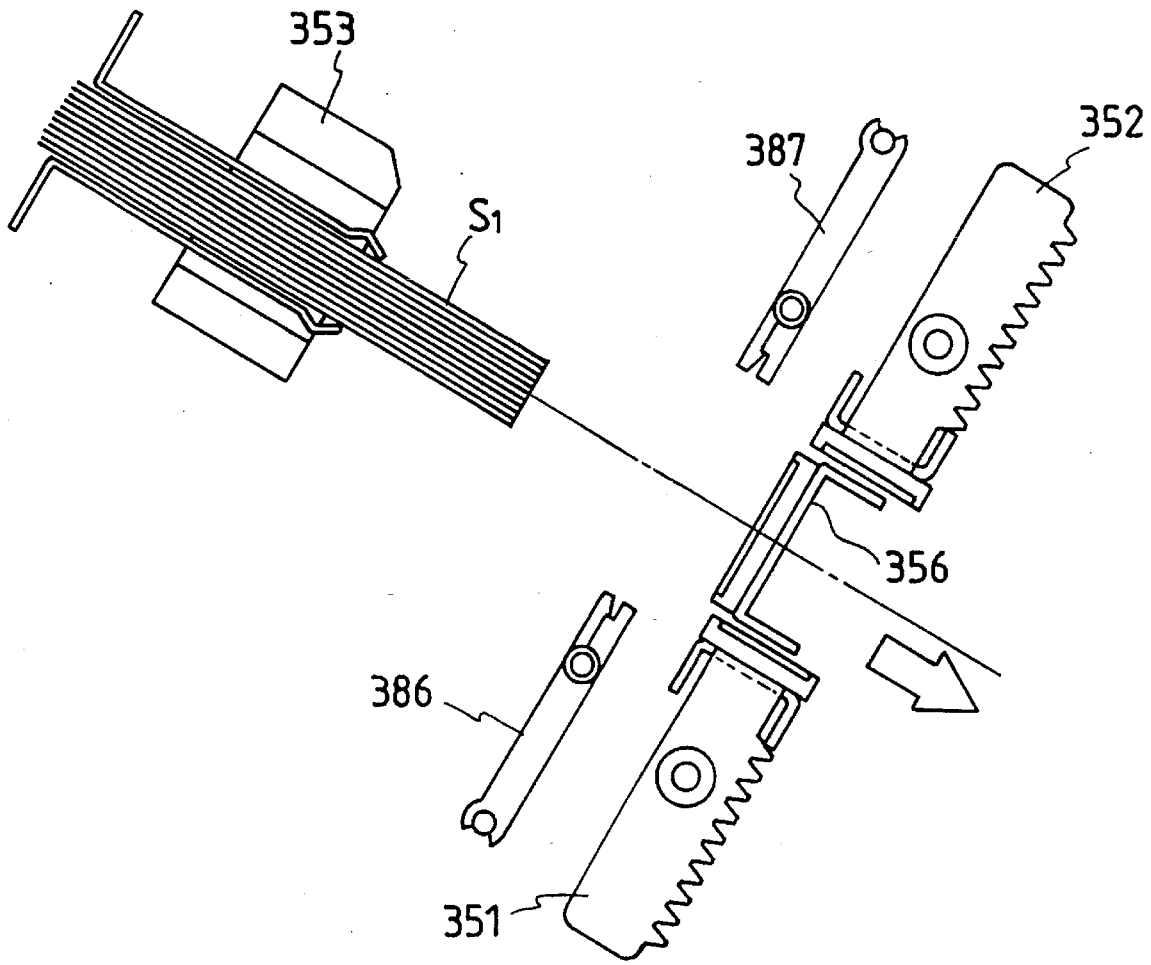

When the bookbound sheet bundle is retarded from the back abutment position H, the side heaters 351, 352 and the back surface heater 356*a* are returned to their waiting positions as shown in FIG. 70 in order to supply the next bind tape 377.

Figure 72:
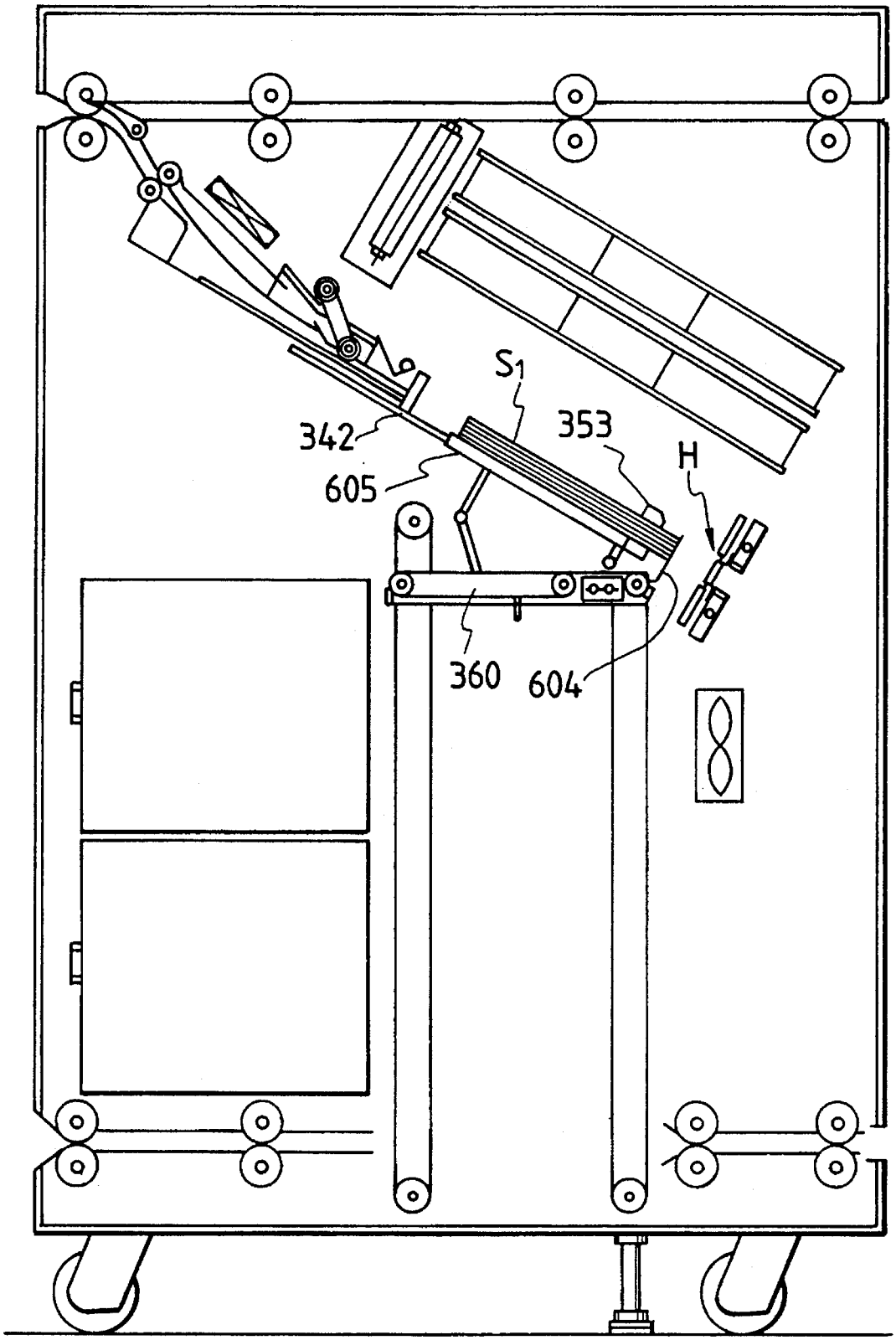
FIG. 72 is a side view of a carriage portion for conveying the sheet bundle after the bookbinding is finished.

FIG. 72 shows a condition that the bookbound sheet bundle shifted by the clamping member 353 while being guided by the auxiliary guide plate 342 is positioned at the position where the sheet bundle is received by the carriage 360. While the sheet bundle is being bound in the back abutment position H, the sheet bundle supporting rod 605 and the sheet bundle rear end supporting plate 604 of the carriage 360 are rotated around the support shaft, so that the sheet bundle supporting rod 605 cooperates with the auxiliary guide plate 342 to support the lower surface of the sheet bundle (the sheet bundle supporting rod is shifted in a direction shown by the arrow S in FIG. 51).

After the bookbinding operation is finished, the bookbound sheet bundle is shifted in a direction shown by the arrow C (FIG. 51) by the clamping member 353 to be separated from the heaters. Thereafter, the sheet bundle rear end supporting plate is shifted between the sheet bundle and the heater.

Figure 73:
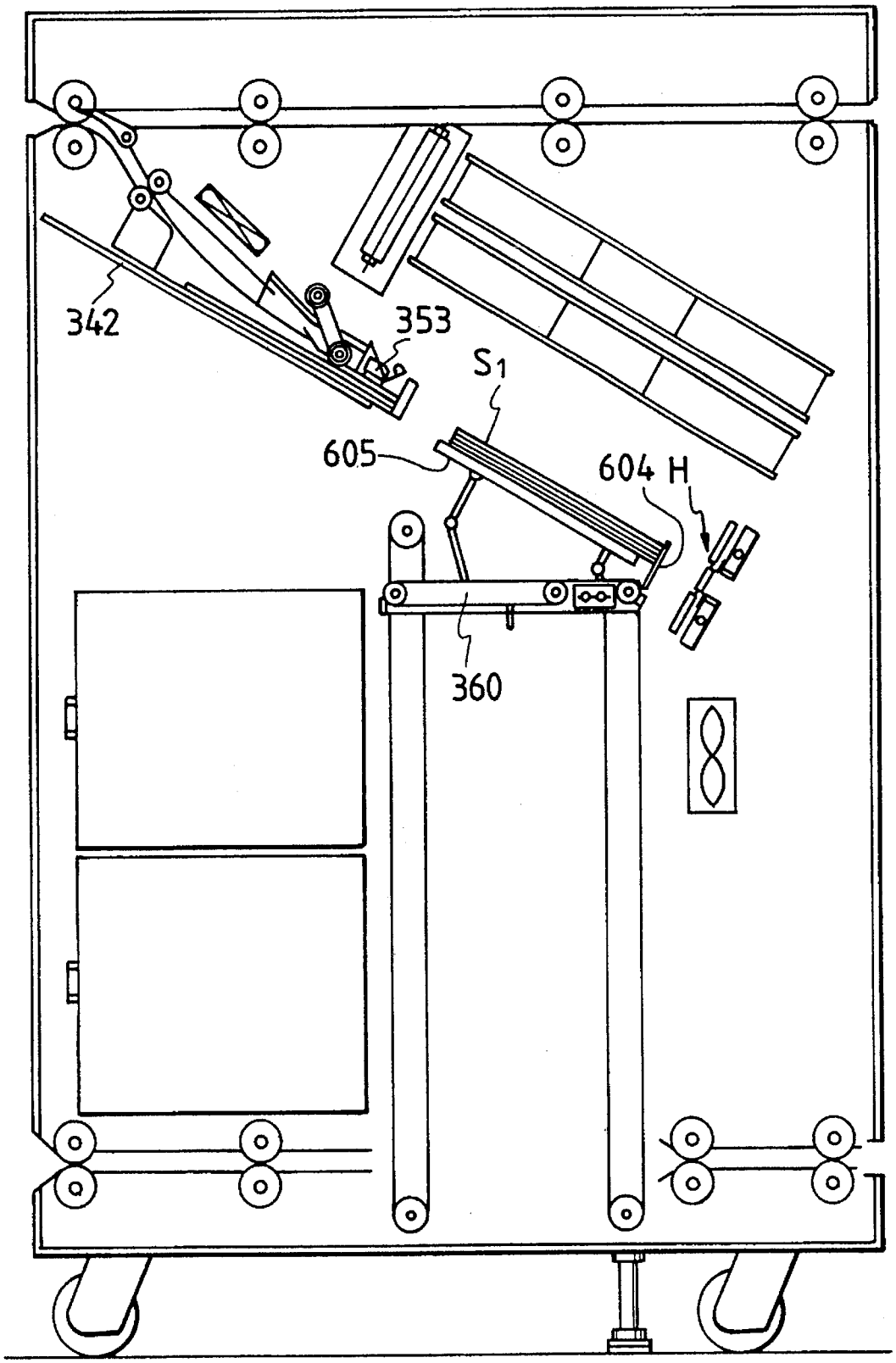
FIGS. 73 to 77 are views for explaining the operation of the carriage portion of FIG. 72.

FIG. 73 shows a condition that the clamping member 353 is separated from the sheet bundle $S_1$ and the end of the sheet bundle is abutted against the sheet bundle rear end supporting plate 604, thereby supporting the sheet bundle in a direction B (FIG. 51). The sheet bundle supporting rod is further shifted in the direction D (FIG. 51) so that the lower surface of the sheet bundle is supported only by the sheet bundle supporting rod. Thereafter, the clamping member and the auxiliary guide plate are returned toward the sheet align tray (FIG. 73).

Since the sheet bundle is lifted above the moving path of the auxiliary guide plate 342 by the sheet bundle supporting rod 605, the clamping member 353 and the auxiliary guide plate 342 can be returned to the sheet align tray 341.

Figure 74:
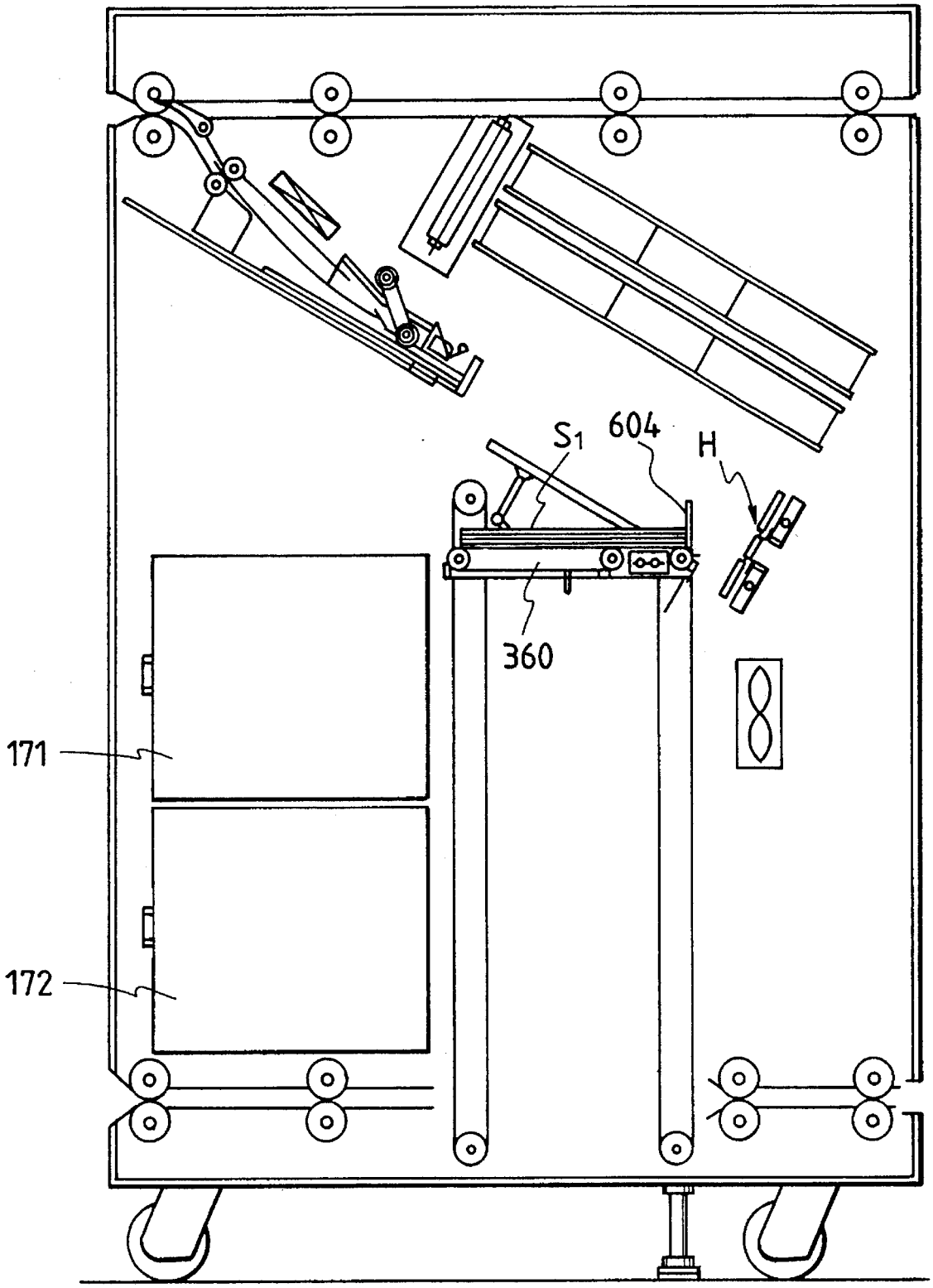

After the clamping member 353 and the auxiliary guide plate 342 are returned to the sheet align tray 341, the sheet bundle supporting rod 605 and the sheet bundle rear end supporting plate 604 are rotated in a direction shown by the arrow E (FIG. 51), thereby orienting the sheet bundle horizontally (FIG. 74). In this horizontal position, the sheet bundle is contacted with the convey belt 361. Since the convey belt has a plurality of combs, the rod 605 can be lowered through between the combs.

Figure 75:
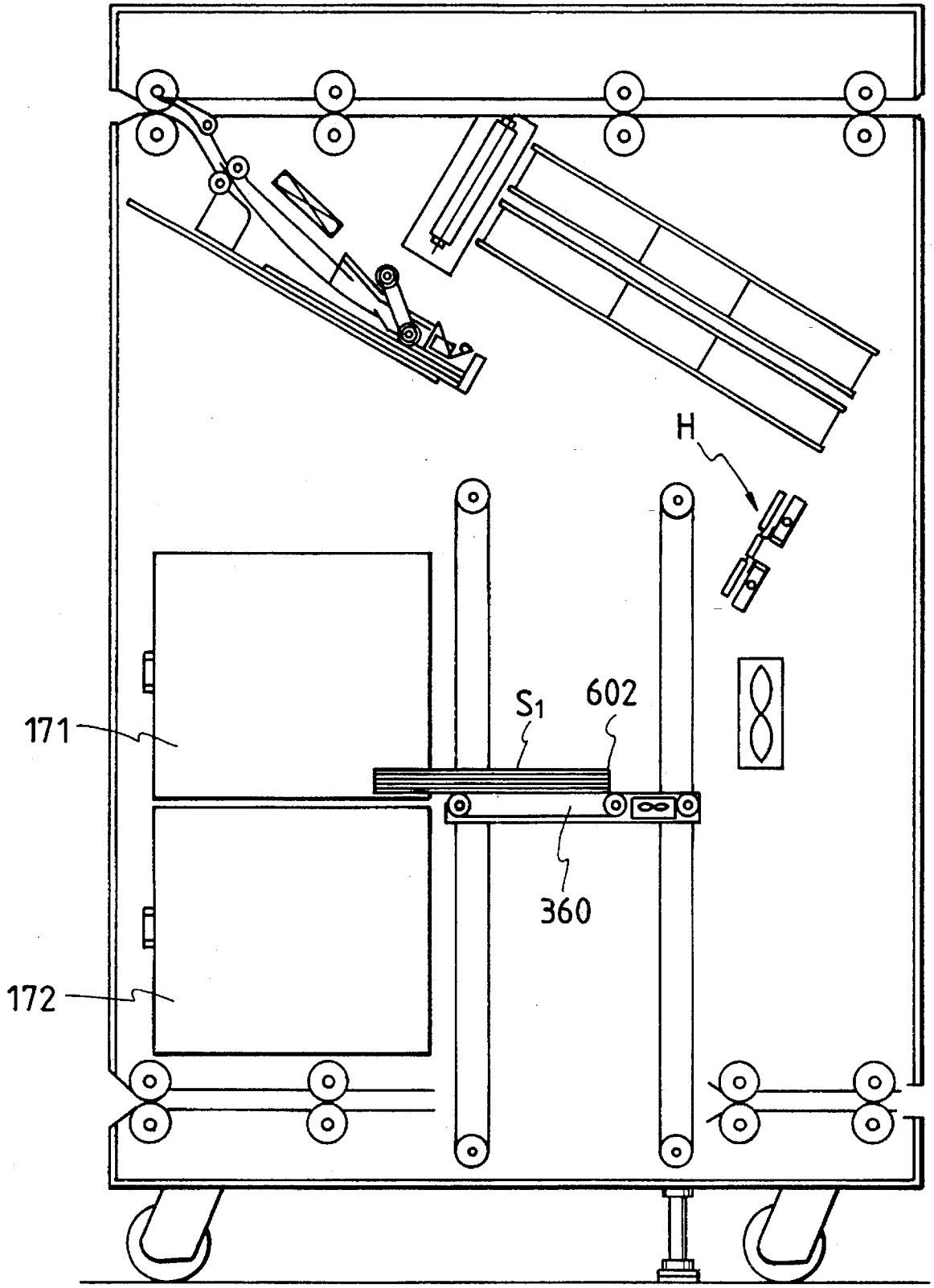
Figure 76:
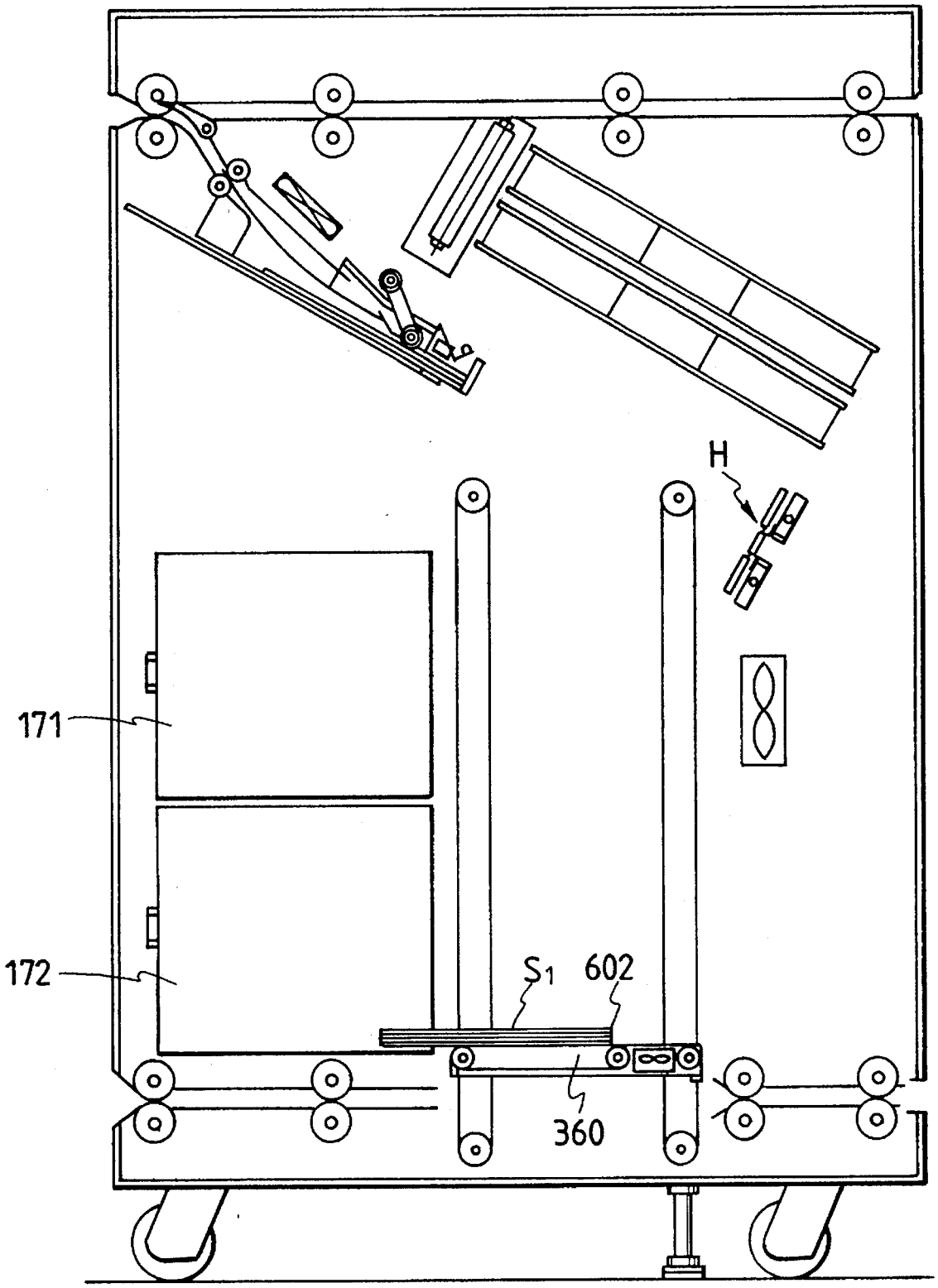

FIGS. 75 and 76 show a condition that the bookbound sheet bundle is contained into the stackers 171 and 172, respectively. The bookbound sheet bundle on the carriage 360 is contained into the stacker 171 or 172 by the convey belt 361 and the rear pushing member 604.

Figure 77:
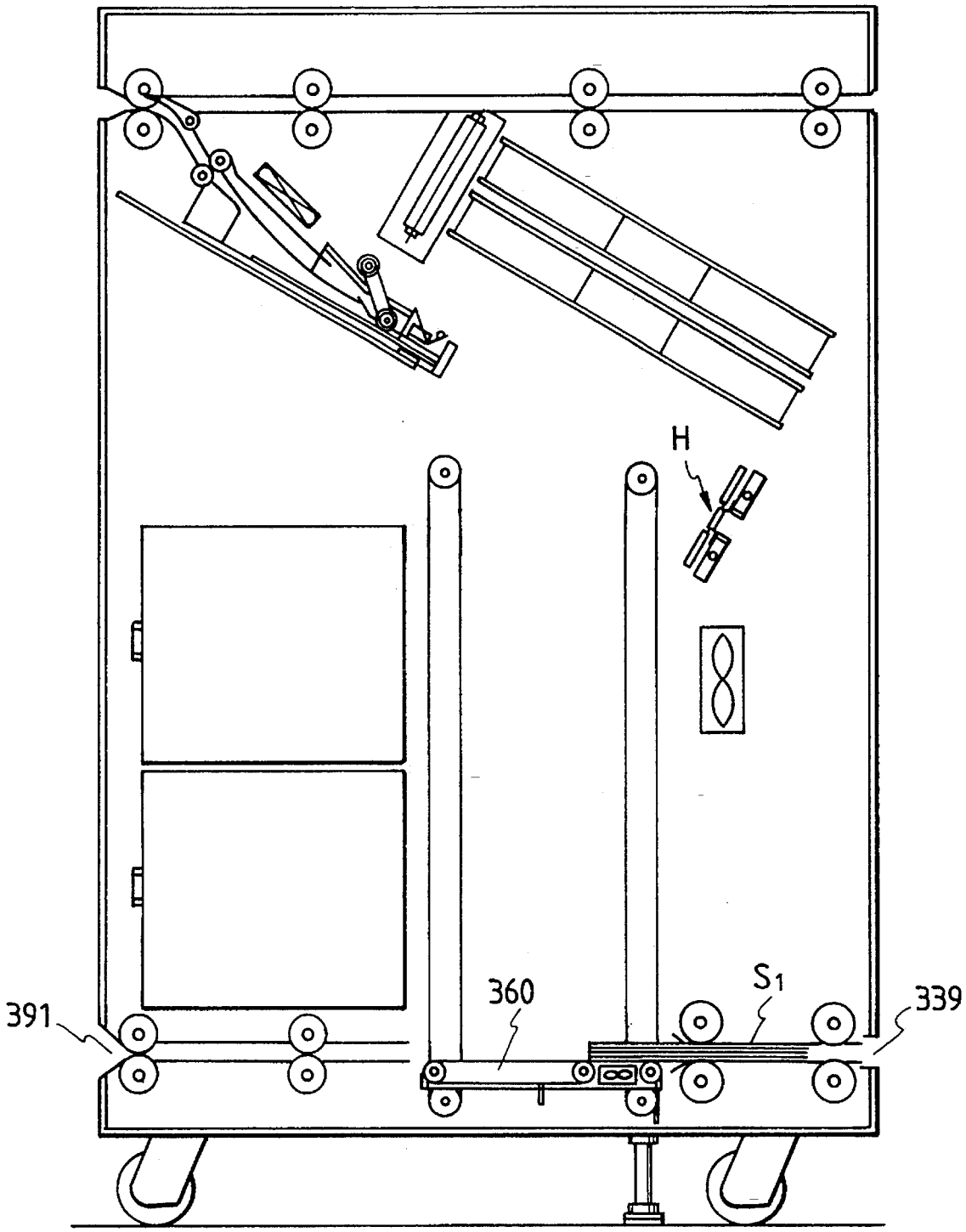
Figure 78:
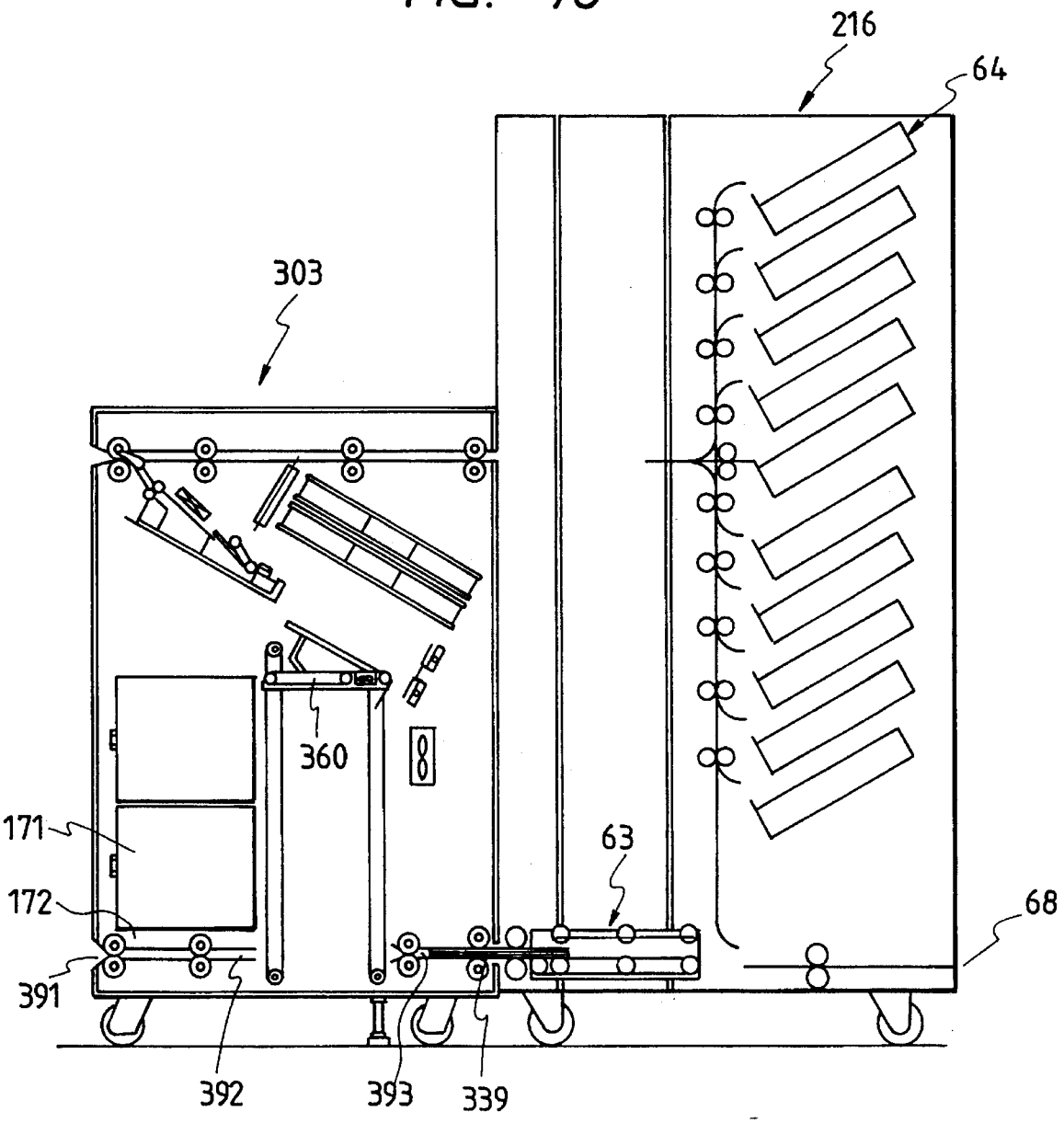
FIG. 78 is a sectional side view showing the bookbinding apparatus and the sorting apparatus.
Figure 79:
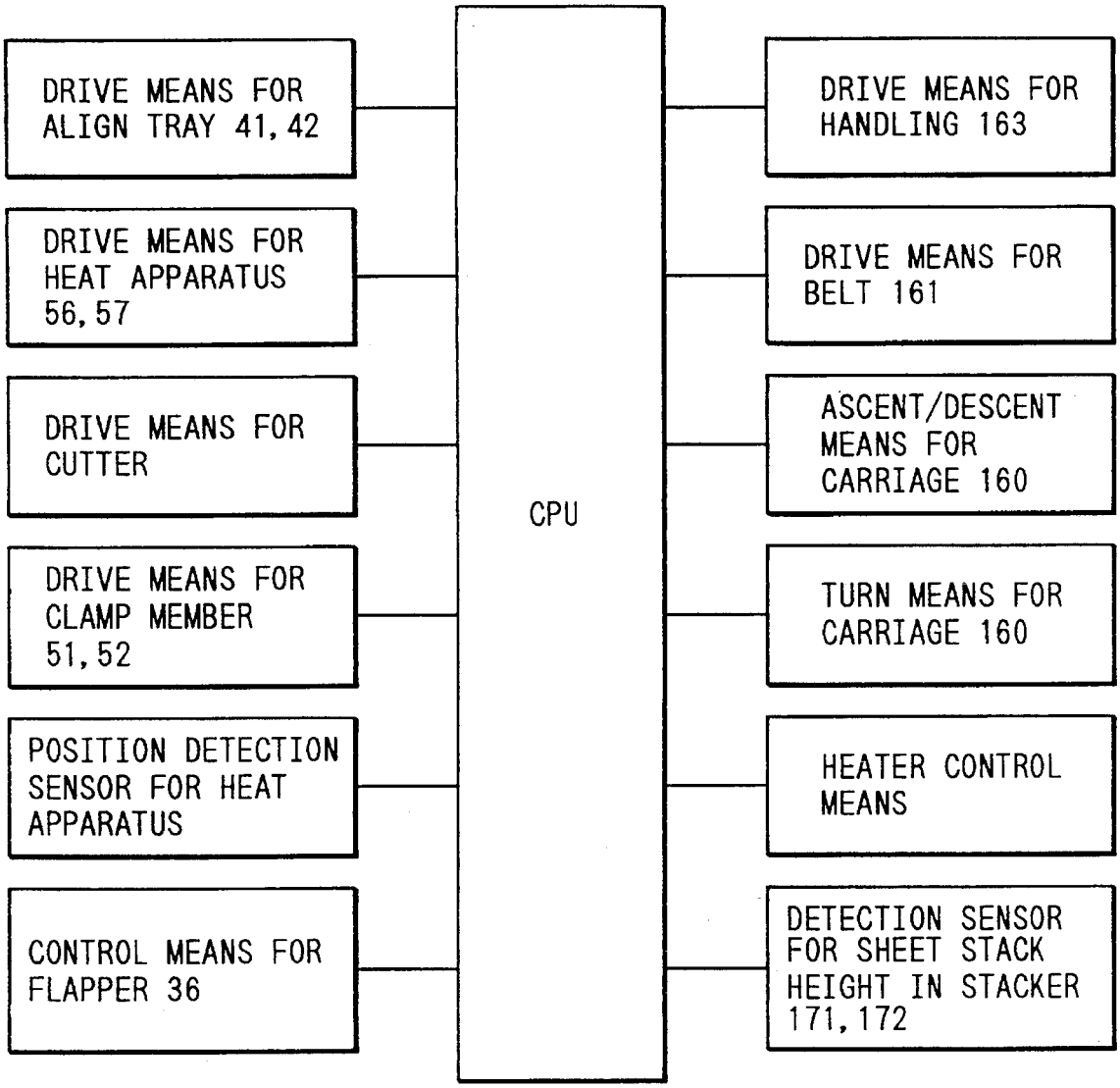
FIG. 79 is a block diagram of the system of FIG. 78.

On the other hand, when the bookbound sheet bundle on the carriage 360 is not contained in the stackers 171, 172, as shown in FIG. 77, the bookbound sheet bundle is discharged out of the apparatus through a second discharge opening 339. In FIG. 78, the bookbound sheet bundle discharged from the bookbinding apparatus 303 is received by an elevator 63 positioned at a lower portion of the sheet sorting and containing apparatus 216. By shifting the elevator upwardly or downwardly, the bookbound sheet bundle is contained into a desired discharge tray 64. When the bookbound sheet bundle is not contained into the discharge tray 64, the sheet bundle is discharged out of the sheet sorting and containing apparatus 216 through the elevator 63 positioned at the lowermost position.

On the other hand, when an unbound sheet bundle or a sheet is discharged into the sheet sorting and containing apparatus through the bookbinding apparatus, the carriage 360 is shifted to the lower portion of the bookbinding apparatus. The unbound sheet bundle or the sheet enters into a second inlet opening 391 below the stacker 172 through a path 12*b* and is discharged from the second discharge opening 339 through a left side convey path 392, carriage 360 and right side convey path 393 and through a path 68. With the arrangement as mentioned above, when the unbound sheet bundle is discharged out of the sheet sorting and containing apparatus 216, since the sheet bundle does not pass through the convey paths for distributing the sheets, the sheet bundle can easily be discharged out of the apparatus.

As mentioned above, according to the present invention, the sheet bundle can be contained in the stacker or be discharged out of the apparatus, if desired.

Further, since the discharge opening is provided independently from the stacker, another sheet post-treatment apparatus can be connected to the book binding apparatus downstream thereof, thereby increasing the productivity.

Further, by providing the sheet bundle receiving means for receiving the sheet bundle sent from the sheet align tray to the back abutment position where to bind tape was adhered to the sheet bundle by the tape heating apparatus, the bookbound sheet bundle can be rested on the endless belt of the convey means by rocking the sheet bundle receiving means. Furthermore, by lowering the convey means and then by rotating the endless belt, the bookbound sheet bundle can be contained into the selected stacker or be discharged from the discharge opening onto another downstream apparatus such as a sorting apparatus.

Further, when the sheet bundle receiving means receives the sheet bundle, by regulating the bookbound sheet bundle by the stopper, the receiving means can stably receive the sheet bundle. In addition, when the bookbound sheet bundle is contained into the stacker, by pushing the sheet bundle not only by the belt convey means but also by the stopper, the sheet bundle can positively be contained into the stacker.

What is claimed is:

1. A book binding apparatus comprising:

sheet storing means for temporarily storing a sheet;

binding means for binding sheets as a sheet bundle;

transfer means for conveying the bound sheet bundle;

a discharge opening for discharging the bound sheet bundle conveyed by said transfer means to a position external to the apparatus; and stacker means arranged in a confronting relation to said discharge opening with the interposition of said transfer means, for storing the bound sheet bundle.

2. A book binding apparatus according to claim 1, wherein said transfer means is reciprocally shifted between said stacker means and said binding means.

3. A book binding apparatus according to claim 2, wherein said transfer means includes convey means for directing the sheet bundle to said stacker means or said discharge opening.

4. A book binding apparatus according to claim 3, wherein said convey means is a belt.

5. A book binding apparatus according to claim 3, wherein said transfer means includes receiving means for receiving the sheet bundle bound by said binding means.

6. A book binding apparatus according to claim 5, further comprising stopper means operated when said receiving means receives the sheet bundle, and wherein said stopper means cooperates with said convey means to convey the sheet bundle.

7. A book binding apparatus according to claim 1, wherein said stacker means has a plurality of stackers disposed to be inserted and retracted independently.

8. A book binding apparatus according to claim 1, wherein said binding means comprises gluing means having tape heating means.

9. A book binding apparatus according to claim 8, wherein said tape heating means supplies a bind tape to a tip end of the sheet bundle at a back abutment position and adheres the bind tape to the sheet bundle by heating the bind tape.

10. A book binding apparatus according to claim 9, wherein the back abutment position is disposed on a substantially straight line extending in a aligning direction of the tip end of the sheet bundle.

11. A book binding apparatus according to claim 1, further comprising a path for introducing the sheet to a second discharge opening without using said sheet storing means.

12. A book binding apparatus comprising:

sheet storing means for temporarily storing a sheet;

binding means for binding sheets as a sheet bundle;

transfer means for conveying the bound sheet bundle;

a discharge opening for discharging the bound sheet bundle conveyed by said transfer means to a position external to the apparatus; and stacker means for storing the bound sheet bundle, wherein said transfer means selects whether to introduce the bound sheet bundle to said stacker means or to said discharge opening.

13. An image forming apparatus comprising:

said book binding apparatus according to claim 1;

a body arranged at an upstream side of a sheet entrance portion of said book binding apparatus and including an image forming means for forming an image on the sheet; and a sheet sorting apparatus arranged downstream of said discharge openings for sorting or distributing the bound sheet bundle.

14. An image forming apparatus according to claim 13, wherein said sheet sorting apparatus has a plurality of bin trays, and a carriage for shifting the sheet or the sheet bundle along an array of said bin trays.

* * * * *

UNITED STATES PATENT AND TRADEMARK OFFICE

CERTIFICATE OF CORRECTION

PATENT NO. : 5,540,421 Page 1 of 4

DATED : July 30, 1996

INVENTOR(S) : Hiroshi OHTA, et al.

It is certified that error appears in the above-indentified patent and that said Letters Patent is hereby corrected as shown below: On the title page:

ITEM [75] - Inventors:

Line 6, "Yamanaka; Kozo Sakakibara," should read --Yamanaka, Kawasaki; Kozo Sakakibara,--.

COLUMN 3:

Line 13, "stacker" should read --stackers--.

COLUMN 4:

Line 66, "shows" should read --show--.

COLUMN 5:

Line 25, "sheet" should read --sheets--.

COLUMN 6:

Line 38, "the" (first occurrence) should read --the sheet--.

COLUMN 7:

Line 3, "[In" should read --[In the--;
Line 65, "staker" should read --stacker--; and,
Line 67, "rays" should read --trays--.

UNITED STATES PATENT AND TRADEMARK OFFICE

CERTIFICATE OF CORRECTION

PATENT NO. : 5,540,421 Page 2 of 4

DATED : July 30, 1996

INVENTOR(S) : Hiroshi OHTA, et al.

It is certified that error appears in the above-indentified patent and that said Letters Patent is hereby corrected as shown below:

COLUMN 8:

Line 41, "effects" should read --effect--.

COLUMN 10:

Line 10, "thickness-smaller" should read --thickness smaller--;
Line 32, "70a-70a" should read --70a-70e--; and,
Line 62, "convey" should read --convey--.

COLUMN 11:

Line 63, "[In" should read --[In the--; and,
Line 64, "aas" should read --as--.

COLUMN 12:

Line 27, "in case of" should read --in the case of a--.

COLUMN 14:

Line 40, "pair" (first occurrence) should read --pairs--.

COLUMN 17:

Line 10, "77A" should read --177A--.

UNITED STATES PATENT AND TRADEMARK OFFICE

CERTIFICATE OF CORRECTION

PATENT NO. : 5,540,421 Page 3 of 4

DATED : July 30, 1996

INVENTOR(S) : Hiroshi OHTA, et al.

It is certified that error appears in the above-indentified patent and that said Letters Patent is hereby corrected as shown below:

COLUMN 18:

Line 25, "pass-by" should read --bypass--;
Line 48, "heater.122" should read --heater 122--; and,
Line 65, "pass-by" should read --bypass--.

COLUMN 19:

Line 19, "of" should read --of which is--; and,
Line 60, "stacker," should read --stackers,--.

COLUMN 20:

Line 23, "pair" should read --pairs--; and,
Line 62, "which" should read --which is--.

COLUMN 21:

Line 67, "in synchronous" should read --synchronously--.

COLUMN 22:

Line 29, "side" should read --sides--; and,
Line 63, "is" should read --are--.

UNITED STATES PATENT AND TRADEMARK OFFICE

CERTIFICATE OF CORRECTION

PATENT NO. : 5,540,421 Page 4 of 4

DATED : July 30, 1996

INVENTOR(S) : Hiroshi OHTA, et al.

It is certified that error appears in the above-indentified patent and that said Letters Patent is hereby corrected as shown below:

COLUMN 24:

Line 37, "to" (second occurrence) should read --the--.

COLUMN 25:

Line 27, "a" should read --an--.

Signed and Sealed this

Twenty-eighth Day of January, 1997

*Attest:*

Bruce Lehman

BRUCE LEHMAN

*Attesting Officer*

*Commissioner of Patents and Trademarks*